US009039153B2

(12) United States Patent
Matsuzaki et al.

(10) Patent No.: US 9,039,153 B2
(45) **Date of Patent: *May 26, 2015**

(54) PRINTING APPARATUS AND PRINTING MATERIAL SUPPLY SYSTEM

(71) Applicant: Seiko Epson Corporation, Tokyo (JP)

(72) Inventors: Kazutoshi Matsuzaki, Shiojiri (JP); Kazumasa Harada, Matsumoto (JP); Satoshi Nakata, Matsumoto (JP); Hidetaka Kawata, Suwa (JP); Izumi Nozawa, Matsumoto (JP); Hidetoshi Kodama, Matsumoto (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/739,451

(22) Filed: Jan. 11, 2013

(65) Prior Publication Data

US 2013/0182052 A1 Jul. 18, 2013

(30) Foreign Application Priority Data

| | | |
|---|---|---|
| Jan. 12, 2012 | (JP) | 2012-003652 |
| Jan. 12, 2012 | (JP) | 2012-003653 |
| Jan. 12, 2012 | (JP) | 2012-003694 |
| Jan. 12, 2012 | (JP) | 2012-003698 |
| Jan. 12, 2012 | (JP) | 2012-003701 |

(51) Int. Cl.
*B41J 2/175* (2006.01)

(52) U.S. Cl.
CPC ..... *B41J 2/17526* (2013.01); *B41J 2/17509* (2013.01); *B41J 2/1752* (2013.01)
USPC ..... 347/86

(58) Field of Classification Search
None
See application file for complete search history.

(56) References Cited

U.S. PATENT DOCUMENTS

| | | | |
|---|---|---|---|
| 4,907,018 | A | 3/1990 | Pinkerpell et al. |
| 6,276,780 | B1 | 8/2001 | Carrese et al. |

(Continued)

FOREIGN PATENT DOCUMENTS

| | | | |
|---|---|---|---|
| DE | 102006036716 | B3 | 9/2007 |
| EP | 0698497 | A3 | 3/1999 |

(Continued)

OTHER PUBLICATIONS

Combined Search and Examination Report issued on Jun. 3, 2013 in U.K. Patent Appln. No. GB1300618.4.

(Continued)

*Primary Examiner* — Matthew Luu
*Assistant Examiner* — Erica Lin
(74) *Attorney, Agent, or Firm* — Stroock & Stroock & Lavan LLP

(57) ABSTRACT

A printing apparatus adapted to have a cartridge detachably mounted thereon includes a cartridge mounting structure, a printing material supply tube, a plurality of apparatus-side terminals and a lever used for attachment and detachment of the cartridge to and from the printing apparatus. The lever has an operating member, a first apparatus-side locking portion and an axis of rotation. When an external force is applied to the operating member of the lever from the +X-axis direction to the −X-axis direction, the lever moves the first apparatus-side locking portion about the axis of rotation from a specified locking position toward the +X-axis direction and disengages the first apparatus-side locking portion from a first cartridge-side restriction portion, so as to eliminate the restriction of motion of the cartridge. This ensures stable electrical connection between cartridge-side terminals and apparatus-side terminals.

19 Claims, 41 Drawing Sheets

F4–F4 CROSS SECTION

(56) References Cited

U.S. PATENT DOCUMENTS

| | | | | |
|---|---|---|---|---|
| 6,488,369 | B1 | 12/2002 | Steinmetz et al. | |
| 6,502,917 | B1 | 1/2003 | Shinada et al. | |
| 6,955,422 | B2 | 10/2005 | Miyazawa et al. | |
| 6,979,079 | B2 | 12/2005 | Hashii et al. | |
| 7,213,914 | B2 | 5/2007 | Anma et al. | |
| 7,237,881 | B2 | 7/2007 | Hayasaki et al. | |
| 7,244,018 | B2 | 7/2007 | Hashii et al. | |
| 7,278,721 | B2 | 10/2007 | Shimizu et al. | |
| 7,562,958 | B2 | 7/2009 | Asauchi | |
| 7,712,986 | B2 | 5/2010 | DeVore et al. | |
| 8,172,386 | B2 | 5/2012 | Petranek et al. | |
| 8,177,340 | B2 | 5/2012 | Harazim | |
| 8,297,738 | B1 | 10/2012 | Kodama et al. | |
| 8,297,739 | B1 | 10/2012 | Kodama et al. | |
| 8,439,482 | B1 | 5/2013 | Kodama et al. | |
| 2002/0135634 | A1 | 9/2002 | Lodal et al. | |
| 2005/0168546 | A1 | 8/2005 | Studholme et al. | |
| 2006/0139422 | A1 | 6/2006 | Hatasa et al. | |
| 2006/0250426 | A1 | 11/2006 | Wanibe et al. | |
| 2007/0279464 | A1 * | 12/2007 | Harazim | 347/86 |
| 2008/0211892 | A1 | 9/2008 | Kotaki et al. | |
| 2009/0051745 | A1 | 2/2009 | Watanabe et al. | |
| 2009/0096850 | A1 | 4/2009 | Sulser et al. | |
| 2011/0012962 | A1 | 1/2011 | Nakano et al. | |
| 2011/0063386 | A1 | 3/2011 | Petranek et al. | |
| 2012/0056955 | A1 | 3/2012 | Kodama et al. | |
| 2012/0056956 | A1 | 3/2012 | Kodama et al. | |
| 2012/0256991 | A1 | 10/2012 | Kodama et al. | |

FOREIGN PATENT DOCUMENTS

| | | | |
|---|---|---|---|
| EP | 1547782 | A2 | 6/2005 |
| EP | 1547783 | A2 | 6/2005 |
| EP | 1547783 | A3 | 11/2006 |
| EP | 1892104 | A1 | 2/2008 |
| JP | 2000062212 | A | 2/2000 |
| JP | 2002-019142 | A | 1/2002 |
| JP | 2003-011390 | A | 1/2003 |
| JP | 2004209663 | A | 7/2004 |
| JP | 2005-022345 | A | 1/2005 |
| JP | 2005-144723 | A | 6/2005 |
| JP | 2007-230249 | A | 9/2007 |
| WO | 2009/143422 | A2 | 11/2009 |

OTHER PUBLICATIONS

Office Action issued on May 25, 2012 in U.S. Appl. No. 13/410,461 (now Patent No. 8,297,738), filed Mar. 2, 2012.

Office Action issued on May 25, 2012 in U.S. Appl. No. 13/410,478 (now Patent No. 8,297,739), filed Mar. 2, 2012.

International Search Report and the Written Opinion of the International Searching Authority issued on Dec. 14, 2012 in International Application No. PCT/JP2012/001395, filed on Mar. 1, 2012.

International Search Report and the Written Opinion of the International Searching Authority issued on Dec. 17, 2012 in International Application No. PCT/JP2012/001397, filed on Mar. 1, 2012.

International Search Report and the Written Opinion of the International Searching Authority issued on Dec. 17, 2012 in International Application No. PCT/JP2012/001409, filed on Mar. 1, 2012.

International Search Report and the Written Opinion of the International Searching Authority issued on Dec. 17, 2012 in International Application No. PCT/JP2012/001410, filed on Mar. 1, 2012.

Extended European Search Report issued on Sep. 10, 2014 in European Application No. 13192668.5.

Examiner's Report issued on Sep. 9, 2014 in Canadian Patent Application No. 2,807,789.

Chinese Office Action and English translation of Chinese Office Action issued on Sep. 23, 2014 in Chinese Patent Application No. 201280003040.0.

Extended European Search Report issued on Mar. 10, 2015 in European Patent Application No. 14195157.4.

* cited by examiner

F4-F4 CROSS SECTION

F8–F8 CROSS SECTION

VIEW OF ARROW F9

VIEW OF ARROW F10

F16–F16 CROSS SECTION

PRINTING APPARATUS AND PRINTING MATERIAL SUPPLY SYSTEM

CROSS-REFERENCE TO RELATED APPLICATIONS

This application claims priority to Japanese Patent Application No. 2012-003694 filed on Jan. 12, 2012, Japanese Patent Application No. 2012-003698 filed on Jan. 12, 2012, Japanese Patent Application No. 2012-003653 filed on Jan. 12, 2012, Japanese Patent Application No. 2012-003652 filed on Jan. 12, 2012, and Japanese Patent Application No. 2012-003701 filed on Jan. 12, 2012, the entire contents of each of which is incorporated by reference herein.

BACKGROUND OF THE INVENTION

1. Field of the Invention

The present invention relates to a printing apparatus and a printing material supply system having the printing apparatus.

2. Description of the Related Art

The recently cartridges have been equipped with a circuit board for processing information regarding the printing material (for example, information regarding the remaining amount of the printing material). For attachment of this cartridge to a printing apparatus, the circuit board of the cartridge is electrically connected with the printing apparatus through the contact between terminals on the cartridge and terminals on the printing apparatus. Accompanied with the recent downsizing of the terminals, there is the increasing importance of stably maintaining electrical connection between the terminals on the cartridge (hereinafter referred to as "cartridge-side terminals") and the terminals on the printing apparatus (hereinafter referred to as "apparatus-side terminals").

Various mounting mechanisms have been proposed to mount the cartridge on the printing apparatus. One known mechanism uses an elastically deformable lever provided on either a cartridge or a cartridge mounting structure to mount the cartridge on the cartridge mounting structure.

SUMMARY

When the cartridge is not correctly mounted at a designed attachment position on the cartridge mounting structure, the cartridge-side terminals may be moved from the adequate connecting location for electrical connection with the apparatus-side terminals. In other words, there may be a positional misalignment of the cartridge-side terminals to the cartridge mounting structure in the attached state of the cartridge to the cartridge mounting structure.

Even when the cartridge-side terminals are electrically connected with the apparatus-side terminals, the electrical connection between the cartridge-side terminals and the apparatus-side terminals may become unstable. For example, application of an external force to the cartridge due to vibration or motion during the printing operation may shift the cartridge from the designed attachment position and cause a positional misalignment of the cartridge-side terminals to the cartridge mounting structure.

As described above, shifting the cartridge-side terminals from the adequate connecting location for electrical connection with the apparatus-side terminals may lead to a failure in electrical connection between the cartridge-side terminals and the apparatus-side terminals.

Any of these problems described above is not limited to the cartridge containing ink for printing but is commonly found in any of printing apparatuses and/or cartridges configured to supply or eject various other printing materials (for example, toner) as well as ink.

Consequently, by taking into account the above problems, there is a requirement to provide technology that ensures stable electrical connection between cartridge-side terminals and apparatus-side terminals.

In order to achieve at least part of the foregoing, the present invention provides various aspects and embodiments described below.

First Aspect:

A printing apparatus adapted to have a cartridge detachably mounted thereon, wherein three space axes orthogonal to one another are represented by an X-axis, a Y-axis and a Z-axis of the cartridge, the cartridge comprising:

a first face located on a −Z-axis direction side and a second face located on a +Z-axis direction side, as two surfaces opposed to each other in the Z-axis direction;

a third face located on a +X-axis direction side and a fourth face located on a −X-axis direction side, as two surfaces opposed to each other in the X-axis direction;

a fifth face located on a −Y-axis direction side and a sixth face located on a +Y-axis direction side, as two surfaces opposed to each other in the Y-axis direction;

a cartridge-side corner section arranged to connect the first face with the third face;

a printing material supply port placed on the first face and configured to supply printing material to the printing apparatus;

a first cartridge-side restriction portion placed on the third face;

a sloped surface arranged to form part of the cartridge-side corner section and inclined in a specific direction including the +X-axis direction component and the −Z-axis direction component; and a plurality of cartridge-side terminals located on the sloped surface, wherein the X axis, the Y axis and the Z axis with respect to the printing apparatus in an attached state of the cartridge to the printing apparatus respectively correspond to an X axis, a Y axis and a Z axis of the printing apparatus, the printing apparatus comprising:

a cartridge mounting structure configured to have: (i) an apparatus-side bottom wall member opposed to the first face of the cartridge in the attached state; (ii) a first apparatus-side side wall member opposed to the third face of the cartridge in the attached state; and (iii) a second apparatus-side side wall member opposed to the fourth face of the cartridge in the attached state;

a printing material supply tube structured to have a central axis parallel to the Z-axis, a base end provided on the apparatus-side bottom wall member and a peripheral end to be connected with the printing material supply port;

a plurality of apparatus-side terminals located in an apparatus-side corner section where the apparatus-side bottom wall member intersects the first apparatus-side side wall member, wherein in the attached state, the respective apparatus-side terminals are in contact with the respective cartridge-side terminals to apply a force to the cartridge in a specific direction including the +Z-axis direction component; and a lever placed on the first apparatus-side side wall member in a rotatable manner to be used for attachment and detachment of the cartridge to and from the printing apparatus, wherein the lever is structured to have: an operating member located at the +Z-axis direction end and configured to receive an external force applied by a user; and a first apparatus-side locking portion located at the −Z-axis direction end, wherein in the attached state, the first apparatus-side locking portion engages with the first cartridge-side restriction portion of the cartridge, so as to restrict motion of the cartridge in the +Z-axis direction, the lever additionally has an axis of rotation at a specific position between the operating member and the first apparatus-side locking portion, wherein in the attached state, the axis of rotation is located on the +Z-axis direction side and on the +X-axis direction side of a specified locking position where the first apparatus-side locking portion engages with the first cartridge-side restriction portion, and when an external force is applied to the operating member of the lever from the +X-axis direction to the −X-axis direction, the lever moves the first apparatus-side locking portion about the axis of rotation from the specified locking position toward the +X-axis direction and disengages the first apparatus-side locking portion from the first cartridge-side restriction portion, so as to eliminate the restriction of the motion of the cartridge.

In the printing apparatus according to the first aspect, in the attached state, the first cartridge-side restriction portion applies an external force to the lever to rotate the lever about the axis of rotation in a direction opposite to the unlocking or disengaging direction. This reduces the possibility that the first cartridge-side restriction portion is disengaged from the first apparatus-side locking portion and thereby ensures stable electrical connection between the cartridge-side terminals and the apparatus-side terminals.

Second Aspect:

The printing apparatus according to the first aspect, wherein the lever additionally has a second apparatus-side locking portion located at the −Z-axis direction end, wherein in the attached state, the second apparatus-side locking portion engages with a second abutting part of the first cartridge-side restriction portion, which is different from a first abutting part of the first cartridge-side restriction portion that is engaged with the first apparatus-side locking portion, so as to restrict motion of the cartridge in the +X-axis direction.

The printing apparatus according to the second aspect additionally has the second apparatus-side locking portion to restrict motion of the cartridge in the +X-axis direction in the attached state. This further reduces the possibility that the first cartridge-side restriction portion is disengaged from the first apparatus-side locking portion.

Third Aspect:

The printing apparatus according to either one of the first and second aspects, wherein the first apparatus-side locking portion has a cross section that is parallel to both the X axis and the Z axis and is formed in an arc shape about the axis of rotation.

In the printing apparatus according to the third aspect, the first apparatus-side locking portion has the cross section that is parallel to both the X axis and the Z axis and is formed in an arc shape about the axis of rotation. The arc shape enables the cartridge to be smoothly attached to and detached from the cartridge mounting structure.

Fourth Aspect:

The printing apparatus according to the third aspect, wherein the axis of rotation is located at a position near to the specified locking position with respect to the X-axis direction.

In the printing apparatus according to the fourth aspect, even when the locking position of the cartridge by the first apparatus-side locking portion is slightly shifted from the specified locking position, this arrangement effectively reduces the positional misalignment of the cartridge to the cartridge mounting structure in the Z-axis direction.

Fifth Aspect:

The printing apparatus according to any one of the first aspect to the fourth aspect, wherein the lever additionally has a guide member configured to guide the first cartridge-side restriction portion to the first apparatus-side locking portion while restricting motion of the cartridge both in the X-axis direction and in the Y-axis direction, when the cartridge is mounted on the cartridge mounting structure.

In the printing apparatus according to the fifth aspect, the guide member serves to restrict the motion of the cartridge in both the X-axis direction and the Y-axis direction. This facilitates the cartridge to be mounted at the adequate attachment position.

Sixth Aspect:

The printing apparatus according to the fifth aspect, wherein the guide member has a guide bottom wall formed along the Y-axis direction and a pair of guide walls vertically angled toward the −X-axis direction from the guide bottom wall and opposed to each other in the Y-axis direction, the guide bottom wall and the pair of guide walls are extended from a location of the operating member of the lever to a location of the first apparatus-side locking portion, and distance between the pair of guide walls is less than the Y-axis direction length of the cartridge in the attached state but is greater than the Y-axis direction length of the first cartridge-side restriction portion in the attached state.

In the printing apparatus according to the sixth aspect, insertion of the first cartridge-side restriction portion between the pair of guide walls further facilitates the cartridge to be mounted at the adequate designed attachment position.

Seventh Aspect:

The printing apparatus according to the sixth aspect, wherein one of the pair of guide walls is located at the −Y-axis direction end of the guide bottom wall, the other of the pair of guide walls is located at the +Y-axis direction end of the guide bottom wall, and the guide member is arranged to form a recess by the guide bottom wall and the pair of guide walls to receive the first cartridge-side restriction portion.

In the printing apparatus according to the seventh aspect, the guide bottom wall and the pair of guide walls readily define the recess serving as the guide member to receive the first cartridge-side restriction portion and guide the first cartridge-side restriction portion to the first apparatus-side locking portion.

Eighth Aspect:

The printing apparatus according to any one of the first aspect to the seventh aspect, wherein the operating member of the lever is structured to have: an operation surface arranged to receive an external force applied to the operating member to eliminate the restriction of the motion of the cartridge by the first apparatus-side locking portion; and an operating-member opposed surface arranged to be in contact with a projection located on the +Z-axis direction side of the first cartridge-side restriction portion located on the third face of the cartridge, wherein the operating-member opposed surface comes into contact with the projection to apply a force in a specific direction including the +Z-axis direction component to the cartridge and thereby eliminate the restriction of the motion of the cartridge.

In the printing apparatus according to the eighth aspect, the operating member is used to disengage the first cartridge-side restriction portion from the first apparatus-side locking portion. The cartridge is then detached from the cartridge mounting structure by applying an external force to the projection via the operating member. In other words, a series of operations for applying an external force to the operating member of the lever from the +X-axis direction to the −X-axis direction release the engagement and enable the cartridge to be detached from the cartridge mounting structure.

Ninth Aspect:

The printing apparatus according to the eighth aspect, wherein the operating-member opposed surface is inclined in a specific direction including the −X-axis direction component and the +Z-axis direction component in the attached state.

In the printing apparatus according to the ninth aspect, the inclination of the operating-member opposed surface enables the operating member to readily apply an external force in the +Z-axis direction to the projection.

Tenth Aspect:

The printing apparatus according to any one of the first aspect to the ninth aspect, further comprising:

an elastic member that is elastically deformable, wherein the elastic member is configured to apply an external force including the −X-axis direction component to a specific part of the lever located on the −Z-axis direction side of the axis of rotation at least during a mounting operation of mounting the cartridge on the cartridge mounting structure.

The printing apparatus according to the tenth aspect enables the first apparatus-side locking portion to be smoothly moved to the specified locking position.

Eleventh Aspect:

The printing apparatus according to the tenth aspect, wherein the elastic member is arranged to apply the external force to the specific part of the lever located on the −Z-axis direction side of the axis of rotation in the attached state.

The printing apparatus according to the eleventh aspect advantageously reduces the possibility that the first cartridge-side restriction portion is disengaged from the first apparatus-side locking portion in the attached state. The structure of this aspect also ensures vigorous motion of the first cartridge-side restriction portion to the specified locking position, thus enabling the user to sufficiently feel a click that informs the user of the engagement.

Twelfth Aspect:

The printing apparatus according to the tenth aspect, wherein the elastic member is arranged to apply no external force to the lever in the attached state.

In the printing apparatus according to the twelfth aspect, the lever does not receive any external force from the elastic member in the attached state. This advantageously reduces the possibility of plastic deformation of the lever by the external force. This accordingly reduces the possibility that the specified locking position is shifted and thereby ensures more stable electrical connection between the cartridge-side terminals and the apparatus-side terminals.

Thirteenth Aspect:

The printing apparatus according to any one of the first aspect to the twelfth aspect, wherein the lever has center of gravity at a location where the first apparatus-side locking portion is moved to the specified locking position by dead weight of the lever.

The printing apparatus according to the thirteenth aspect does not require any additional mechanism (for example, elastic member) to move the first apparatus-side locking portion to the specified locking position, thus reducing the manufacturing cost.

Fourteenth Aspect:

The printing apparatus according to any one of the first aspect to the thirteenth aspect, wherein the lever additionally has a pair of shaft bodies to form the axis of rotation, and one of the pair of shaft bodies is provided as a projection protruded from an outer surface on the +Y-axis direction side and the other of the pair of shaft bodies is provided as a projection protruded from an outer surface on the −Y-axis direction side.

The printing apparatus according to the fourteenth aspect has the pair of shaft bodies to readily form the axis of rotation.

Fifteenth Aspect:

The printing apparatus according to the fourteenth aspect, wherein each of the pair of shaft bodies is structured to have: a first curved surface arranged to form a first arc about the axis of rotation on a cross section parallel to both the X axis and the Z axis; and a second curved surface arranged to form a second arc about the axis of rotation on the cross section parallel to both the X axis and the Z axis, wherein the second arc has a greater radius than radius of the first arc, and the first curved surface is located on the −X-axis direction side of the second curved surface.

In the printing apparatus according to the fifteenth aspect, the smaller radius of the first curved surface locates the axis of rotation at a specific position nearer to the part of the cartridge chamber where the cartridge is placed. The greater radius of the second curved surface, on the other hand, reduces the decrease in strength of the shaft bodies.

Sixteenth Aspect:

The printing apparatus according to any one of the first aspect to the fifteenth aspect, further comprising:

a second apparatus-side restriction portion located on the second apparatus-side side wall member, wherein the second apparatus-side restriction portion engages with a second cartridge-side restriction portion located on the fourth face of the cartridge, so as to restrict motion of the cartridge in the +Z-axis direction.

In the printing apparatus according to the sixteenth aspect, the second cartridge-side restriction portion is additionally provided on the second apparatus-side side wall member to restrict motion of the cartridge in the +Z-axis direction. This structure restricts motion of the cartridge in the +Z-axis direction from both sides of the X-axis direction. This more effectively prevents positional misalignment of the respective cartridge-side terminals to the cartridge mounting structure and thereby ensures more stable electrical connection between the cartridge-side terminals and the apparatus-side terminals.

Seventeenth Aspect:

The printing apparatus according to the sixteenth aspect, wherein the second apparatus-side restriction portion is provided as a recess or a through hole to receive the second cartridge-side restriction portion as a projection formed on the fourth face of the cartridge.

The printing apparatus according to the seventeenth aspect facilitates formation of the second apparatus-side restriction portion.

Eighteenth Aspect:

The printing apparatus according to any one of the first aspect to the seventeenth aspect, further comprising:

a third apparatus-side restriction portion formed on the apparatus-side bottom wall member at a location nearer to the first apparatus-side side wall member than the printing material supply tube, wherein the third apparatus-side restriction portion is provided as a projection, wherein in the attached state, the projection is located between a pair of projection members protruded from in the +X-axis direction from a stepped surface, which is formed to connect the sloped surface with the first face of the cartridge, to restrict motion of the cartridge in the Y-axis direction.

In the printing apparatus according to the eighteenth aspect, the third cartridge-side restriction portion is provided at the location nearer to the first apparatus-side side wall member than the printing material supply tube to restrict motion of the cartridge in the Y-axis direction. The third cartridge-side restriction portion more effectively prevents positional misalignment of the respective cartridge-side terminals to the cartridge mounting structure. In some cases, the cartridge in the attached state may be rotated about the printing material supply tube provided in the cartridge mounting structure by an external force. In other words, the third face-side of the cartridge may move in the Y-axis direction relative to the cartridge mounting structure. The structure of providing the third cartridge-side restriction portion at the location nearer to the first apparatus-side side wall member than the printing material supply tube more effectively prevents positional misalignment of the circuit board to the cartridge mounting structure, compared with the structure of providing the third cartridge-side restriction portion on the first face-side of the cartridge.

Nineteenth Aspect:

A printing material supply system, comprising:

the printing apparatus according to any one of the first aspect to the eighteenth aspect; and a cartridge, the cartridge comprising:

a first face located on a −Z-axis direction side and a second face located on a +Z-axis direction side, as two surfaces opposed to each other in the Z-axis direction;

a third face located on a +X-axis direction side and a fourth face located on a −X-axis direction side, as two surfaces opposed to each other in the X-axis direction;

a fifth face located on a −Y-axis direction side and a sixth face located on a +Y-axis direction side, as two surfaces opposed to each other in the Y-axis direction;

a cartridge-side corner section arranged to connect the first face with the third face;

a printing material supply port placed on the first face and configured to supply printing material to the printing apparatus;

a first cartridge-side restriction portion placed on the third face;

a sloped surface arranged to form part of the cartridge-side corner section and inclined in a specific direction including the +X-axis direction component and the −Z-axis direction component; and a plurality of cartridge-side terminals located on the sloped surface.

In the printing supply system according to the nineteenth aspect, in the attached state, the first cartridge-side restriction portion applies an external force to the lever to rotate the lever about the axis of rotation in a direction opposite to the unlocking or disengaging direction. This reduces the possibility that the first cartridge-side restriction portion is disengaged from the first apparatus-side locking portion and thereby ensures stable electrical connection between the cartridge-side terminals and the apparatus-side terminals.

The present invention is not limited to the cartridge or the printing material supply system described above but may be implemented by diversity of other aspects, for example, a liquid cartridge, a liquid container, a printing material container, a cartridge adapter, a circuit board, a printing apparatus, a liquid ejection apparatus, and a liquid supply system including a liquid ejection apparatus and a liquid cartridge. The invention is not limited to the above aspects, but a multiplicity of variations and modifications may be made to these aspects without departing from the scope of the invention.

DESCRIPTION OF EMBODIMENTS

In order to further clarify the configurations and the operations of the invention, some embodiments of the invention are described below with reference to the accompanied drawings.

A. First Embodiment

A-1. General Configuration of Printing Material Supply System

Figure 1:
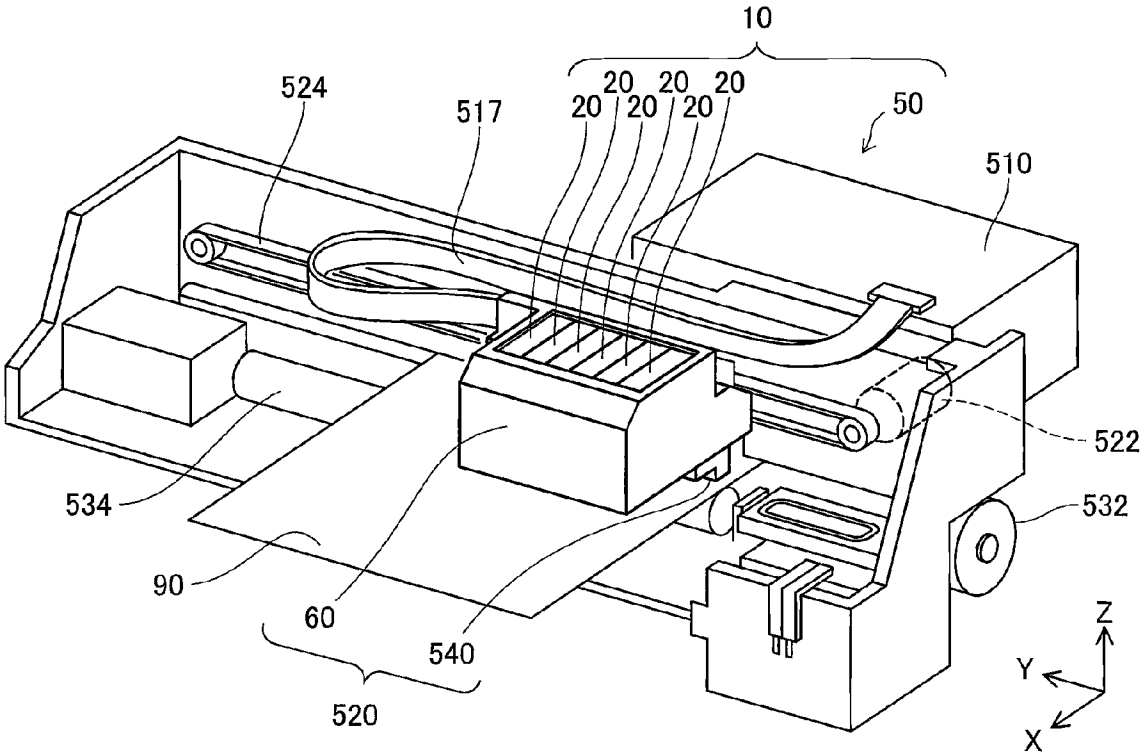
FIG. 1 is a perspective view illustrating the configuration of a printing material supply system.

FIG. 1 is a perspective view illustrating the configuration of a printing material supply system 10. XYZ axes orthogonal to one another are shown in FIG. 1. The XYZ axes in FIG. 1 correspond to the XYZ axes in the other drawings. In the subsequent drawings, the XYZ axes are shown when needed basis. The printing material supply system 10 includes cartridges 20 and a printer 50 serving as a printing device. In the printing material supply system 10, the cartridges 20 are removably attached to a holder 60 of the printer 50 by the user.

Each of the cartridges 20 in the printing material supply system 10 contains ink as a printing material. The ink as the printing material contained in the cartridge 20 is supplied through a printing material supply port and a printing material supply tube (described later) to a head 540. According to this embodiment, a plurality of the cartridges 20 are removably attached to the holder 60 of the printer 50. More specifically, six cartridges 20 respectively containing six different color inks (i.e., black, yellow, magenta, light magenta, cyan and light cyan) are attached to the holder 60.

According to other embodiments, the number of cartridges attached to the holder 60 is not limited to six but may be greater than six or less than six. According to other embodiments, the number of different color inks is not limited to six colors but may be greater than six colors or less than six colors. According to other embodiments, two or more cartridges 20 attached to the holder 60 may contain one identical color ink. The detailed structures of the cartridge 20 and the holder 60 will be described later.

The printer 50 of the printing material supply system 10 is a compact inkjet printer for personal use. The printer 50 has a controller 510 and a carriage 520 including the holder 60, in addition to the holder 60. The cartridge 520 also includes the head 540. The printer 50 supplies ink from the cartridge 20 attached to the holder 60 through the printing material supply tube (described later) to the head 540 and ejects ink from the head 540 onto a printing medium 90, such as printing sheet or label, so as to print various data, such as character strings, figures and images, on the printing medium 90.

The controller 510 of the printer 50 serves to control the operations of the respective parts of the printer 50. The carriage 520 of the printer 50 is configured to move the head 540 relative to the printing medium 90. The head 540 of the printer 50 has an ink ejection mechanism configured to eject ink from the cartridge 20 attached to the holder 60 onto the printing medium 90. The controller 510 and the carriage 520 are electrically connected via a flexible cable 317. The ink ejection mechanism of the head 540 is operated by control signals from the controller 510.

According to this embodiment, the carriage 520 has the head 540 and the holder 60. This type of the printer 50 having the cartridges 20 attached to the holder 60 on the carriage 520 serving to move the head 540 is called "on-carriage type" printer. According to another embodiment, a stationary holder 60 may be provided at a different position from the carriage 520, and ink may be supplied from each of the cartridges 20 attached to the stationary holder 60 to the head 540 of the carriage 520 through a flexible tube. This type of the printer is called "off-carriage type" printer.

According to this embodiment, the printer 50 has a main scan feed mechanism and a sub-scan feed mechanism to move the carriage 520 and the printing medium 90 relative to each other and implement printing on the printing medium 90. The main scan feed mechanism of the printer 50 includes a carriage motor 522 and a drive belt 524 and serves to transfer the power of the carriage motor 520 to the carriage 520 by means of the drive belt 520, so as to move back and forth the carriage 520 in a main scanning direction. The sub-scan feed mechanism of the printer 50 includes a feed motor 532 and a platen 534 and serves to transfer the power of the feed motor 532 to the platen 534, so as to feed the printing medium 90 in a sub-scanning direction orthogonal to the main scanning direction. The carriage motor 522 of the main scan feed mechanism and the feed motor 532 of the sub-scan feed mechanism are operated by control signals from the controller 510.

According to this embodiment, in the use state or use attitude of the printing material supply system 10, the X axis represents the axis along the sub-scanning direction (front-rear direction), in which the printing medium 90 is fed. The Y axis represents the axis along the main scanning direction (left-right direction), in which the carriage 520 is moved back and forth. The Z axis represents the axis along the direction of gravity (vertical direction). The use state of the printing material supply system 10 means the state of the printing material supply system 10 placed on a horizontal plane. In this embodiment, the horizontal plane is a plane parallel to the X axis and the Y axis, i.e., XY plane.

According to this embodiment, the +X-axis direction represents the sub-scanning direction (forward direction), the −X-axis direction represents its reverse direction (backward direction). the +Z-axis direction represents the direction going from the bottom to the top of the printing material supply system 10 along the direction of gravity (upward direction), and the −Z-axis direction represents its reverse direction (downward direction). In this embodiment, the +X-axis direction side (front side) is the front face of the printing material supply system 10. According to this embodiment, the +Y-axis direction represents the direction going from the right side face to the left side face of the printing material supply system 10 (leftward direction), and the −Y-axis direction represents its reverse direction (rightward direction). In this embodiment, the plurality of cartridges 20 attached to the holder 60 are arrayed in the direction along the Y axis (left-right direction) called the "Y-axis direction". Similarly the direction along the X axis (front-rear direction) and the direction along the Z axis (vertical direction) are called the "X-axis direction" and the "Z-axis direction".

A-2. Structure for Attachment of Cartridge 20 to Holder 60

Figure 2:
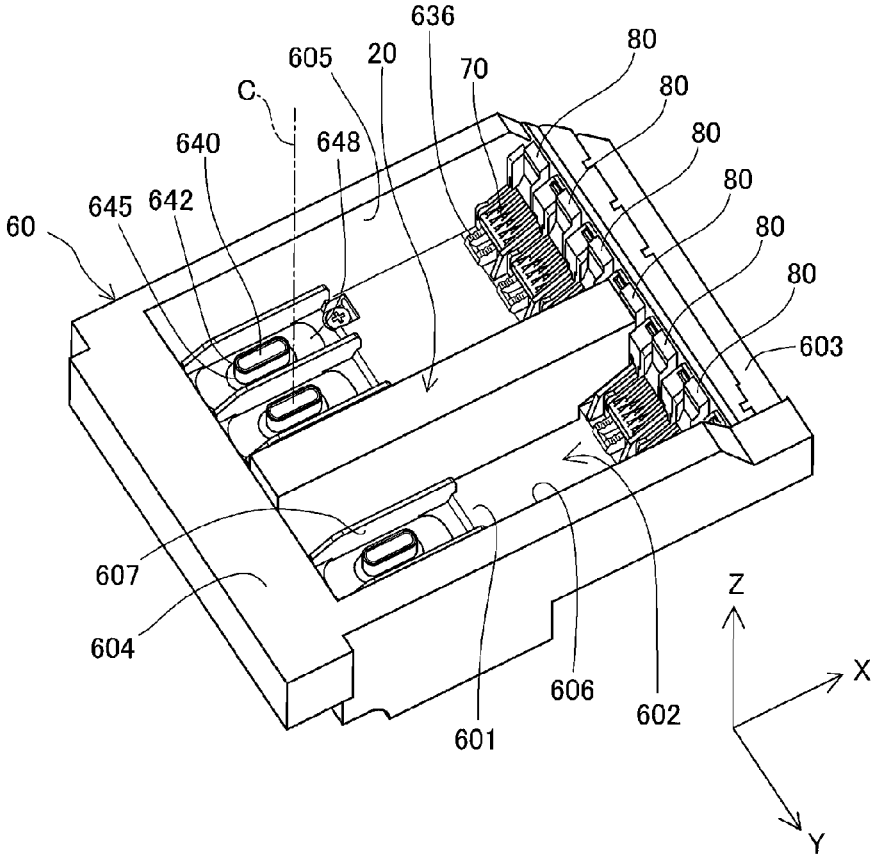
FIG. 2 is a perspective view illustrating a holder with a cartridge attached thereto.
Figure 3:
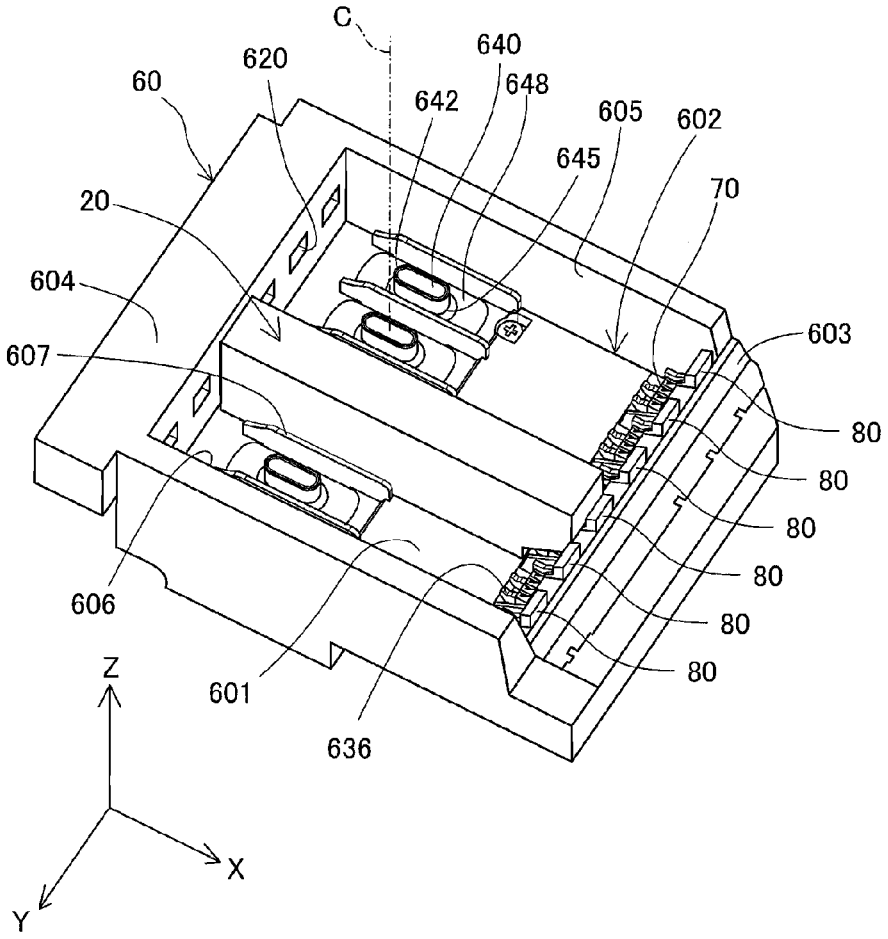
FIG. 3 is a perspective view illustrating a holder with a cartridge attached thereto.
Figure 4:
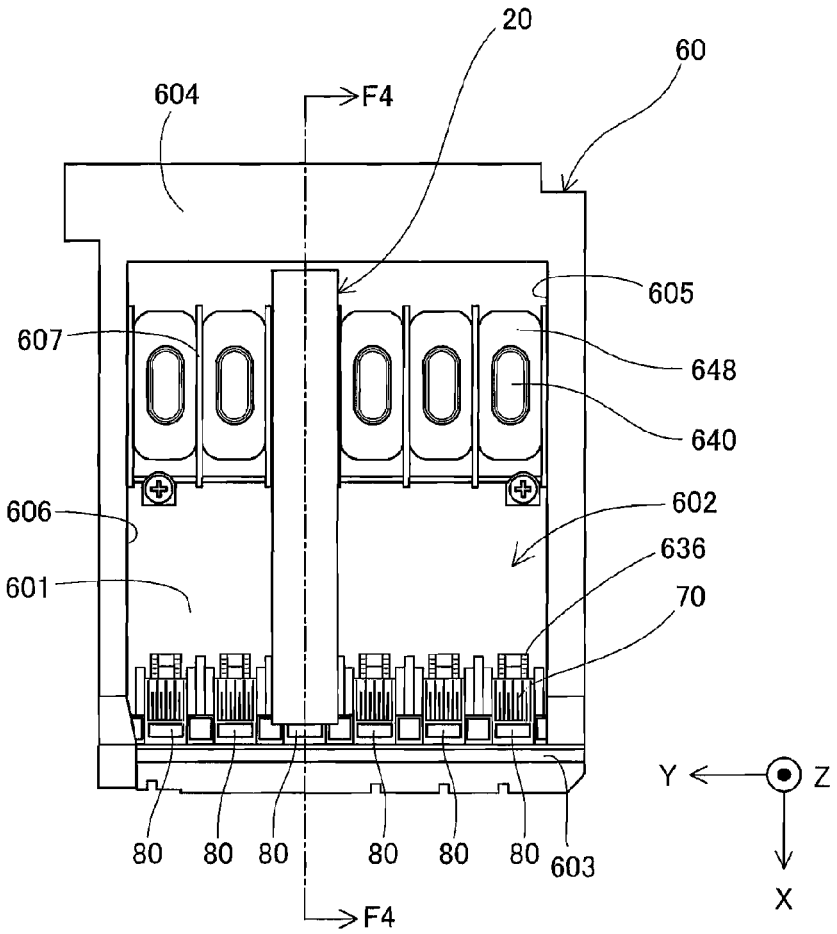
FIG. 4 is a top view illustrating a holder with a cartridge attached thereto.

FIGS. 2 and 3 are perspective views illustrating the holder 60 with the cartridge 20 attached thereto. FIG. 4 is a top view illustrating the holder 60 holder 60 with the cartridge 20 attached thereto. In the state illustrated in FIGS. 2 to 4, one cartridge 20 is properly attached at a designed attachment position of the holder 60. The state of "properly attached at a designed attachment position" means that the cartridge 20 is attached, such that cartridge-side terminals are located at positions respectively in contact with corresponding apparatus-side terminals included in a contact mechanism of the printer 50 (described later).

As shown in FIGS. 2 and 3, the holder 60 of the printer 50 has five wall members 601, 603, 604, 605 and 606. A recess formed by these five wall members serves as a cartridge chamber or cartridge mounting structure 602. The cartridge chamber 602 is parted by partition walls 607 into a plurality of slots (mounting spaces) to receive the respective cartridges 20. The partition walls 607 serve as guides to insert the cartridges 20 into the respective slots, but may be omitted as appropriate. Each slot has a printing material supply tube 640, a contact mechanism 70, a lever 80, a second apparatus-side restriction portion 620 and a projection 636 serving as a third apparatus-side restriction portion. One side face (+Z-axis direction side face, top face) of each slot is open, and the cartridge 20 is attached to and detached from the holder 60 via this open side face (open top face).

The cartridge 20 is attached to the holder 60 in such a state that the cartridge 20 is locked by the lever 80 and the second apparatus-side restriction portion 620 and that the printing material supply port (described later) is connected with the printing material supply tube 640. This state is called "attached state of the cartridge 20 to the holder 60" or simply "attached state". Connecting the printing material supply tube 640 with the printing material supply port of the cartridge 20 enables ink as the printing material contained in the cartridge 20 to be supplied to the head 540 (FIG. 1). The printing material supply tube 640 has a peripheral end 642 (also called "connection end") located on the +Z-axis direction side and a base end 645 located on the −Z-axis direction side. The base end 645 is provided on the bottom wall member 601, and the peripheral end 642 is connected with the printing material supply port of the cartridge 20. The printing material supply tube 640 has a central axis C parallel to the Z axis. The direction going from the base end 645 to the peripheral end 642 along the central axis C is the +Z-axis direction.

As shown in FIG. 2, an elastic member 648 is provided around the printing material supply tube 640 to seal the periphery of the printing material supply port of the cartridge 20 in the attached state, so as to prevent leakage of ink from the printing material supply port to the periphery. In the attached state, the elastic member 648 applies a pressing force including a +Z-axis direction component to the cartridge 20.

In the attached state, electrical connection between the terminals provided on a circuit board (described later) of the cartridge 20 and those of the contact mechanism 70 in each slot of the holder 60 allows transmission of various information between the cartridge 20 and the printer 50.

Figure 5:
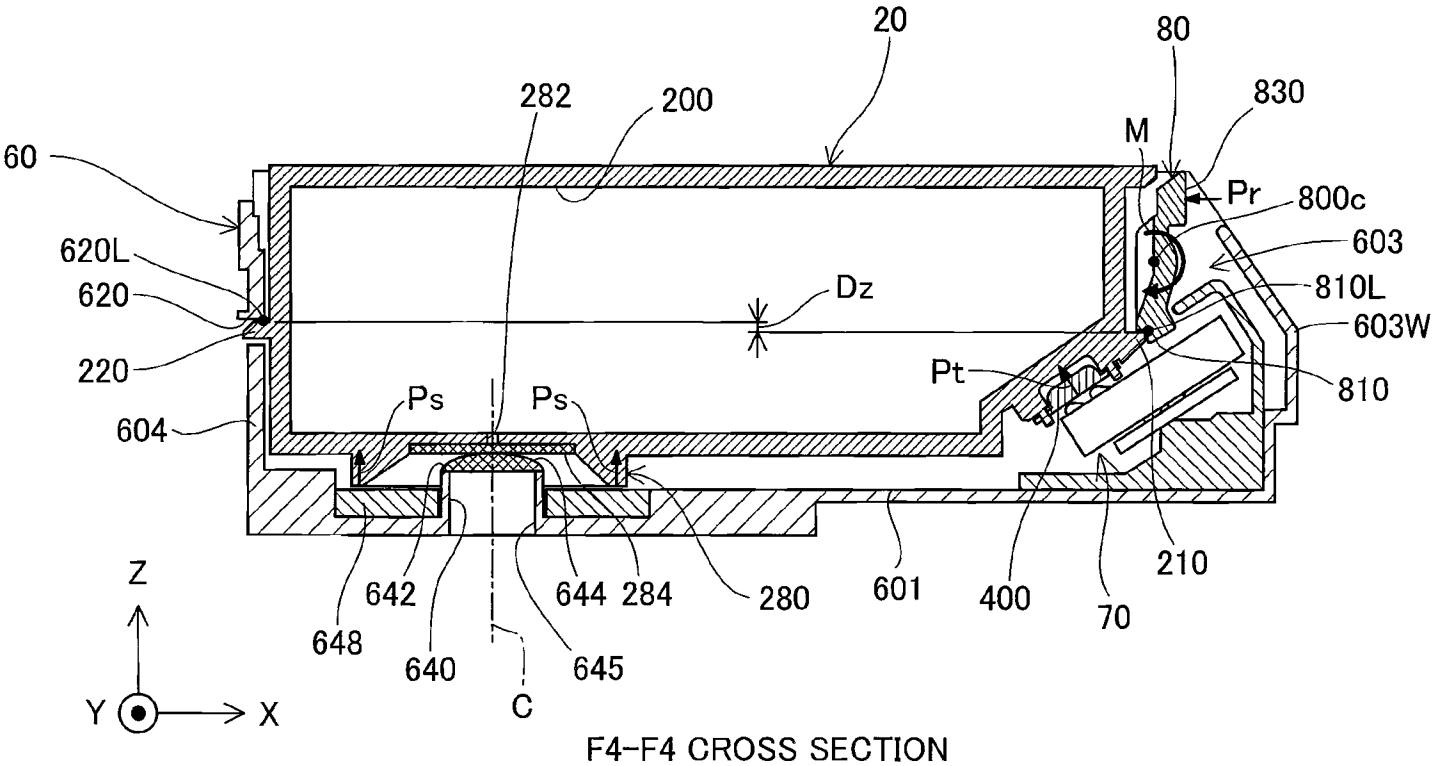
FIG. 5 is a sectional view taken on line F4-F4 in FIG. 4.

FIG. 5 is a sectional view, taken on F4-F4 line in FIG. 4. The projection 636 is omitted from the illustration. The printing material supply tube 640 of the printer 50 is connected with a printing material supply port 280 of the cartridge 20, so that ink is supplied from the cartridge 20 to the head 540 (FIG. 1) via a printing material flow path 282.

According to this embodiment, a porous filter 644 serving to filter the ink supplied from the cartridge 20 is provided at the peripheral end 642 of the printing material supply tube 640. The porous filter 644 may be made of, for example, stainless steel mesh or stainless steel woven fabric. According to another embodiment, the porous filter may not be located at the peripheral end 642 of the printing material supply tube 640.

The contact mechanism 70 of the printer 50 is located on the +X-axis direction side of the printing material supply tube 640 and is configured to be electrically connectable with the terminals provided on a circuit board 40 of the cartridge 20. In the attached state of the cartridge 20, a pressing force Pt including a +Z-axis direction component is applied from the terminals of the contact mechanism 70 to the circuit board 40. In the attached state of the cartridge 20, a pressing force Ps in the +Z-axis direction is applied from the elastic member 648 to the printing material supply port 280.

The lever 80 used for attachment and detachment of the cartridge 20 has an operating member 830 at a +Z-axis direction end and a first apparatus-side restriction portion 810 at a −Z-axis direction end. The first apparatus-side restriction portion 810 (more specifically its first apparatus-side locking face described later) is configured to engage with a first cartridge-side restriction portion 210 at a preset locking position or first locking position 810L in the attached state. The first locking position 810L is located on the +Z-axis direction side and on the +X-axis direction side of the contact between the terminals provided on the circuit board 40 and the contact mechanism 70. The first apparatus-side restriction portion 810 engages with the first cartridge-side restriction portion 210 to restrict the motion of the cartridge 20 in the +Z-axis direction.

The lever 80 turns around an axis 800*c* at the position between the operating member 830 and the first apparatus-side restriction portion 810. The axis of rotation 800*c* of the lever 80 is located on the +Z-axis direction side and on the +X-axis direction side of the first locking position 810L.

The user uses the operating member 830 of the lever 80 to remove the cartridge 20 from the holder 60. For removal of the cartridge 20, the user presses the operating member 830 in the −X-axis direction. This pressing applies a force Pr (called "operating force Pr") from the +X-axis direction side toward the −X-axis direction side, to the operating member 830. This operating force Pr turns the lever 80 around the axis 800*c* and moves the first apparatus-side restriction portion 810 in the +X-axis direction from the first locking position 810L. This releases the engagement of the first cartridge-side restriction portion 210 with the first apparatus-side restriction portion 810 and enables the cartridge 20 to be removed from the holder 60.

The second apparatus-side restriction portion 620 is provided on the side wall member 604 and is configured to engage with a second cartridge-side restriction portion 220 at a second locking position 620L. According to this embodiment, the second apparatus-side restriction portion 620 is a through hole formed in the side wall member 604 of the holder 60. The second locking position 620L is located on the +Z-axis direction side and on the −X-axis direction side of the printing material supply tube 640. The second apparatus-side restriction portion 620 engages with the second cartridge-side restriction portion 220 to restrict the motion of the cartridge 20 in the +Z-axis direction. As described above, the motion of the cartridge 20 in the +Z-axis direction is restricted by both its +X-axis direction end and its −X-axis direction end in the attached state.

The second locking position 620L, at which the second cartridge-side restriction portion 220 is in contact with the second apparatus-side restriction portion 620, serves as a pivot point, around which the cartridge 20 is turned to be attached to and detached from the holder 60. In other words, the cartridge 20 is turned around the second locking position 620L along a plane parallel to the Z axis and the X axis for attachment or detachment. The second cartridge side restriction portion 220 and the second apparatus-side restriction portion 620 accordingly serve as the pivot point of rotation of the cartridge 20 for attachment or detachment of the cartridge 20. The attachment and detachment of the cartridge 20 to and from the holder 60 will be described in detail later.

As shown in FIG. 5, in the attached state, the first locking position 810L is located on the −Z-axis direction side by a distance Dz from the second locking position 620L. This reduces the possibility that the first cartridge-side restriction portion 210 is disengaged from the first apparatus-side restriction portion 810 by the pressing forces Ps and Pt applied from the holder 60 to the cartridge 20. The cartridges 20 can thus be stably held at the designed attachment position.

Figure 6A:
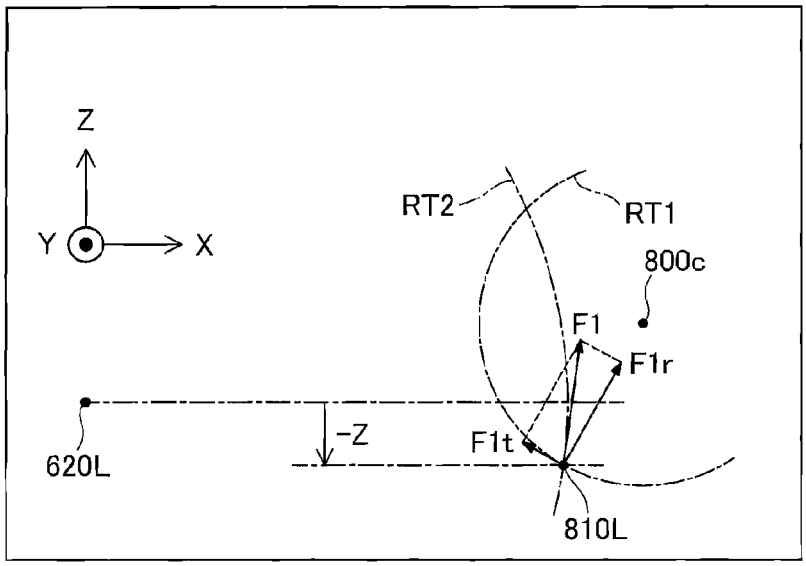
FIGS. 6A and 6B show how the force is applied from the cartridge to a lever.
Figure 6B:
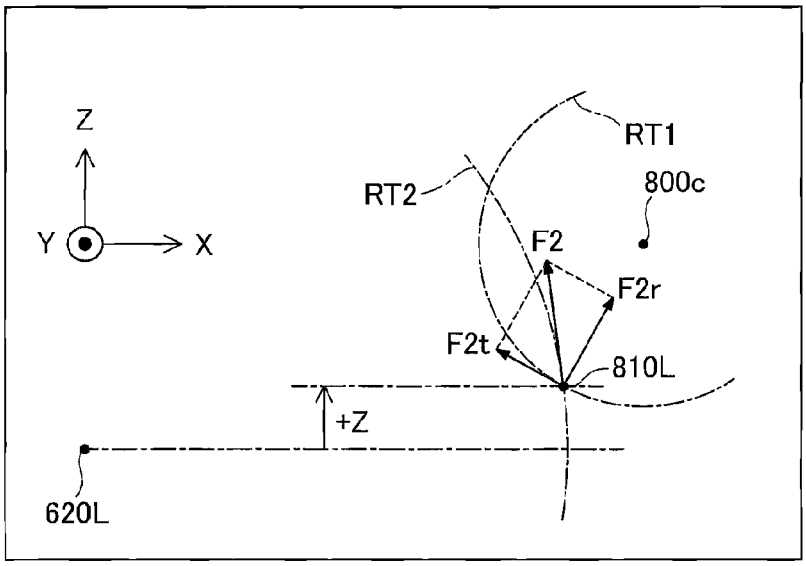

FIGS. 6A and 6B show how the force is applied from the cartridge 20 to the lever 80 at the first locking position 810L. In the state of FIG. 6A where the first locking position 810L is located on the −Z-axis direction side of the second locking position 620L, a force F1 is applied from the cartridge 20 to the lever 80 at the first locking position 810L. In the state of FIG. 6B where the first locking position 810L is located on the +Z-axis direction side of the second locking position 620L, a force F2 is applied from the cartridge 20 to the lever 80 at the first locking position 810L. The force F1 shown in FIG. 6A has the same magnitude as that of the force F2 shown in FIG. 6B.

FIGS. 6A and 6B schematically show the positional relationships of the first locking position 810L, the second locking position 620L and the axis of rotation 800*c* (also called "pivot center 800*c*") to one another on the X axis and on the Z axis. The difference between the two positional relationships shown in FIGS. 6A and 6B is the difference of the second locking position 620L on the Z axis. An arc RT1 shown in FIGS. 6A and 6B shows the rotation locus of the first locking position 810L around the axis of rotation 800*c*. An arc RT2 shown in FIGS. 6A and 6B shows the rotation locus of the first locking position 810L around the second locking position 620L.

In the state of FIG. 6A where the first locking position 810L is located on the −Z-axis direction side of the second locking position 620L, the force F1 applied in the tangential direction of the arc RT2 at the first locking position 810L has a +X-axis direction component and a +Z-axis direction component. The force F1 is accordingly resolved into a component F1*t* in the tangential direction of the arc RT1 and a component F1*r* in the radial direction of the arc RT1.

In the state of FIG. 6B where the first locking position 810L is located on the +Z-axis direction side of the second locking position 620L, the force F2 applied in the tangential direction of the arc RT2 at the first locking position 810L has a −X-axis direction component and a +Z-axis direction component. The force F2 is accordingly resolved into a component F2*t* in the tangential direction of the arc RT1 and a component F2*r* in the radial direction of the arc RT1.

As clearly understood from the comparison between FIGS. 6A and 6B, when the magnitude of force F1 is equal to the magnitude of force F2 (F1=F2), the positional relationships of the first locking position 810L, the second locking position 620L and the axis of rotation 800*c* to one another cause the relation "F1*t*<F2*t*" of the force components in the tangential direction of the arc RT1 and the relation "F1*r*>F2*r*" of the force components in the radial direction of the arc RT1. The state of FIG. 6A has the larger force component from the cartridge 20 toward the axis of rotation 800*c* of the lever 80 and the smaller force component to turn the lever 80 clockwise, viewed from the +Y-axis direction, around the axis of rotation 800*c* than the state of FIG. 6B. In other words, locating the first locking direction 810L on the −Z-axis direction side of the second locking position 620L more effectively reduces the possibility that the first cartridge-side restriction portion 210 is disengaged from the first apparatus-side restriction portion 810, compared with locating the first locking direction 810L on the +Z-axis direction side of the second locking position 620L. In either state, no force acts in the +X-axis direction to release the engagement at the first locking position 810L, so that there is little possibility that the first cartridge-side restriction portion 210 is disengaged from the first apparatus-side restriction portion 810.

A-3. Detailed Structure of Cartridge

Figure 7:
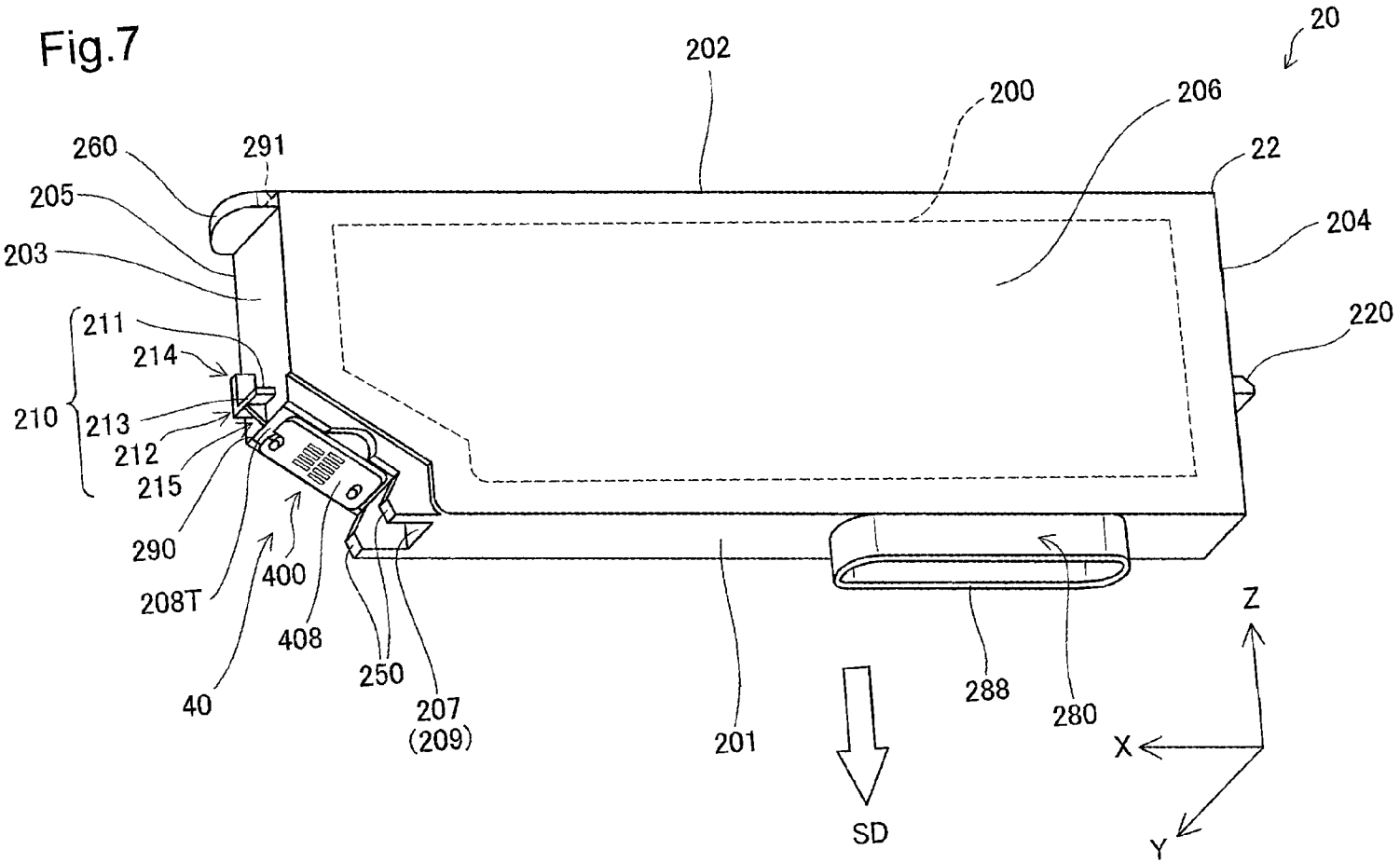
FIG. 7 is a perspective view illustrating the structure of the cartridge.
Figure 8:
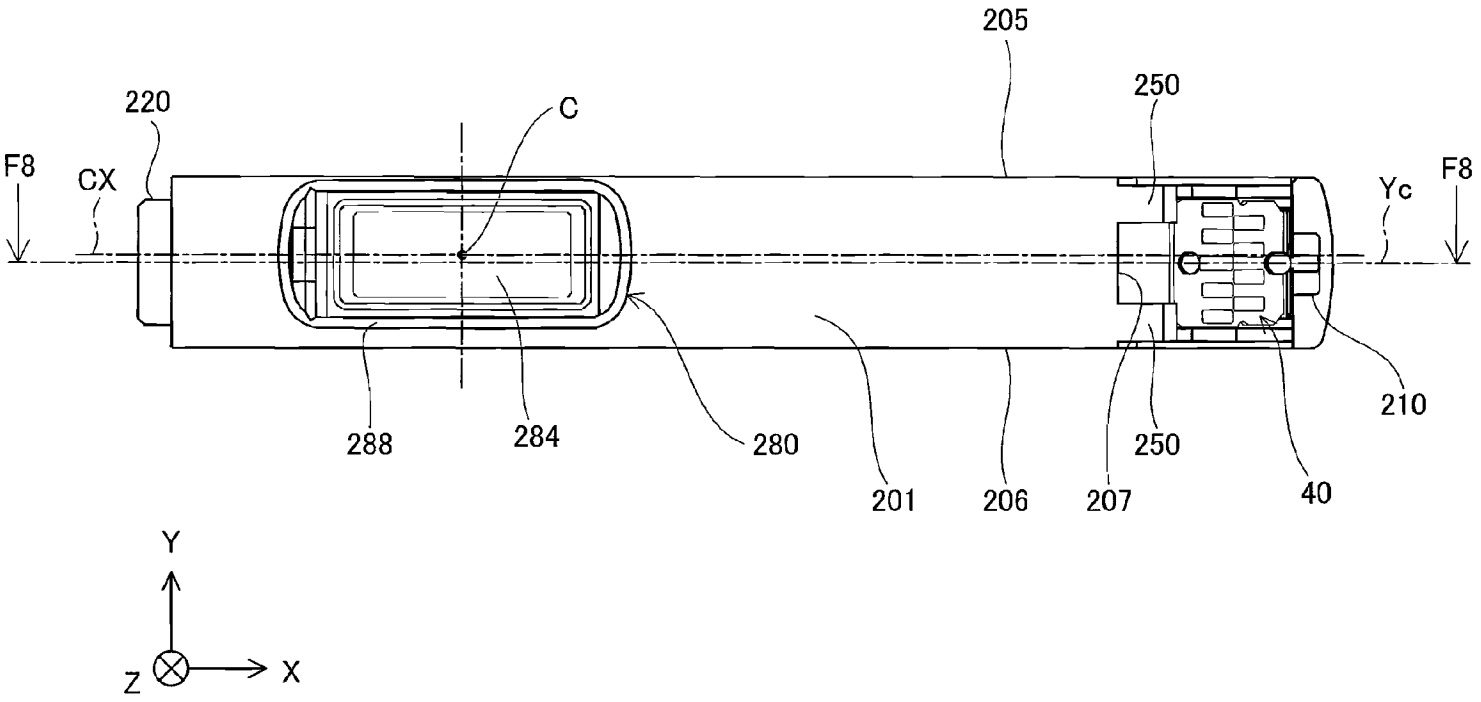
FIG. 8 is a bottom view of the cartridge.
Figure 9:
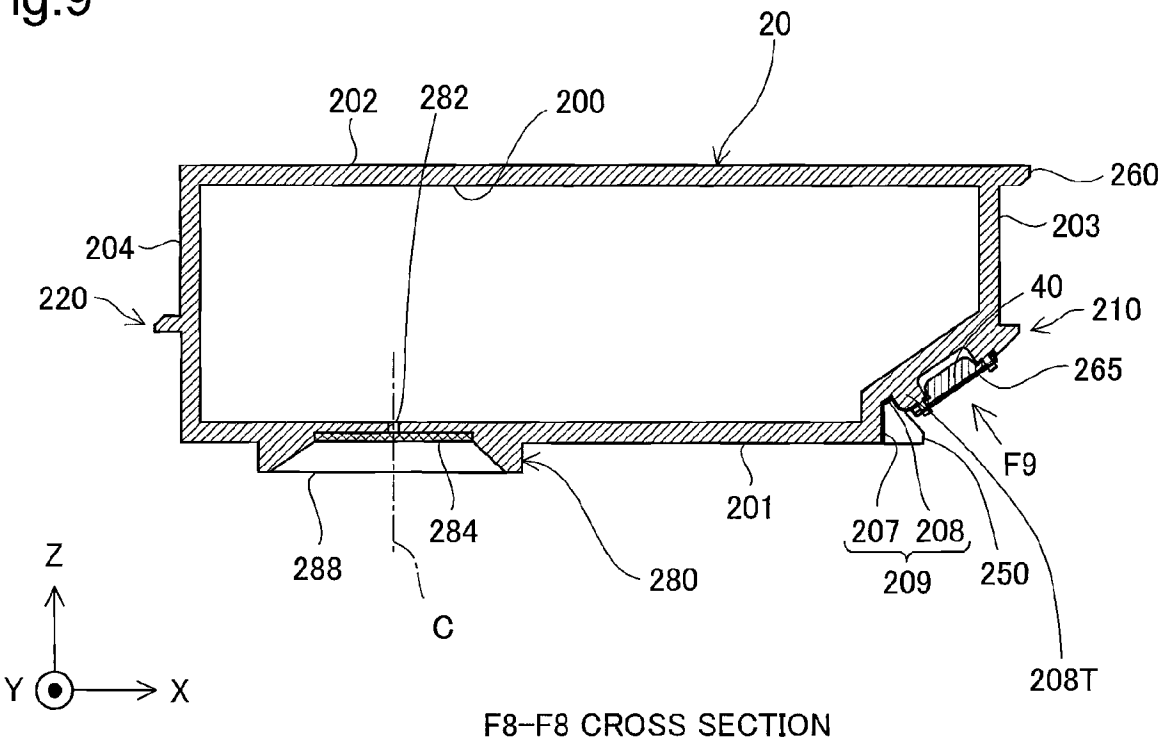
FIG. 9 is a sectional view, taken on line F8-F8 in FIG. 8.
Figure 10A:
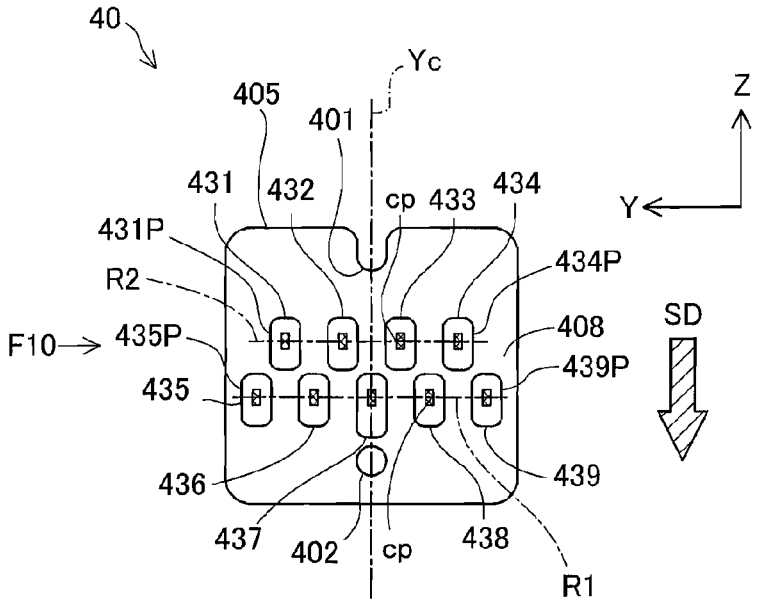
FIGS. 10A and 10B illustrate the detailed structure of a circuit board.
Figure 10B:
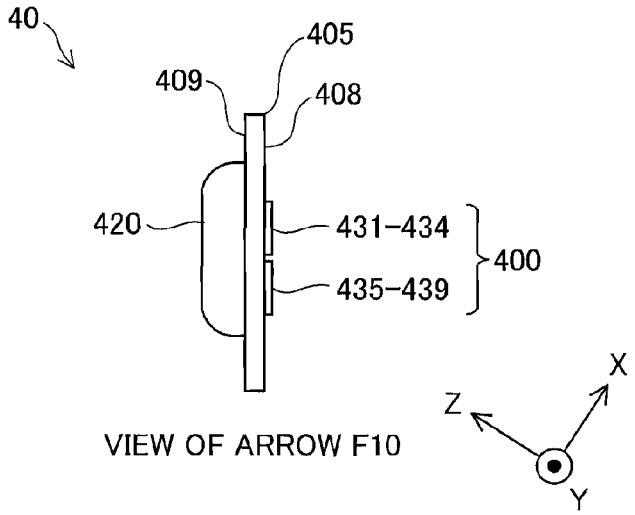

FIG. 7 is a perspective view illustrating the structure of the cartridge 20. FIG. 8 is a bottom view of the cartridge 20. FIG. 9 is a sectional view, taken on line F8-F8 in FIG. 8. FIGS. 10A and 10B illustrate the detailed structure of the circuit board 40. FIG. 10A is a view of the circuit board 40 seen from arrow F9 in FIG. 9, and FIG. 10B is a view of the circuit board 40 seen from arrow F10 in FIG. 10A. According to this embodiment, the X axis, the Y axis and the Z axis represent the axes on the cartridge 20 in the attached state. The +X-axis direction side in the attached state is the front face of the cartridge 20. A plane Yc shown in FIG. 8 is a plane that passes through the center of the width or the Y-axis direction length of the cartridge 20 and is parallel to the Z axis and the X axis (i.e., ZX plane). A plane CX shown in FIG. 8 is a plane that passes through the central axis C and is parallel to the Z axis and the X axis (i.e., ZX plane).

As shown in FIG. 7, the cartridge 20 includes a printing material chamber 200 containing ink, a housing 22, the printing material supply port 280, the circuit board 40 and the first cartridge-side restriction portion 210. The cartridge 20 is attached to the holder 60 in an attachment direction SD, which is the −Z-axis direction (vertically downward direction in the embodiment). The attitude of the cartridge 20 is generally not constant during actual insertion of the cartridge 20 to the holder 60. In the course of attachment of the cartridge 20 to the holder 60, the cartridge 20 may be inclined to the Z axis. In the state immediately before the attachment and in the attached state, however, the printing material supply port 280 receives the printing material supply tube 640 having the central axis C parallel to the Z axis, so that the attitude of the cartridge 20 is restricted by the printing material supply tube 640. This causes the cartridge 20 to be attached in the −Z-axis direction to the holder 60.

The housing 22 (also called "cartridge body 22") defines an inner space including the printing material chamber 200 of the cartridge 20. The housing 22 also forms at least part of the outer wall surfaces of the cartridge 20 and may be made of a synthetic resin, such as polypropylene (PP). The cartridge 20 is in a rectangular prism shape having congruent side faces or in an approximate rectangular parallelepiped shape. Part of the housing 22 may be made of a resin film.

The cartridge 20 has the length (X-axis direction length), the width (Y-axis direction length) and the height (Z-axis direction length), wherein the length, the height and the width descend in this order. The magnitude relation of the length, the width and the height of the cartridge 20 is, however, not limited to this order but may be determined arbitrarily; for example, the height, the length and the width may descend in this order or the height, the length and the width may be equal to one another.

The housing 22 of the cartridge 20 includes a first wall 201, a second wall 202, a third wall 203, a fourth wall 204, a fifth wall 205, a six wall 206 and connection walls 209. The connection walls 209 include a seventh wall 207 and an eighth wall 208 (FIG. 9). The first to the eighth walls 201 to 208 define the inner space including the printing material chamber 200 of the cartridge 20. In the description below, the symbols 201 to 208 assigned to the first to the eighth walls are also used to represent the outer surfaces of the walls constituting the housing 22 of the cartridge 20 (i.e., first to eighth faces 201 to 208). The outer surfaces (first to eighth faces) 201 to 208 of the first to the eighth walls are substantial planes. The "substantial plane" means not only a perfectly flat plane but a plane having partial slight irregularity. In other words, the "substantial plane" includes a plane that has partial slight irregularity but is still recognizable as a face or a wall of the housing 22 of the cartridge 20. The first to the eighth faces 201 to 208 are in rectangular shapes in the planar view.

The first face (first wall) 201, the second face (second wall) 202, the third face (third wall) 203, the fourth face (fourth wall) 204, the fifth face (fifth wall) 205 and the sixth face (sixth wall) 206 are also called "bottom face (bottom wall)", "top face (top wall)", "front face (front wall)", "rear face (rear wall)", "left side face (left wall)" and "right side face (right wall)", respectively.

The first face 201 and the second face 202 are opposed to each other in the Z-axis direction. The first face 201 is located on the −Z-axis direction side, while the second face 202 is located on the +Z-axis direction side. The third face 203 and the fourth face 204 are opposed to each other in the X-axis direction. The third face 203 is located on the +X-axis direction side, while the fourth face 204 is located on the −X-axis direction side. The fifth face 205 and the sixth face 206 are opposed to each other in the Y-axis direction. The fifth face 205 is located on the +Y-axis direction side, while the sixth face 206 is located on the −Y-axis direction side.

According to this embodiment, the first face 201 located on the −Z-axis direction side forms the bottom face in the attached state. The first face 201 is an XY plane parallel to the X axis and the Y axis and perpendicular to the Z axis. The first face 201 is a horizontal face in the attached state.

The second face 202 located on the +Z-axis direction side forms the top face in the attached state. The second face 202 is opposed to the first face 201 and is parallel to the first face 201. The second face 202 is a plane (XY plane) parallel to the X axis and the Y axis and perpendicular to the Z axis. The second face 202 is a horizontal face in the attached state.

The third face 203 located on the +X-axis direction side forms a side face in the attached state. The third face 203 is perpendicular to the first face 201 and the second face 202 and is a plane (YZ plane) parallel to the Y axis and the Z axis and perpendicular to the X axis. Among sides of the third face 203, a side 290 located on the most −Z-axis direction side is called "first side 290", and a side 291 located on the most +Z-axis direction side is called "second side 291". In the specification hereof, the expression that "two faces intersect or cross each other" means not only the state that two faces actually cross each other but the state that an extension of one face intersects the other face and the state that extensions of two faces cross each other.

The fourth face 204 located on the −X-axis direction side forms a side face in the attached state. The fourth face 204 is perpendicular to the first face 201 and the second face 202. The fourth face 204 is parallel to the third face 203. The fourth face 204 is a plane (YZ plane) parallel to the Y axis and the Z axis and perpendicular to the X axis.

The fifth face 205 located on the +Y-axis direction side and the sixth face 206 located on the −Y-axis direction side form side faces in the attached state. The fifth face 205 and the sixth face 206 are perpendicular to the first to the fourth faces 201 to 204. The fifth face 205 and the sixth face 206 are planes (XZ planes) parallel to the X axis and the Z axis and perpendicular to the Y axis. The sixth face 206 is parallel to the fifth face 205.

As shown in FIG. 9, the connection faces 209 couple the first face 201 with the third face 203. The seventh face 207 of the connection faces 209 is perpendicular to the first face 201 and is a plane (YZ plane) parallel to the Y axis and the Z axis. The seventh face 207 as a step is vertically-angled relative to the first face 201. In other words, the seventh face 207 is extended in the +Z-axis direction from the first face 201. The seventh face 207 is located on the −X-axis direction side and on the −Z-axis direction side of the eighth face 208. The eighth face 208 couples the seventh face 207 with the third face 203. The eighth face 208 is a sloped surface inclined in a direction including a +X-axis direction component and a −Z-axis direction component. The eighth face 208 is inclined to the first face 201 and the third face 203. The eight face 208 is perpendicular to the fifth face 205 and the sixth face 206. In other words, the eighth face 208 is inclined to the XY plane and the YZ plane and is perpendicular to the XZ plane. The eighth face 208 has a board mounting member 208T protruded outward from the eighth face 208.

The relationships of the first to the sixth faces 201 to 206 indicate that the facing direction of the first face 201 and the second face 202 is the Z-axis direction, the facing direction of the third face 203 and the fourth face 204 is the X-axis direction and the facing direction of the fifth face 205 and the sixth face 206 is the Y-axis direction.

As shown in FIG. 7, the circuit board 40 is mounted on the board mounting member 208T of the eighth face 208. The circuit board 40 has a surface 408 that is inclined in the direction including the +X-axis direction component and the −Z-axis direction component, like the eighth face 208. The surface 408 is inclined to the first face 201 and the third face 203. The surface 408 is perpendicular to the fifth face 205 and the sixth face 206. In other words, the surface 408 is inclined to the XY plane and the YZ plane and is perpendicular to the XZ plane. The surface 408 is also called "sloped surface 408". The surface 408 has cartridge-side terminals 400, which are in contact with the apparatus-side terminals of the contact mechanism 70 (FIG. 2).

The seventh face 207 and the surface 408 form part of the outer surfaces of the cartridge 20. More specifically the seventh face 207 and the surface 408 form a portion of a corner section 265 coupling the first face 201 and the third face 203 that form part of the outer surfaces of the cartridge 20. For the better understanding, the corner section 265 is shown by a thick line in FIG. 9. The third face 203 and the corner section 265 are opposed to the first apparatus-side side wall member 603 of the holder 60 (FIG. 14) in the attached state of the cartridge 20 to the holder 60 as described later. The third face 203 and the corner section 265 are thus called "first opposed outer wall surface". The fourth face 204 is opposed to the second apparatus-side side wall member 604 of the holder 60 (FIG. 15) in the attached state as described later. The fourth face 204 is thus called "second opposed outer wall surface".

As shown in FIG. 10A, the circuit board 40 has a boss groove 401 at a +Z-axis direction end and a boss hole 402 at a −Z-axis direction end. The circuit board 40 is fixed to the eighth face 208 of the cartridge 20 by means of the boss groove 401 and the boss hole 402. According to this embodiment, the boss groove 401 and the boss hole 402 are provided at positions intersecting the plane Yc passing through the center of the width (Y-axis direction length) of the cartridge 20. According to another embodiment, at least one of the boss groove 401 and the boss hole 402 may be omitted from the circuit board 40, and the circuit board 40 may be fixed to the eighth face 208 by an adhesive or by an engagement click (not shown) provided on the eighth face 208.

As shown in FIGS. 10A and 10B, the circuit board 40 includes the cartridge-side terminals 400 provided on the surface 408 and a memory unit 420 provided on a rear face 409. The surface 408 and the rear face 409 are planes. A portion or a side of the plane surface 408 located on the most +Z-axis direction side in the mounting state of the circuit board 40 on the cartridge 20 is called a board end 405.

The cartridge-side terminals 400 include nine terminals 431 to 439. The memory unit 420 stores information regarding ink of the cartridge 20 (for example, remaining amount of ink and ink color).

As shown in FIG. 10A, the nine cartridge-side terminals 431 to 439 are all in approximate rectangular shape and are arrayed in two lines that are substantially perpendicular to the attachment direction SD. The substantially perpendicular lines are extended in the width direction (Y-axis direction) of the cartridge 20. The back line of the two lines along the attachment direction SD is called first terminal line R1 (lower line R1), and the front line along the attachment direction SD is called second terminal line R2 (upper line R2). The first terminal line R1 and the second terminal line R2 have different positions in the Z-axis direction. More specifically, the first terminal line R1 is located on the −Z-axis direction side of the second terminal line R2. Each of the terminals 431 to 439 has a contact portion "cp" on its center, which is in contact with the contact mechanism 70. The first terminal line R1 and the second terminal line R2 may be regarded as lines formed by a plurality of contact portions "cp".

The terminals 431 to 439 may be called by the following names corresponding to their functions or applications. For differentiation from the terminals on the printer 50, the word "cartridge-side" may be prefixed to each name. For example, the "ground terminal 437" may be called "cartridge-side ground terminal 437".

<First Terminal Line R1>

(1) attachment detection terminal (first terminal) 435;
(2) power terminal 436;
(3) ground terminal 437;
(4) data terminal 438; and
(5) attachment detection terminal (second terminal) 439.

<Second Terminal Line R2>

(6) attachment detection terminal (third terminal) 431;
(7) reset terminal 432;
(8) clock terminal 433; and
(9) attachment detection terminal (fourth terminal) 434.

The contact portions "cp" of the terminals 435 to 439 on the first terminal line R1 and the contact portions "cp" of the terminals 431 to 434 on the second terminal line R2 are arranged alternately or more specifically in zigzag.

The four attachment detection terminals 431, 434, 435 and 439 are used to check the good/poor electrical contact with the corresponding apparatus-side terminals provided in the contact mechanism 70, so that the printer 50 can detect whether the cartridge 20 is properly attached at the designed attachment position of the holder 60. These four terminals 431, 434, 435 and 439 are collectively called "attachment detection terminals". According to this embodiment, the four cartridge-side terminals 431, 434, 435 and 439 are electrically connected with one another inside the circuit board 40. When the cartridge 20 is attached to the holder 60, these terminals 431, 434, 435 and 439 are electrically connected with a ground line (not shown) on the printer 50 via the ground terminal 437. The method of detecting attachment by using the four attachment detection terminals 431, 434, 435 and 439 will be described later.

The other five cartridge-side terminals 432, 433, 436, 437 and 438 are terminals for the memory unit 420. These five terminals 432, 433, 436, 437 and 438 are thus also called "memory terminals".

The reset terminal 432 receives a reset signal RST, which is to be supplied to the memory unit 420. The clock terminal 433 receives a clock signal SCK, which is to be supplied to the memory unit 420. The power terminal 436 receives a power-supply voltage VDD (for example, rated voltage of 3.3 V), which is to be supplied to the memory unit 420. The ground terminal 437 receives a ground voltage VSS (0V), which is to be supplied to the memory unit 420. The data terminal 438 receives a data signal SDA, which is to be supplied to the memory unit 420.

The first terminal 435 as one of the attachment detection terminals includes a first outer part 435P located on the most +Y-axis direction side of the cartridge-side terminals 400. The second terminal 439 as one of the attachment detection terminals includes a second outer part 439P located on the most −Y-axis direction side of the cartridge-side terminals 400. The third terminal 431 as one of the attachment detection terminals includes a third outer part 431P located on the most +Y-axis direction side of the second terminal line R. The fourth terminal 434 as one of the attachment detection terminals includes a fourth outer part 434P located on the most −Y-axis direction side of the second terminal line R.

Among the contact portions "cp" of the cartridge-side terminals 400, the ground terminal 437 having the contact portion "cp" on the center in the Y-axis direction is provided at the position intersecting the plane Yc passing through the center of the width (Y-axis direction length) of the cartridge 20. The contact portions "cp" of the other terminals 431 to 436, 438 and 439 are arranged to be symmetrical with respect to the line of intersection of the plane Yc and the ground terminal 437 as the axis. The ground terminal 437 is configured to be in contact with the contact mechanism 70 prior to the other cartridge-side terminals 431 to 436, 438 and 439 in the course of attachment of the cartridge 20 to the holder 60. The pressing force first applied from the holder 60 to the circuit board 40 is thus generated on the substantial center of the width or the Y-axis direction length of the cartridge 20. This prevents the pressing force applied to the circuit board 40 from acting to tilt the cartridge 20 in the Y-axis direction and thereby enables the attachment of the cartridge 20 at the designed attachment position. Such contact of the ground terminal 437 with the contact mechanism 70 of the holder 60 prior to the other cartridge-side terminals 431 to 436, 438 and 439 advantageously prevents or reduces the high voltage-induced troubles and failures by the grounding function of the ground terminal 437, even when an unexpected high voltage is applied to the cartridge 20.

According to this embodiment, the ground terminal 437 is formed longer along the Z-axis direction than the other cartridge-side terminals 431 to 436, 438 and 439. This ensures the contact of the ground terminal 437 with the contact mechanism 70 of the holder 60. According to another embodiment, all the cartridge-side terminals 431 to 439 on the circuit board 40 may be formed in the same size.

As shown in FIG. 9, the printing material supply port 280 is protruded in the −Z-axis direction from the first face 201. The printing material supply port 280 communicates with the printing material chamber 200 via the printing material flow path 282. The printing material supply port 280 is connected with the printing material supply tube 640 (FIG. 5) of the printer 50 to supply the ink contained in the printing material chamber 200 to the head 540 (FIG. 1). In other words, the printing material supply port 280 is open to outside, in order to supply the ink contained in the printing material chamber 200 to outside of the cartridge 20.

The printing material supply port 280 is provided at the position closer to the fourth face 204 than the third face 203 on the first face 201. The distance between the outer surface of the printing material supply port 280 and the third face 203 in the X-axis direction is accordingly greater than the distance between the outer surface of the printing material supply port 280 and the fourth face 204.

The printing material supply port 280 has an open peripheral end. The surface at this open peripheral end or open surface 288 is a horizontal plane in the attached state. The open surface 288 is accordingly a plane (XY plane) parallel to the X axis and the Y axis.

A resin foam 284 is provided inside the printing material supply port 280 at the position on the +Z-axis direction side of the open surface 288 or more specifically at the position in contact with the printing material flow path 282. According to this embodiment, before shipment of the cartridge 20, the open surface 288 of the printing material supply port 280 is sealed with a sealing member (not shown), such as a cap or a film. For attachment of the cartridge 20 to the holder 60, the sealing member (not shown) for sealing the open surface 288 is removed from the cartridge 20.

According to this embodiment, the printing material supply port 280 is protruded in the −Z-axis direction with the center on the central axis C of the printing material supply tube 640. According to another embodiment, the center of the printing material supply port 280 may be deviated from the central axis C of the printing material supply tube 640. According to this embodiment, the open surface 288 of the printing material supply port 280 viewed from the −Z-axis direction is formed by the line-symmetrical housing with respect to axes parallel to the X axis and the Y axis. According to another embodiment, the open surface 288 of the printing material supply port 280 may be formed by the asymmetric housing. The open surface 288 viewed from the Z direction is in the rounded rectangular shape according to this embodiment but may be in any other suitable shape, e.g., precise circle, ellipse, oval, square or rectangle according to other embodiments.

As shown in FIG. 7, the first cartridge-side restriction portion 210 is provided on the third face 203. The first cartridge-side restriction portion 210 is located on the +Z-axis direction side and on the +X-axis direction side of the printing material supply port 280 and the circuit board 40. The first cartridge-side restriction portion 210 is locked by the lever 80 (FIG. 2), so as to restrict the motion of the cartridge 20 in the attached state. The first cartridge-side restriction portion 210 is structured as a projection protruded in the +X-axis direction (outward) from the third face 203. The first cartridge-side restriction portion 210 is located at the position closer to the first side 290 than the second side 291 along the Z-axis direction. According to this embodiment, the first cartridge-side restriction portion 210 is located adjacent to the first side 290.

The first cartridge-side restriction portion 210 includes a first portion 212 extended in the Y-axis direction (width direction), a second portion 214 extended in the +Z-axis direction (vertically upward direction) from the first portion 212, and a third portion 215 extended in the −Z-axis direction (vertically downward direction) from the first portion 212. The first portion 212 cooperates with the lever 80 to restrict the motion of the cartridge 20 in the attached state. The second portion 214 is provided to lock the first portion 212 by the expected part of the lever 80 in attachment of the cartridge 20 to the holder 60.

The first portion 212 includes a first cartridge-side locking surface 211 as a first abutting part and a second cartridge-side locking surface 213 as a second abutting part. The first cartridge-side locking surface 211 faces in the +Z-axis direction. The second cartridge-side locking surface 213 faces in the +X-axis direction. The third portion 215 is in contact with the first portion 212 and the first side 290.

The cartridge 20 further includes the second cartridge-side restriction portion 220 provided on the fourth face 204, a projection 260 provided on the third face 203 and a third cartridge-side restriction portion 250 provided on the seventh face 207.

The second cartridge-side restriction portion 220 is structured as a projection protruded in the −X-axis direction from the fourth face 204. The second cartridge-side restriction portion 220 is inserted into the second apparatus-side restriction portion 620 (FIG. 3) in the form of the through hole of the holder 60. The user turns the cartridge 20 around the second cartridge-side restriction portion 220 inserted in the second apparatus-side restriction portion 620 (FIG. 3) in attachment or detachment of the cartridge 20 to or from the holder 60. In other words, the second apparatus-side restriction portion 620 serves as the guide for attachment or detachment of the cartridge 20 to or from the holder 60. This facilitates the attachment and detachment of the cartridge 20 to and from the holder 60. In the attached state of the cartridge 20, the second cartridge-side restriction portion 220 is locked by the second apparatus-side restriction portion 620 to restrict the motion of the cartridge 20 in the attached state. The second cartridge-side restriction portion 220 is located on the +Z-axis direction side and on the −X-axis direction side of the printing material supply port 280 and the circuit board 40.

The projection 260 on the third face 203 is located on the +Z-axis direction side of the first cartridge-side restriction portion 210. According to this embodiment, the projection 260 is located at the most +Z-axis direction position (most upward position) including the second side 291 on the third face 203.

The third cartridge-side restriction portion 250 is structured as a pair of projection members (restriction walls) protruded in the +X-axis direction from both Y-axis direction sides of the seventh face 207. The pair of projection members 250 receive the projection 636 (FIG. 2) inserted therebetween and, in cooperation with the projection 636, restrict the motion of the cartridge 20 in the Y-axis direction in the attached state.

Figure 11:
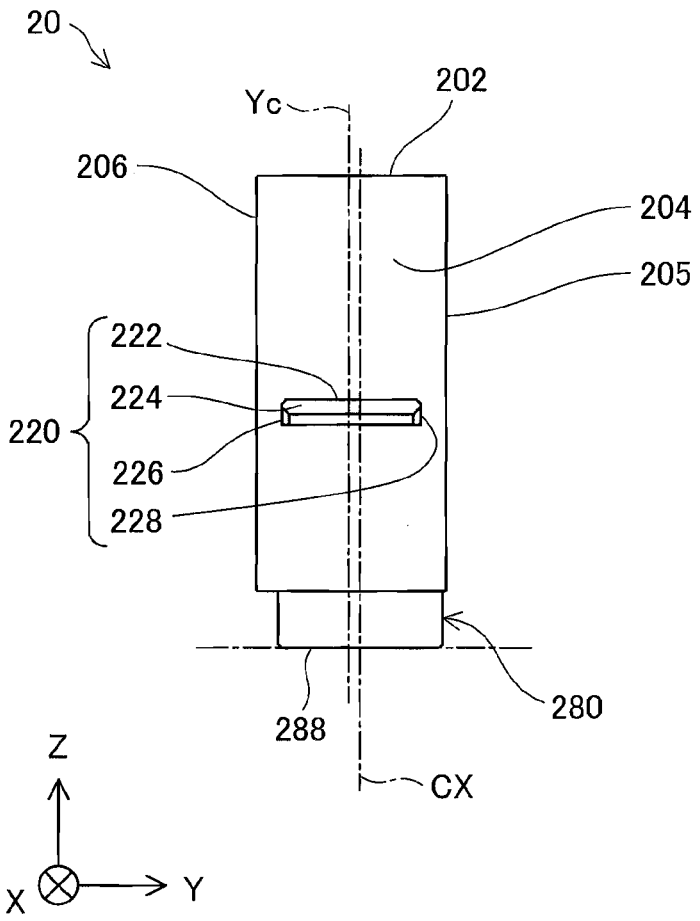
FIG. 11 is a rear view of the cartridge.

FIG. 11 is a rear view of the cartridge 20. The second cartridge-side restriction portion 220 is described in detail with reference to FIG. 11. The second cartridge-side restriction portion 220 includes a first restriction locking surface 222 as a first restriction locking portion, a sloped surface 224, a first restriction side face 226 and a second restriction side face 228.

The first restriction locking surface 222 faces in the +Z-axis direction and forms a horizontal face in the attached state. The first restriction locking surface 222 is in contact with the second apparatus-side restriction portion 620 (FIG. 3) to serve as the pivot point of rotation when the cartridge 20 is turned to be detached from the holder 60.

The first restriction locking surface 222 is locked by the second apparatus-side restriction portion 620 in the attached state, so as to restrict the motion of the cartridge 20 in the +Z-axis direction in the attached state. The first restriction locking surface 222 is provided at the position intersecting the plane Yc passing through the center of the width (Y-axis direction length) of the cartridge 20 and perpendicular to this plane Yc. As shown in FIG. 5, in the attached state of the cartridge 20, the cartridge 20 receives the pressing forces Ps and Pt including the +Z-axis direction components from the holder 60. The first restriction locking surface 222 is pressed against the second apparatus-side restriction portion 620 by these pressing forces Ps and Pt. The second apparatus-side restriction portion 620 is thus in contact with the first restriction locking surface 222 in parallel with the Y-axis direction. This reduces the possibility that the cartridge 20 is tilted about the X axis in the attached state.

The sloped surface 224 is connected with the first restriction locking surface 222 and is inclined to the direction including the +Z-axis direction component and the −X-axis direction component. This enables the first restriction locking surface 222 to be smoothly guided to the second apparatus-side restriction portion 620 in attachment of the cartridge 20 to the holder 60.

The first restriction side face 226 forms a −Y-axis direction side face of the second cartridge-side restriction portion 220. The second restriction side face 228 forms a +Y-axis direction side face of the second cartridge-side restriction portion 220. The first restriction side face 226 is a plane facing in the −Y-axis direction, and the second restriction side face 228 is a plane facing in the +Y-axis direction. The first restriction side face 226 and the second restriction side face 228 are planes respectively parallel to the X-axis direction and the Z-axis direction. The first and the second restriction side faces 226 and 228 interfere with the second apparatus-side restriction portion 620 to restrict the motion of the cartridge 20 in the Y-axis direction in the attached state of the cartridge 20.

Figure 12:
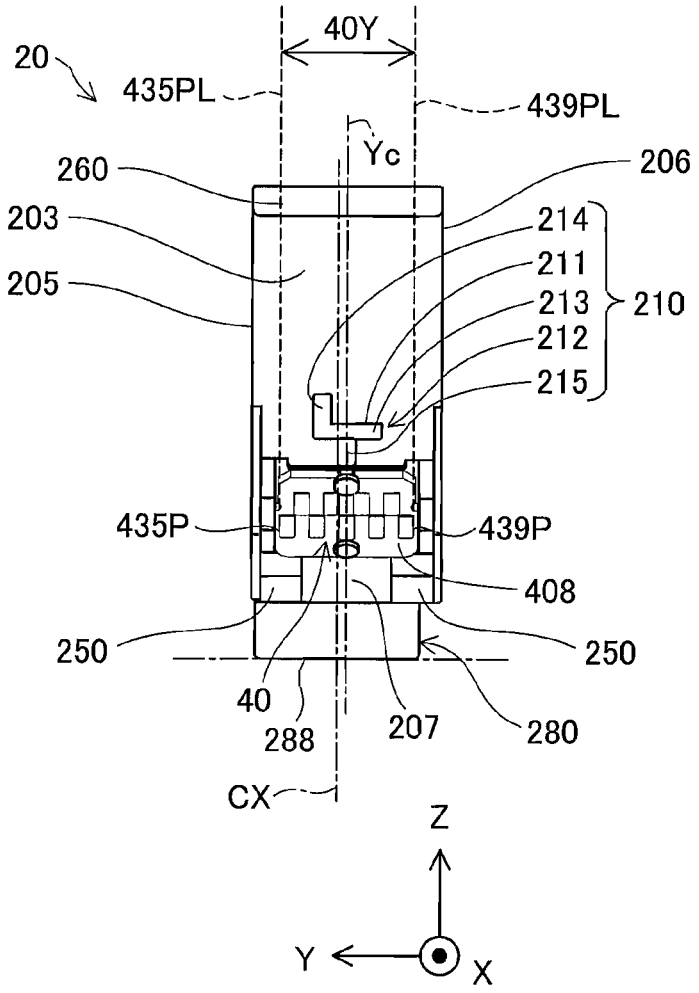
FIG. 12 is a front view of the cartridge.

FIG. 12 is a front view of the cartridge 20. The first cartridge-side restriction portion 210 is described more in detail with reference to FIG. 12. The first cartridge-side restriction portion 210 is provided at the position intersecting the plane Yc. The first cartridge-side locking surface 211 is provided at the position intersecting the plane Yc and perpendicular to this plane Yc.

The first cartridge-side locking surface 211 is located not outside but inside a range 40Y between the first outer part 435P and the second outer part 439P in the Y-axis direction (width direction), when the cartridge 20 is viewed from the third face 203-side in the −X-axis direction. According to this embodiment, the first cartridge-side restriction portion 210 including the first cartridge-side locking surface 211 is located not outside but inside the range 40Y. In other words, the first cartridge-side restriction portion 210 is located inside an area defined by a first phantom line 435PL including the first outer part 435P and a second phantom line 439PL including the second outer part 439P. The first phantom line 435PL and the second phantom line 439PL are straight lines extended in the Z-axis direction.

Figure 13:
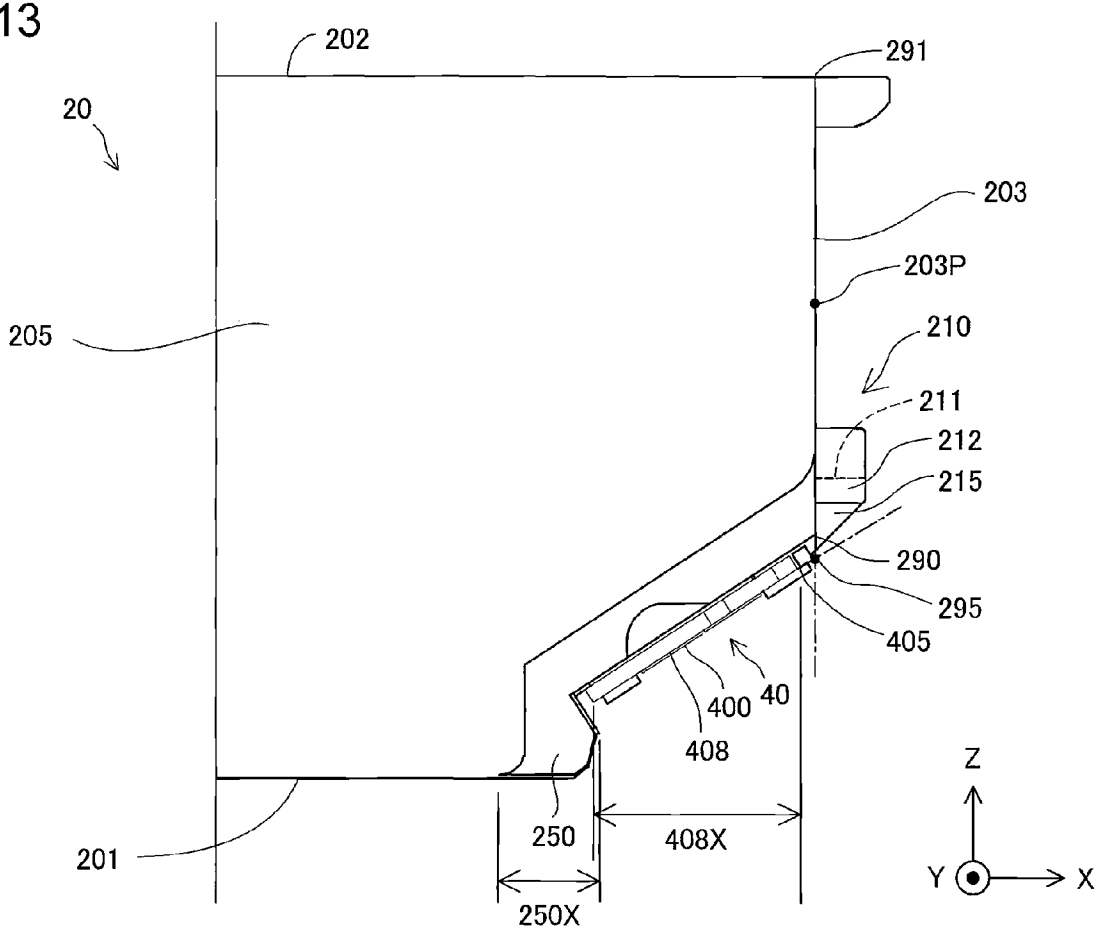
FIG. 13 is a left side view of the cartridge.

FIG. 13 is a left side view of the cartridge 20. The positional relationship of the respective members of the cartridge 20 is described with reference to FIG. 13. A part where the third face 203 intersects the sloped surface 408 is called "intersecting part 295". The intersecting part 295 is a line parallel to the Y-axis direction. According to this embodiment, the intersecting part 295 is located on a plane extended from the third face 203 in the −Z-axis direction. The intersecting part 295 is accordingly located on the −Z-axis direction side of the third face 203. The middle point in the Z-axis direction length on the third face 203 is called midpoint 203P.

The first cartridge-side restriction portion 210 is located close to the intersecting part 295. From another viewpoint, the first cartridge-side restriction portion 210 is located close to the board end 405. This means that the first cartridge-side restriction portion 210 can be sufficiently closer to the cartridge-side terminals 400. The first cartridge-side restriction portion 210 is provided preferably on a specific part of the third face 203 closer to the first side than the second side 291, i.e., the range from the midpoint 203P to the first side 290. It is especially preferable to provide the first cartridge-side restriction portion 210 at the position sufficiently close to the first side 290.

The effective part of the first cartridge-side restriction portion 210 specifically serving to restrict the position of the cartridge-side terminals 400 is the first cartridge-side locking surface 211. It is thus preferable to locate the first cartridge-side locking surface 211 as close as possible to the cartridge-side terminals 400. Omitting the third portion 215 of the first cartridge-side restriction portion 210 and locating the first portion 212 in contact with the first side 290 enable the first cartridge-side locking surface 211 to be closer to the intersecting part 295 or the board end 405.

FIG. 13 also shows an X-axis direction range 250X of the third cartridge-side restriction portion 250 and an X-axis direction range 408X of the sloped surface 408. As clearly understood from this drawing, part of the third cartridge-side restriction portion 250 overlaps with the sloped surface 408 in the X-axis direction, when the cartridge 20 is viewed from the first face 201-side in the +Z-axis direction.

A-4. Detailed Structure of Holder 60

A-4-1. General Structure of Holder 60

Figure 14:
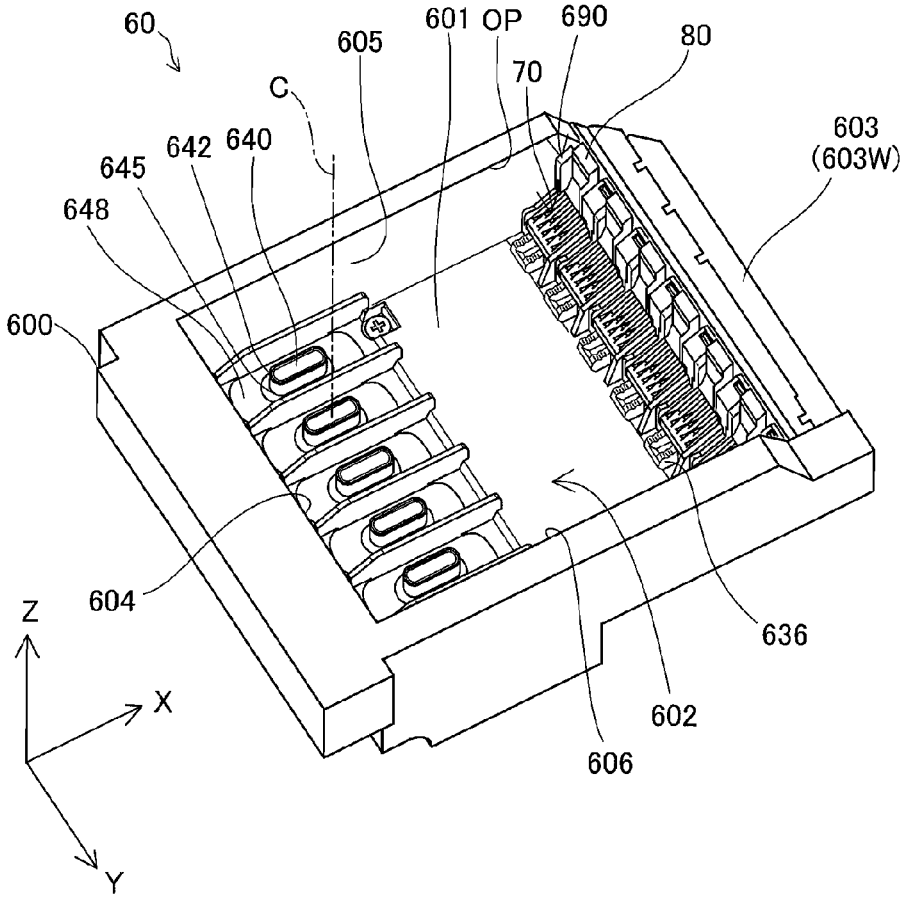
FIG. 14 is a perspective view illustrating the structure of the holder.
Figure 15:
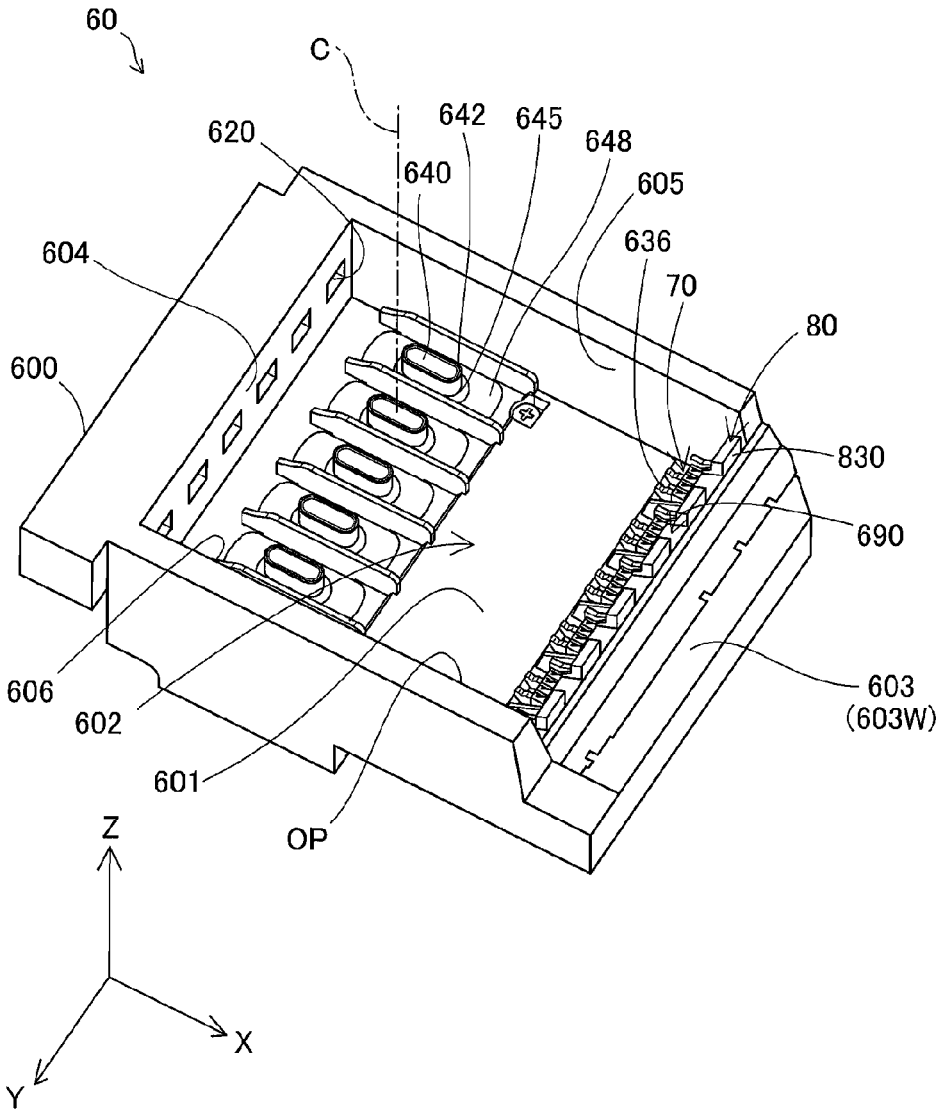
FIG. 15 is a perspective view illustrating the structure of the holder.
Figure 16:
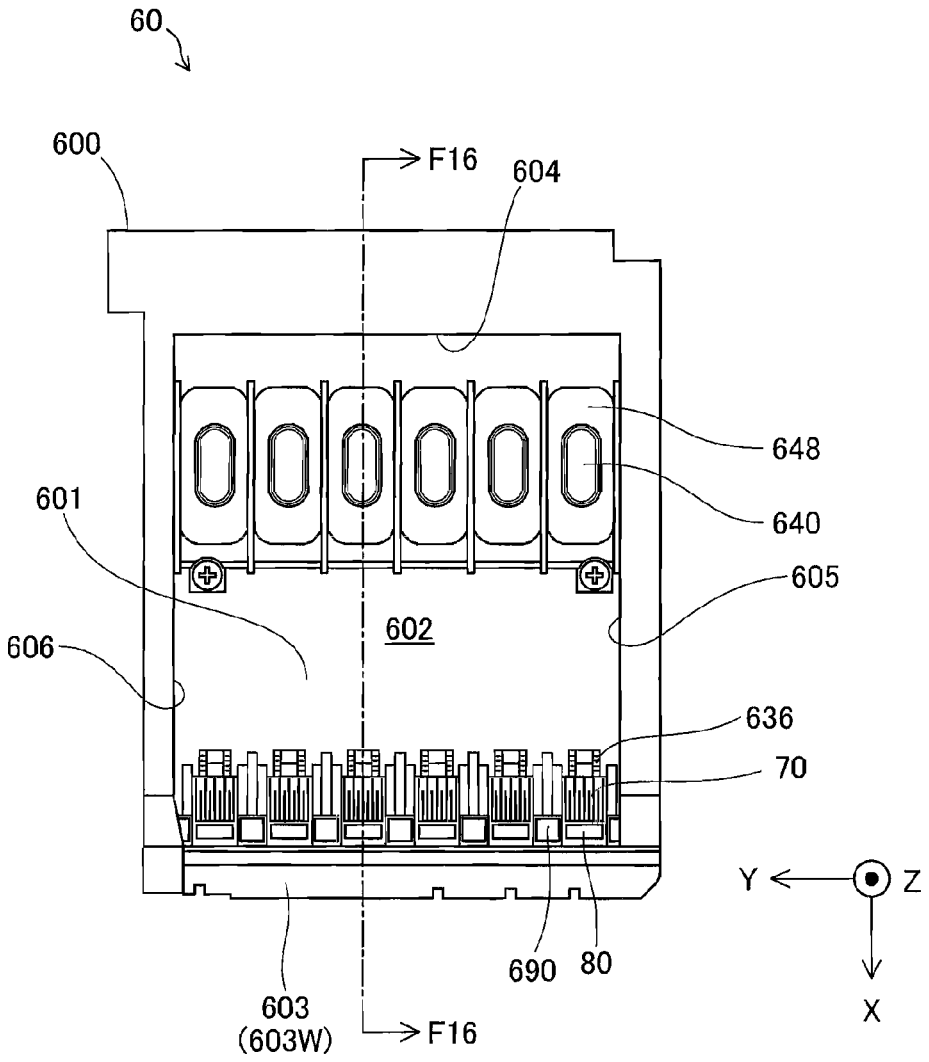
FIG. 16 is a top view illustrating the structure of the holder.
Figure 17:
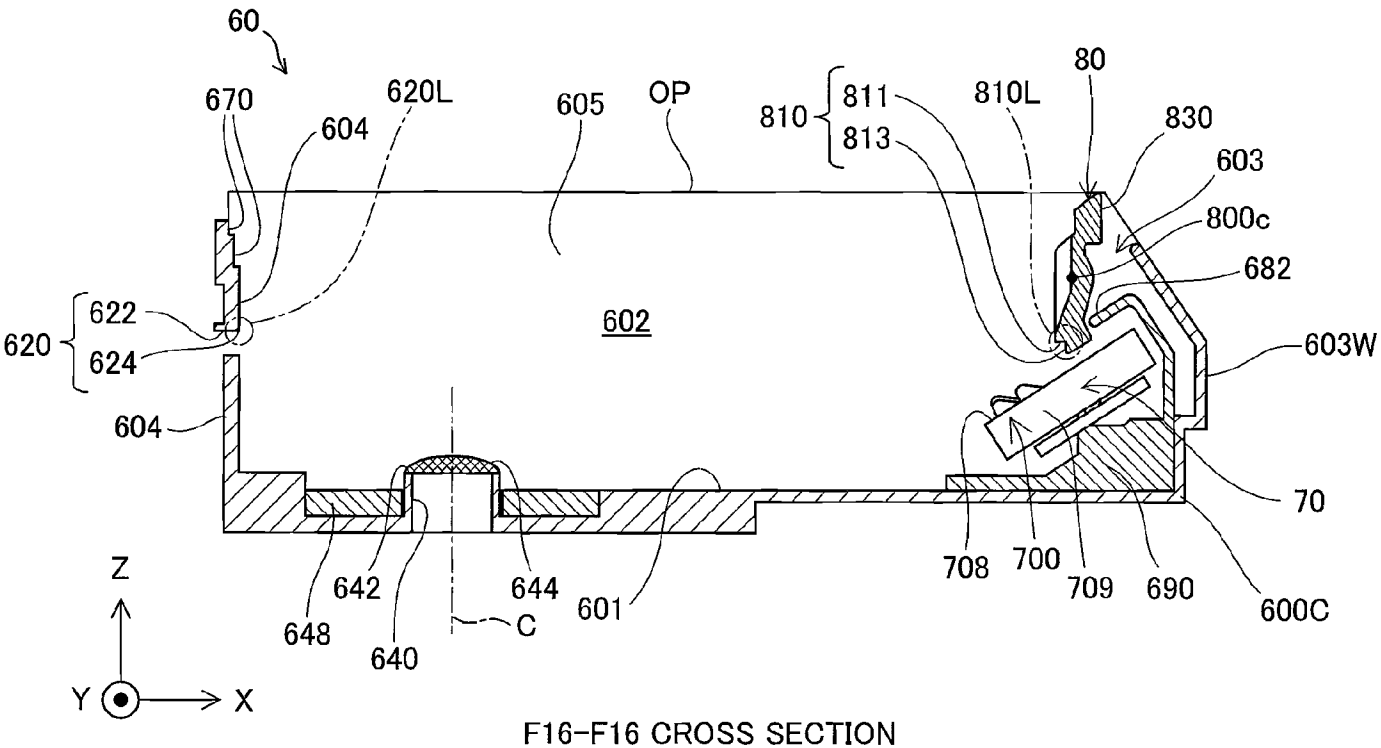
FIG. 17 is a sectional view, taken on line F16-F16 in FIG. 16.

FIGS. 14 and 15 are perspective views illustrating the structure of the holder 60. FIG. 16 is a top view illustrating the structure of the holder 60. FIG. 17 is a sectional view, taken on line F16-F16 in FIG. 16. The projection 636 shown in FIGS. 14 to 16 is omitted from the illustration of FIG. 17.

As described above, the holder 60 of the printer 50 has the five wall members 601, 603, 604, 605 and 606 to form the concave cartridge chamber 602 to receive the cartridge 20. The five wall members 601, 603, 604, 605 and 606 are collectively called "chamber-forming wall members 600". According to this embodiment, the five wall members 601, 603, 604, 605 and 606 are resin plate members and are made of a synthetic resin, more specifically modified polyphenylene ether (m-PPE).

The wall member 601 forms the bottom face of the concave cartridge chamber 602. The wall members 603, 604, 605 and 606 form the side faces of the concave cartridge chamber 602. The wall member 601, the wall member 603, the wall member 604, the wall member 605 and the wall member 606 are respectively called "apparatus-side bottom wall member 601", "first apparatus-side side wall member 603", "second apparatus-side side wall member 604", "third apparatus-side side wall member 605" and "fourth apparatus-side side wall member 606".

Each of the printing material supply tubes 640 and each of the contact mechanisms 70 including the apparatus-side terminals are arrayed in the X-axis direction on the wall member 601. The printing material supply tube 640 is located on the side of the wall member 604, and the contact mechanism 70 is located on the side of the wall member 603. In other words, the printing material supply tube 640 is provided at the position closer to the wall member 604 than the wall member 603.

The contact mechanism 70 is provided at the position closer to the wall member 603 than the printing material supply tube 640.

The elastic member 648 is provided around the printing material supply tube 640 on the wall member 601. As described above with reference to FIG. 5, the elastic member 648 seals the periphery of the printing material supply port 280 the cartridge 20 and thereby prevents leakage of ink from the printing material supply port 280 to the periphery in the attached state of the cartridge 20 to the holder 60. The elastic member 648 generates the pressing force Ps in the direction of pressing back the printing material supply port 280 of the cartridge 20 (in the +Z-axis direction) in the attached state of the cartridge 20 to the holder 60 (FIG. 5).

As shown in FIGS. 14 to 16, the cartridge 20 has an opening OP on the upper side opposed to the wall member 601 across the cartridge chamber 602. The cartridge 20 passes through the opening Op when the cartridge 20 is attached to or detached from the holder 60.

The wall member 603 is vertically-angled relative to the wall member 601 on the +X-axis direction side of the wall member 601. According to this embodiment, the most +X-axis direction side of the wall member 603 forms an outer wall 603W. In the use attitude of the printer 50, the outer wall 603W forms the front face of the holder 60. The outer wall 603W is extended in the direction of the array of the plurality of cartridges 20 (Y-axis direction). The lever 80 used for attachment and detachment of the cartridge 20 is provided on the wall member 603. The lever 80 is fixed in a rotatable manner to the wall member 603 via a retainer 690. In other words, the lever 80 is fixed to the retainer 690 forming part of the wall member 603. The axis of rotation of the lever 80 is parallel to the Y-axis direction.

The retainer 690 is provided at a corner section (apparatus-side corner section) 600C (FIG. 17) where the side wall member 603 intersects the bottom wall member 601.

As shown in FIG. 5, the operating member 830 is provided on the +Z-axis direction end of the lever 80. When the user presses this operating member 803 from the +X-axis direction side toward the −X-axis direction side (i.e., when the user applies the operating force Pr to the operating member 803), the lever 80 is turned counterclockwise (seen from the +Y-axis direction) about the axis of rotation. The lever 80 is accordingly rotated on the XZ plane parallel to the X-axis direction and the Z-axis direction.

The lever 80 is provided as a separate member from the chamber-forming wall members 601, 603, 604, 605 and 606. The lever 80 is made of a synthetic resin, more specifically polyacetal (POM) according to this embodiment. The lever 80 has a certain level of rigidity sufficient to lock the cartridge 20. More specifically, the lever 80 preferably has rigidity that causes no substantial deformation of the lever 80 by a force (for example, force of 14.4 N) applied from the cartridge 20 in the attached state. For example, the deformation of the lever 80 by application of an external force of 14.4N from the cartridge 20 is preferably not greater than about 0.5 mm. The lever 80 preferably does not have any elastically deformable portion. This reduces the possibility that the lever 80 is significantly deformed by the force applied from the cartridge 20 in the attached state of the cartridge 20 and ensures the stable electrical connection between the cartridge-side terminals 400 and the apparatus-side terminals of the contact mechanism 70. Providing the separate lever 80 from the chamber-forming wall members 601, 603, 604, 605 and 606 advantageously increases the degree of freedom in selection of the material for the lever 80.

Referring back to FIGS. 14 to 17, the wall member 604 is vertically-angled relative to the wall member 601 on the −X-axis direction side of the wall member 601. The wall member 604 is opposed to the wall member 603 across the cartridge chamber 602. According to this embodiment, the wall member 604 forms the rear face of the holder 60 in the use attitude of the printer 50. The wall member 604 is extended in the direction of the array of the plurality of cartridges 20 (Y-axis direction). The second apparatus-side restriction portion 620 is provided on the wall member 604. The second apparatus-side restriction portion 620 is a through hole passing through the X-axis direction (FIG. 17). According to another embodiment, the second apparatus-side restriction portion 620 may be a recess open to the cartridge chamber 602.

As described above with reference to FIG. 5, the second apparatus-side restriction portion 620 is configured to engage with the second cartridge-side restriction portion 220. The second apparatus-side restriction portion 620 serves as a guide for attachment and detachment of the cartridge 20 to and from the holder 60. The second apparatus-side restriction portion 620 locks the second cartridge-side restriction portion 220 in the attached state of the cartridge 20 to the holder 60. More specifically, the second apparatus-side restriction portion 620 locks the second cartridge-side restriction portion 220 at the second locking position 620L located on the +Z-axis direction side and on the −X-axis direction side of the printing material supply tube 640. According to this embodiment, the second apparatus-side restriction portion 620 is structured as a through hole having the size to receive the second cartridge-side restriction portion 220 and has a apparatus-side locking surface 622. The apparatus-side locking surface 622 is a plane facing in the −Z-axis direction and locks the first restriction locking surface 222 of the second cartridge-side restriction portion 220 (FIG. 11). A +X-axis direction end 624 of the apparatus-side locking surface 622 is in contact with the second cartridge-side restriction portion 220 and accordingly serves as the pivot point of rotation for detachment of the cartridge 20 from the holder 60.

As shown in FIG. 17, the second apparatus-side side wall member 604 of the holder 60 has a space 670 provided on the +Z-axis direction side of the second apparatus-side restriction portion 620. The space 670 provides a room to allow rotation of the cartridge 20 about the vicinity of the second apparatus-side restriction portion 620 as the pivot point of rotation when the cartridge 20 is attached to or detached from the holder 60. According to this embodiment, the space 670 is formed by steps recessed in the −X-axis direction stepwise in the +Z-axis direction from the second apparatus-side side wall member 604. According to another embodiment, the space 670 may be formed by a sloped surface of the wall member 604 lowered in the −X-axis direction gradually in the +Z-axis direction.

As shown in FIGS. 14 to 16, the wall member 605 is vertically-angled relative to the wall member 601 on the −Y-axis direction side of the wall member 601. According to this embodiment, the wall member 605 forms the right side face of the holder 60 in the use attitude of the printer 50. The wall member 605 is connected with the wall members 603 and 604. The wall member 605 is extended in the X-axis direction and crosses the direction of the array of the plurality of cartridges 20 (Y-axis direction).

The wall member 606 is vertically-angled relative to the wall member 601 on the +Y-axis direction side of the wall member 601. The wall member 606 is opposed to the wall member 605 across the cartridge chamber 602. According to this embodiment, the wall member 606 forms the left side face of the holder 60 in the use attitude of the printer 50. The wall member 606 is connected with the wall members 603 and 604. The wall member 606 is extended in the X-axis direction and crosses the direction of the array of the plurality of cartridges 20 (Y-axis direction).

According to the positional relationships of the wall members 601 and 603 to 606 described above, the wall member 601 is perpendicular to the Z-axis direction; the wall member 603 and the wall member 604 are opposed to each other in the X-axis direction; the wall member 605 and the wall member 606 are opposed to each other in the Y-axis direction; and the wall member 601 and the opening OP are opposed to each other in the Z-axis direction.

The contact mechanism 70 is provided at the corner section 600C where the wall member 601 intersects the wall member 603 of the holder 60. The contact mechanism 70 is located at the position closer to the wall member 603 than the printing material supply tube 640. The contact mechanism 70 includes a plurality of apparatus-side terminals corresponding to and in contact with the respective terminals 431 to 439 of the cartridge-side terminals 400 (FIG. 10), and a terminal base on which the plurality of apparatus-side terminals are located.

A-4-2. Detailed Structure of Contact Mechanism 70

Figure 18:
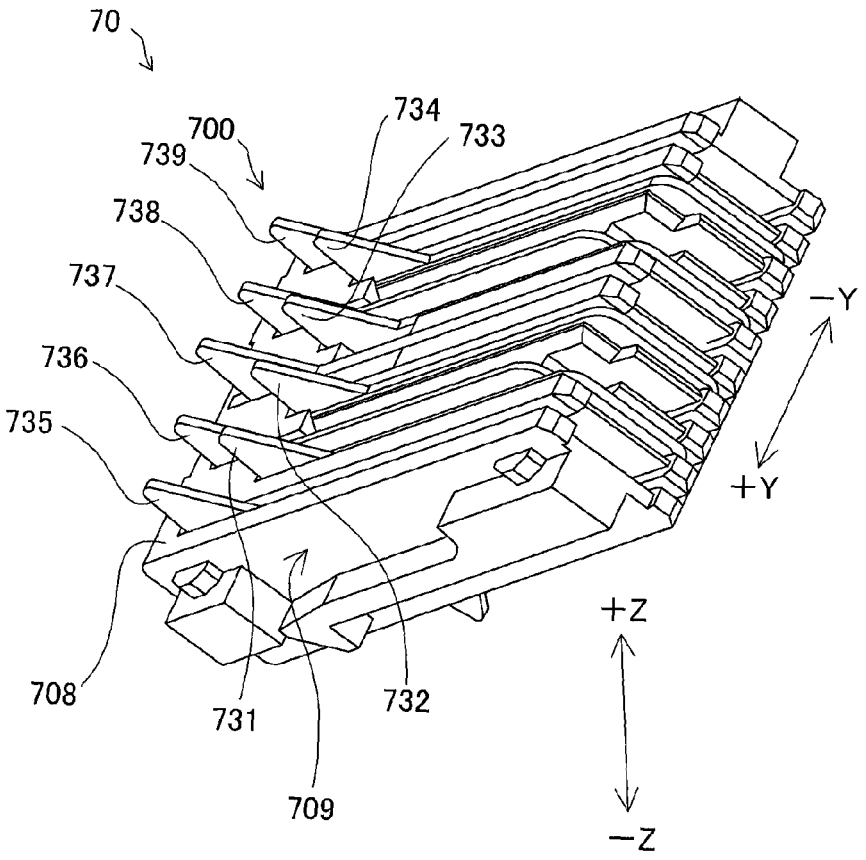
FIG. 18 is a perspective view of a contact mechanism.

FIG. 18 is a perspective view of the contact mechanism 70, which is detached from the holder 60.

The contact mechanism 70 includes a terminal base 709 and apparatus-side terminals 731 to 739 located on the terminal base 709. Each of the apparatus-side terminals 731 to 739 is an elastic member having electrical conductivity and has a protruded portion from a apparatus-side sloped surface 708, which is displaced by an external force. The apparatus-side terminals 731 to 739 generate the pressing force Pt in the direction of pressing back the circuit board 40 of the cartridge 20 (direction including the +Z-axis direction component and the −X-axis direction component) in the attached state of the cartridge 20 to the holder 60 (FIG. 5). The pressing force Pt is generated as a reaction force when the cartridge 20 presses the apparatus-side terminals 731 to 739 protruded from the apparatus-side sloped surface 708 toward the apparatus-side sloped surface 708.

The nine apparatus-side terminals 731 to 739 are provided at the positions corresponding to the nine cartridge-side terminals 431 to 439. The apparatus-side terminal 731 is called "attachment detection terminal (third terminal) 731". The apparatus-side terminal 732 is called "reset terminal 732". The apparatus-side terminal 733 is called "clock terminal 733". The apparatus-side terminal 734 is called "attachment detection terminal (fourth terminal) 734". The apparatus-side terminal 735 is called "attachment detection terminal (first terminal) 735". The apparatus-side terminal 736 is called "power terminal 736". The apparatus-side terminal 737 is called "ground terminal 737". The apparatus-side terminal 738 is called "data terminal 738". The apparatus-side terminal 739 is called "attachment detection terminal (second terminal) 739". For differentiation from the cartridge-side terminals, the word "apparatus-side" may be prefixed to each name. For example, the "ground terminal 737" may be called "apparatus-side ground terminal 737". The nine apparatus-side terminals 731 to 739 are collectively called apparatus-side terminals 700.

The nine apparatus-side terminals 731 to 739 are arrayed in a first apparatus-side terminal line and a second apparatus-side terminal line having different positions in the Z-axis direction. The first apparatus-side terminal line includes the five apparatus-side terminals 735 to 739, and the second apparatus-side terminal line includes the four apparatus-side terminals 731 to 734. The first apparatus-side terminal line is located on the −Z-axis direction side of the second apparatus-side terminal line. The number of the apparatus-side terminals is not limited to none but may be varied to any desired number greater than nine or less than nine according to the structure of the circuit board 40.

Among the nine apparatus-side terminals 731 to 739, the apparatus-side ground terminal 737 located on the substantial center in the Y-axis direction is electrically connected with a ground line (not shown). The height of the apparatus-side ground terminal 737 protruded from the apparatus-side sloped surface 708 is greater than the height of the other apparatus-side terminals 731 to 736, 738 and 739. The apparatus-side ground terminal 737 is accordingly in contact with the circuit board 40 of the cartridge 20 prior to the other apparatus-side terminals 731 to 736, 738 and 739.

According to this embodiment, in order to accelerate assembling the printer, the apparatus-side terminals 731 to 739 are located on the terminal base 709 and are unitized to the contact mechanism 70, which is incorporated in the holder 60. The unitized contact mechanism 70 using the terminal base 709 is, however, not essential. According to another embodiment, a suitable structure for receiving the apparatus-side terminals 731 to 739 may be formed integrally with the bottom wall member 601 or the outer wall 603W of the holder 60, and the apparatus-side terminals 731 to 739 may be incorporated in the structure. The terminal base 709 is accordingly not essential.

A-4-3. Detailed Structure of Lever 80

Figure 19:
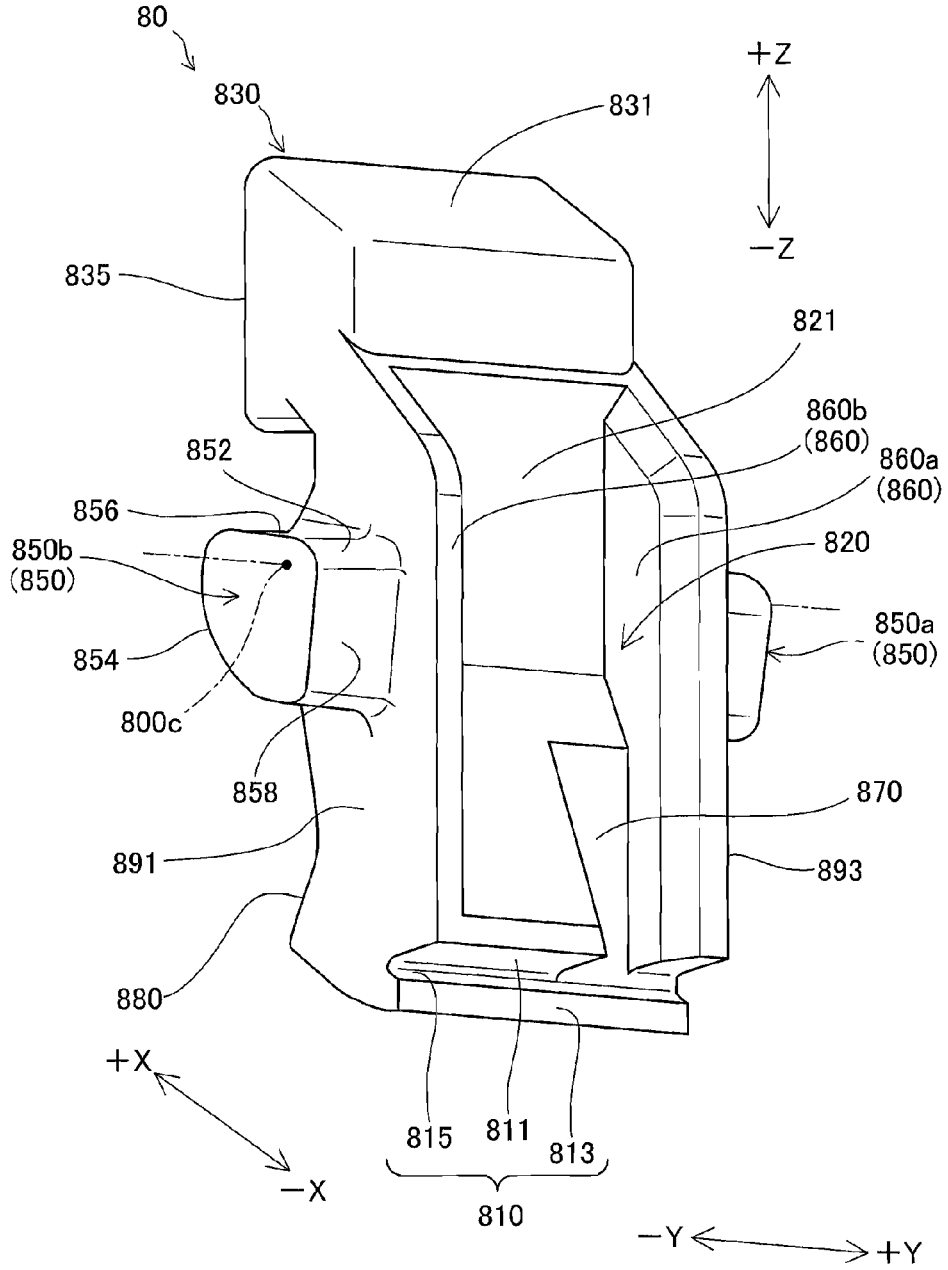
FIG. 19 is a perspective view illustrating the appearance of a lever.
Figure 20:
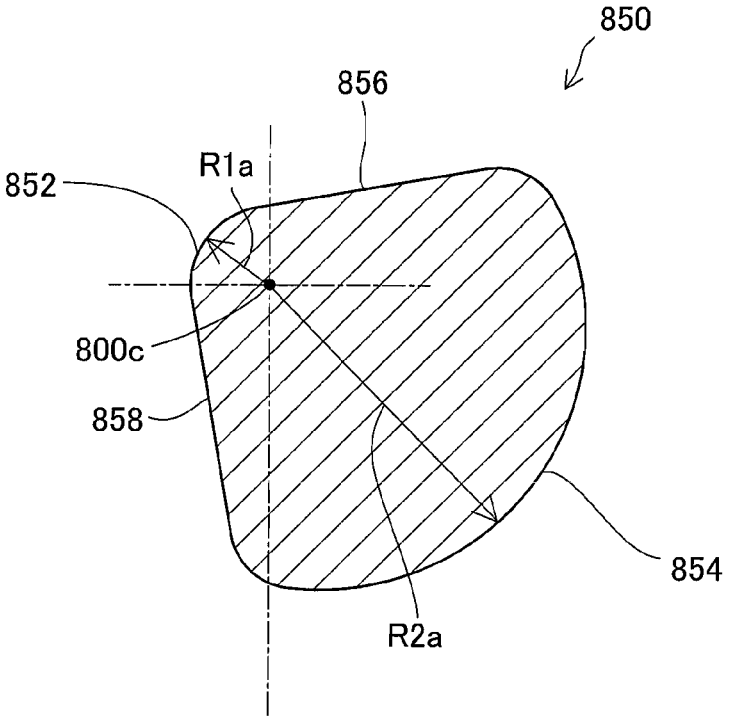
FIG. 20 illustrates a cross section of a shaft body of the lever taken on a plane parallel to the X axis and the Z axis.
Figure 21:
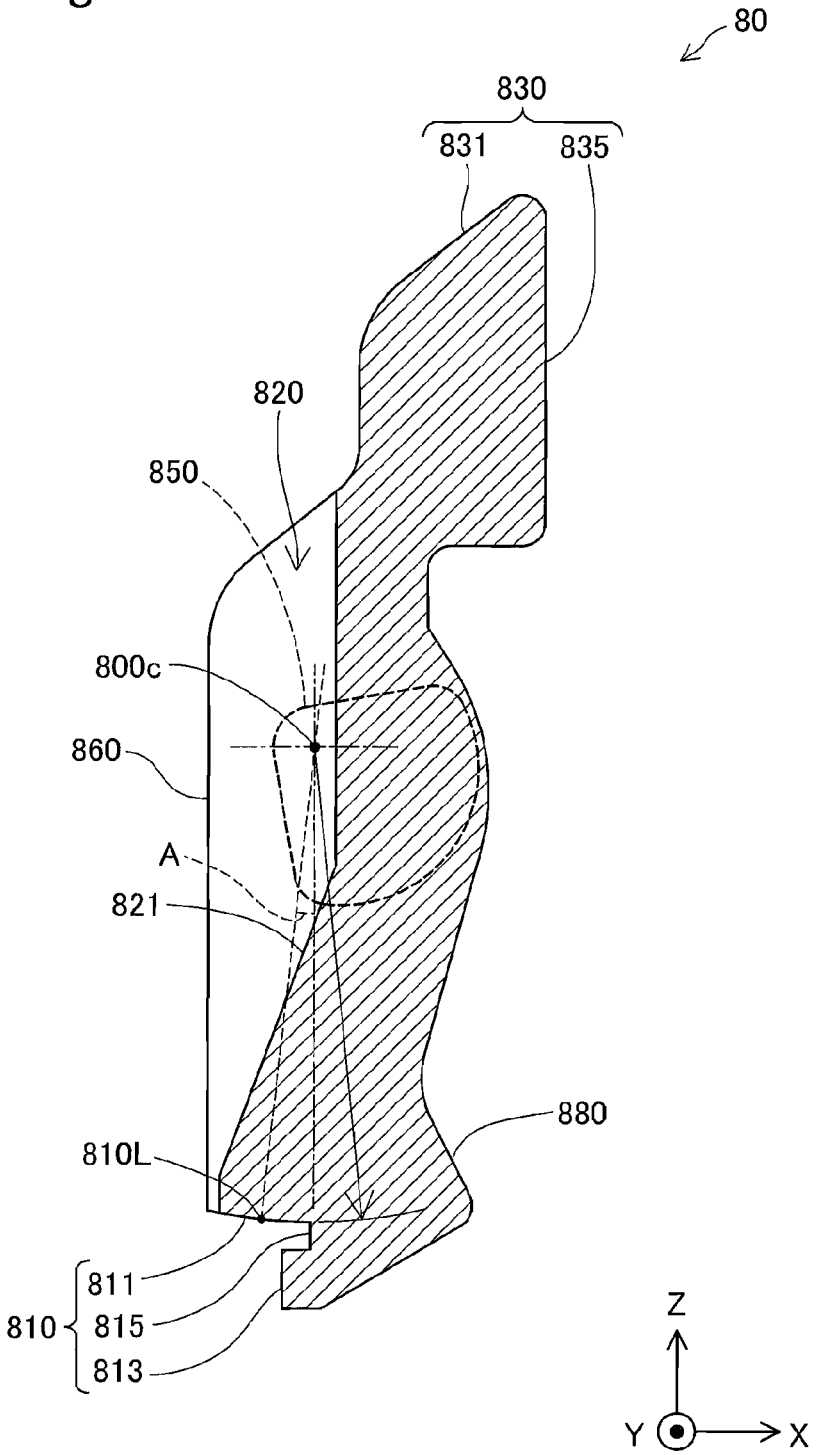
FIG. 21 is a sectional view of the lever.

FIG. 19 is a perspective view illustrating the appearance of the lever 80. FIG. 20 illustrates a cross section of a shaft body 850 taken on the plane parallel to the X axis and the Z axis (XZ plane, plane perpendicular to the Y axis). FIG. 21 illustrates a cross section of the lever 80 taken on the plane that passes through the central region in the width direction (Y-axis direction) of the lever 80 and is parallel to the X axis and the Z axis (XZ plane, plane perpendicular to the Y axis). FIG. 21 shows the cross section of the lever 80 in the state that the cartridge 20 is properly attached at the designed attachment position of the holder 60.

As shown in FIGS. 19 and 21, the lever 80 includes the operating member 830, a pair of shaft bodies 850, a guide member 820, and the first apparatus-side restriction portion 810. The lever 80 has the operating member 830 on one end (+Z-axis direction end) and the first apparatus-side restriction portion 810 on the other side (−Z-axis direction end). The lever 80 has an axis of rotation 800*c* between the operating member 830 and the first apparatus-side restriction member 810. In other words, the lever 80 turns around the axis of rotation 800*c* at the position between the operating member 830 and the first apparatus-side restriction portion 810.

The operating member 830 of the lever 80 receives the external force applied by the user. As shown in FIG. 21, the operating member 830 is provided at the +Z-axis direction end of the lever 80. The operating member 830 is located on the +Z-axis direction side of the axis of rotation 800*c* in the attached state of the cartridge 20 to the holder 60. The operating member 830 is located on the +Z-axis direction side of the first apparatus-side side wall member 603 of the holder 60 (FIG. 15).

The operating member 830 has an operation surface 835 and an operating-member opposed surface 831. The operation surface 835 receives the external force (force Pr shown in FIG. 5) applied by the user from the +X-axis direction side to the −X-axis direction side for detachment of the cartridge 20 from the holder 60. The operating-member opposed surface 831 is a face opposed to the cartridge 20 in the attached state of the cartridge 20 to the holder 60.

As shown in FIG. 19, the pair of shat bodies 850 are provided at the substantially middle position between the ends of the lever 80. The pair of shaft bodies 850 define the axis of rotation 800*c* of the lever 80. The axis of rotation 800*c* is parallel to the Y-axis direction (direction of the array of the cartridges 20). One shaft body 850*a* of the pair of shaft bodies 850 (called "first shaft body 850*a*") is protruded in the +Y-axis direction from an outer surface 893 on the +Y-axis direction side of the lever 80. The other shaft body 850*b* of the pair of shaft bodies 850 (called "second shaft body 850*b*") is protruded in the −Y-axis direction from an outer surface 891 on the −Y-axis direction side of the lever 80. The outer surfaces 891 and 893 are also called side faces 891 and 893. The pair of shaft bodies 850 provided on the lever 80 readily define the axis of rotation 800*c* by using a retainer as described later.

According to this embodiment, each of the shaft bodies 850 has an inner arc-shaped surface 852, an outer arc-shaped surface 854, and radial side faces 856 and 858. The respective faces 852, 854, 856 and 858 form the circumferential surface of the shaft body 850. The inner arc-shaped surface 852 and the outer arc-shaped surface 854 are respectively called "first curved surface 852" and "second curved surface 854". The centers of the inner arc-shaped surface 852 and the outer arc-shaped surface 854 correspond to the axis of rotation 800*c*. The inner arc-shaped surface 852 is located at the position closer to the second apparatus-side side wall member 604 than (i.e., on the −X-axis direction side of) the outer arc-shaped surface 854.

As shown in FIG. 20, the inner arc-shaped surface 852 forms an arc of radius R1*a* about the axis of rotation 800*c* on the cross section parallel to the X axis and the Z axis. The outer arc-shaped surface 854 forms an arc of radius R2*a* about the axis of rotation 800*c* on the cross section parallel to the X axis and the Z axis. The radius R1*a* is smaller than the radius R2*a*. As described above, each shaft body 850 has the concentric inner arc-shaped surface 852 and outer arc-shaped surface 854, which is located at the position closer to the second apparatus-side side wall member 604 than the outer arc-shaped surface 854, as part of the circumferential surface. The axis of rotation 800*c* can thus be located at the closer position to the cartridge 20 in the cartridge chamber 602 without interfering with the cartridge 20. This enables the cartridge 20 to be locked by the first apparatus-side restriction portion 810, while reducing a deviation from the first locking position 810L. When the axis of rotation 800*c* is located at the distant position from the cartridge 20, a shift of the lever 80 from the standard attitude in the state of the cartridge 20 properly attached at the designed attachment position causes a significant displacement of the first apparatus-side restriction portion 810 in the Z-axis direction. Locating the axis of rotation 800*c* at the closer position from the cartridge 20 advantageously reduces the displacement of the first apparatus-side restriction portion 810 in the Z-axis direction when the lever 80 is shifted from the standard attitude in the state of the cartridge 20 properly attached at the designed attachment position. Namely such positioning enables the cartridge 20 to be locked by the first apparatus-side restriction portion 810 with the less deviation from the first locking position 810L. Setting the greater radius R2*a* of the outer arc-shaped surface 854 than the radius R1*a* of the inner arc-shaped surface 852 advantageously prevents the strength degradation of the shaft body 850. The "preset locking position (first locking position) 810L" means the position where a first apparatus-side locking surface 811 (first part of the first apparatus-side restriction portion 810) abuts the first cartridge-side locking surface 211 (first abutting part of the first cartridge-side restriction portion 210) when the cartridge 20 is attached at the attachment position set as the ideal designed position.

The first apparatus-side restriction portion 810 serves to lock the cartridge 20 in the attached state and restrict the motion of the cartridge 20. As shown in FIG. 21, the first apparatus-side restriction portion 810 is provided on the −Z-axis direction end of the lever 80. The first apparatus-side restriction portion 810 is located on the −Z-axis direction side of the axis of rotation 800*c* in the attached state of the cartridge 20 to the holder 60.

As shown in FIG. 21, the first apparatus-side restriction portion 810 locks the first cartridge-side restriction portion 210 (FIG. 5) by two parts. The first apparatus-side restriction portion 810 includes the first apparatus-side locking surface 811 as the first part (the first apparatus-side restriction portion), a groove 815 and a second apparatus-side locking surface 813 as the second part (the second apparatus-side restriction portion). According to this embodiment, the two apparatus-side locking surfaces 811 and 813 of the first apparatus-side restriction portion 810 are located to intersect each other.

The first apparatus-side locking surface 811 is a curved surface in an arc shape around the axis of rotation 800*c*. The first apparatus-side locking surface 811 accordingly has the arc shape around the axis of rotation 800*c* on the cross section parallel to the X axis and the Z axis (i.e., cross section parallel to the XZ plane, cross section perpendicular to the Y axis). For attachment of the cartridge 20 to the holder 60, this structure enables the first apparatus-side locking surface 811 to be smoothly moved to the preset locking position 810L and lock the cartridge 20. For detachment of the cartridge 20 from the holder 60, this structure enables the first apparatus-side locking surface 811 to smoothly unlock the cartridge 20. This structure accordingly ensures the smooth operations for attachment and detachment of the cartridge 20 to and from the holder 60.

At the preset locking position (first locking position) 810L, the first apparatus-side locking surface 811 is close to the axis of rotation 800*c* in the X-axis direction. In other words, at the preset locking position (first locking position) 810L, the first apparatus-side locking surface 811 is located approximately beneath the axis of rotation 800*c* according to this embodiment. More specifically, at the preset locking position (first locking position) 810L, the first apparatus-side locking surface 811 is located on the slightly −X-axis direction side of the axis of rotation 800*c*. At the preset locking position 810L, the first apparatus-side locking surface 811 accordingly defines a plane intersecting at an approximately right angle the +Z-axis direction force which the cartridge 20 in the attached state receives from the apparatus-side terminals 700 and the elastic member 648. According to this embodiment, the plane in contact with the first apparatus-side locking surface 811 as the curved surface is a substantially horizontal plane at the preset locking position 810L. This reduces the possibility of releasing the engagement between the first cartridge-side locking surface 211 of the cartridge 20 in the attached state and the first apparatus-side locking surface 811. The first locking position 810L in the X-axis direction is thus preferably the position close to the axis of rotation 800*c* and on the −X-axis direction side of the axis of rotation 800*c*. This makes the plane in contact with the first apparatus-side locking surface 811 substantially horizontal and prevents application of the +X-axis direction force from the cartridge 20 in the attached state to the first apparatus-side locking surface 811. Locating the first locking position 810L close to the axis of rotation 800*c* in the X-axis direction advantageously reduces a deviation of the locking position in the Z-axis direction even when the actual locking position of the first cartridge-side locking surface 211 and the first apparatus-side locking surface 811 is slightly deviated from the first locking position 810L. In other words, this reduces the deviation of the cartridge 20 in the Z-axis direction relative to the holder 60 and ensures the good electrical connection of the cartridge-side terminals 400 with the apparatus-side terminals 700. For example, on the cross section of the lever 80 taken on the plane parallel to the X axis and the Z axis, the first locking position 810 should be located, such that an angle A between the straight line passing through the axis of rotation 800*c* and parallel to the Z-axis direction and the straight line connecting the axis of rotation 800*c* with the first locking position 810L is preferably not greater than 15 degrees, more preferably not greater than 10 degrees, and further preferably not greater than 5 degrees. The angle A is also preferably not less than 1 degree.

As shown in FIG. 19, the guide member 820 is provided between the operating member 830 and the first apparatus-side restriction portion 810 to be extended from the +Z-axis direction end to the −Z-axis direction end. The guide member 820 serves to guide the first cartridge-side restriction portion 210 (FIG. 12) to the first apparatus-side restriction portion 810, while restricting the motion of the cartridge 20 in the Y-axis direction in the course of attachment of the cartridge 20 to the holder 60. The cartridge 20 can thus be properly attached at the designed attachment position.

The guide member 820 is a recess formed by a guide bottom wall 821 provided along the Y-axis direction and a pair of guide walls 860 being vertically-angled toward the −X-axis direction from the guide bottom wall 821. The guide bottom wall 821 and the pair of guide walls 860 readily form the recess to receive the first cartridge-side restriction portion 210 structured as the projection. The pair of guide walls 860 include a first guide wall 860*a* provided on the +Y-axis direction side and a second guide wall 860*b* provided on the −Y-axis direction side. The shaft body 850*a* is located on the outer surface 893 of the first guide wall 860*a*, whilst the shaft body 850*b* is located on the outer surface 891 of the second guide wall 860*b*.

The space between the two guide walls 860*a* and 860*b*, i.e., the distance between the inner surfaces of the two guide walls 860*a* and 860*b*, is less than the Y-axis direction length of the cartridge 20 but is greater than the Y-axis direction length of the first cartridge-side restriction portion 210 (FIG. 12). For attachment of the cartridge 20 to the holder 60, the first cartridge-side restriction portion 210 is received by the guide member 820 and is readily and securely guided to the first apparatus-side restriction portion 810, while the pair of guide walls 860*a* and 860*b* restrict the motion of the cartridge 20 in the Y-axis direction and the guide bottom wall 821 restricts the motion of the cartridge 20 in the Z-axis direction.

One part of the guide bottom wall 821 on the side of the first apparatus-side restriction portion 810 has a groove 870 configured to receive the second portion 214 of the first cartridge-side restriction portion 210 (FIG. 12). The groove 870 is recessed from the surface of the guide bottom wall 821 in the +X-axis direction. The groove 870 is extended from the middle in the +Z-axis direction of the guide bottom wall 821 to its −Z-axis direction end.

The lever 80 set on the holder 60 is configured to move the first apparatus-side locking surface 811 to the first locking position 810L by its dead weight. The lever 80 is tilted to locate the first apparatus-side locking surface 811 on the −X-axis direction side of the axis of rotation 800*c* (FIG. 21), when the shaft bodies 850 are retained by the retainer 690. According to one embodiment, the lever 80 may be tilted by locating the center of gravity of the lever 80 on the −Z-axis direction side and on the −X-axis direction side of the axis of rotation 800*c*. According to another embodiment, the lever 80 may be tilted by locating the center of gravity of the lever 80 on the +Z-axis direction side and on the +X-axis direction side of the axis of rotation 800*c*.

A-4-4. Detailed Structure of Retainer 690

Figure 22:
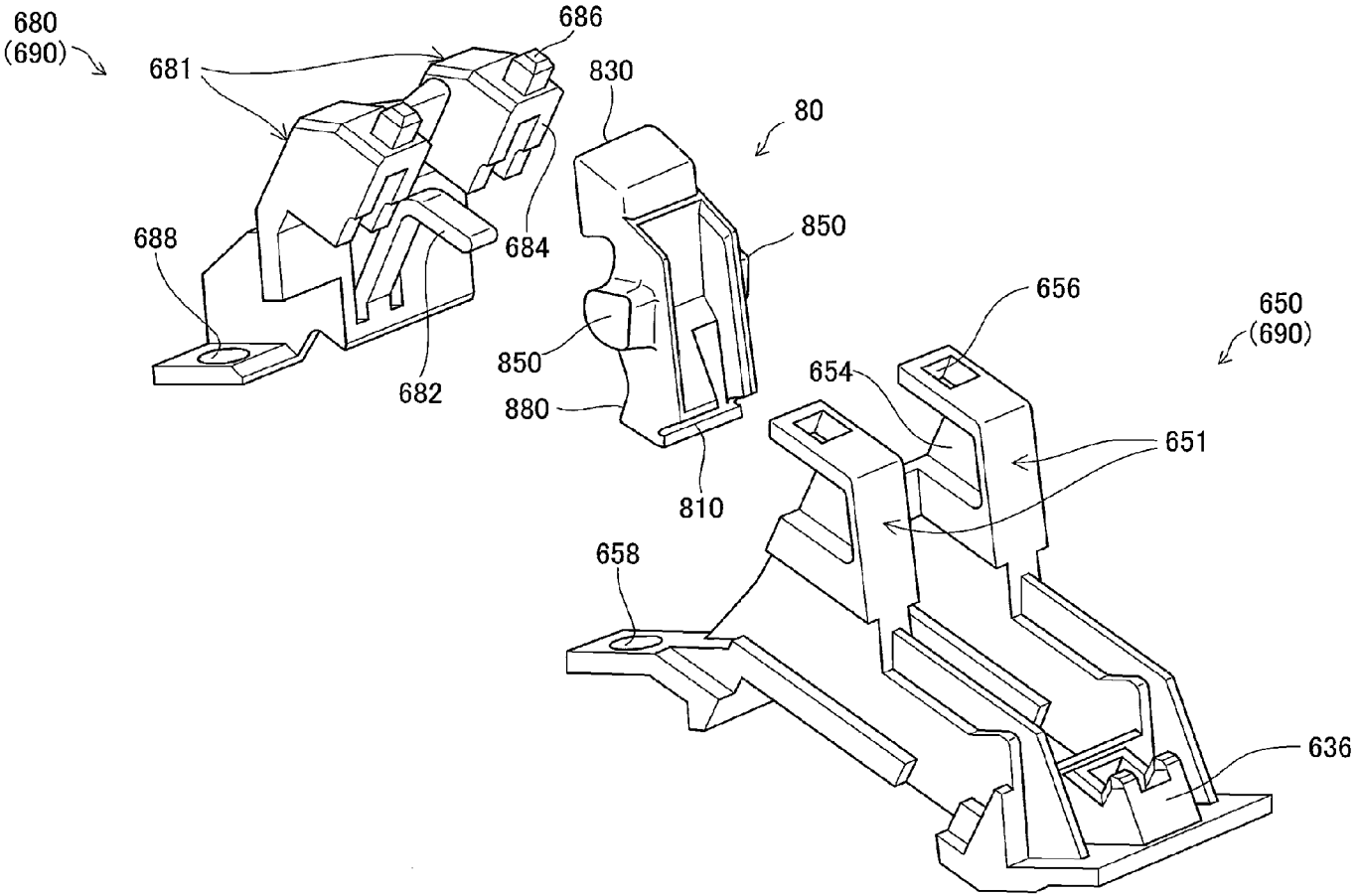
FIG. 22 is an exploded perspective view of a retainer and a perspective view of the lever.

FIG. 22 is an exploded perspective view of the retainer 690 and a perspective view of the lever 80. The lever 80 is retained by the retainer 690, so as to be attached to the holder 60 in a rotatable manner. FIG. 22 shows partial structure of the retainer 690 to retain the lever 80. The retainer 690 is structured by a combination of a first retainer member 650 and a second retainer member 680. The retainer 690 is made of a synthetic resin, more specifically ABS resin according to this embodiment.

The first retainer member 650 has a pair of standing portions 651 and a through hole 658. According to this embodiment, the first retainer member 650 also has the projection 636 serving as the third apparatus-side restriction portion.

The pair of standing portions 651 of the first retainer member 650 are arranged across a space for receiving the lever 80. Each of the standing portions 651 has a bearing element 654 to receive the shaft body 850 of the lever 80. According to this embodiment, each of the standing portions 651 also has an engagement hole 656 serving to engage the second retainer member 680.

The second retainer member 680 has a pair of standing portions 681 and a through hole 688. According to this embodiment, the second retainer member 680 also has an elastic member 682.

The pair of standing portions 681 of the second retainer member 680 are arranged across the same space as that between the pair of standing portions 651 of the first retainer member 650. Each of the standing portions 681 has a block surface 684 to block the bearing element 654, in order to prevent the shaft body 850 of the lever 80 from being unintentionally uncoupled from the bearing element 654. According to this embodiment, each of the standing portions 681 also has an engagement projection 686 to be fit in the engagement hole 656 of the first retainer member 650.

For attachment of the lever 80 to the holder 60, the lever 80 is located between the pair of standing portions 651 by setting the respective shaft bodies 850 of the lever 80 into the corresponding bearing elements 654 of the pair of standing portions 651 of the first retainer member 650. Subsequently the two retainer members 650 and 680 are assembled, so that the bearing elements 654 with the shaft bodies 850 of the lever 80 fit therein are blocked by the corresponding block surfaces 684 of the second retainer member 680. The first and second retainer members 650 and 680 are then fixed to the wall of the holder 60, for example, with screws set in the through holes 658 and 688. This attaches the lever 80 to the holder 60 in a rotatable manner.

Figure 23:
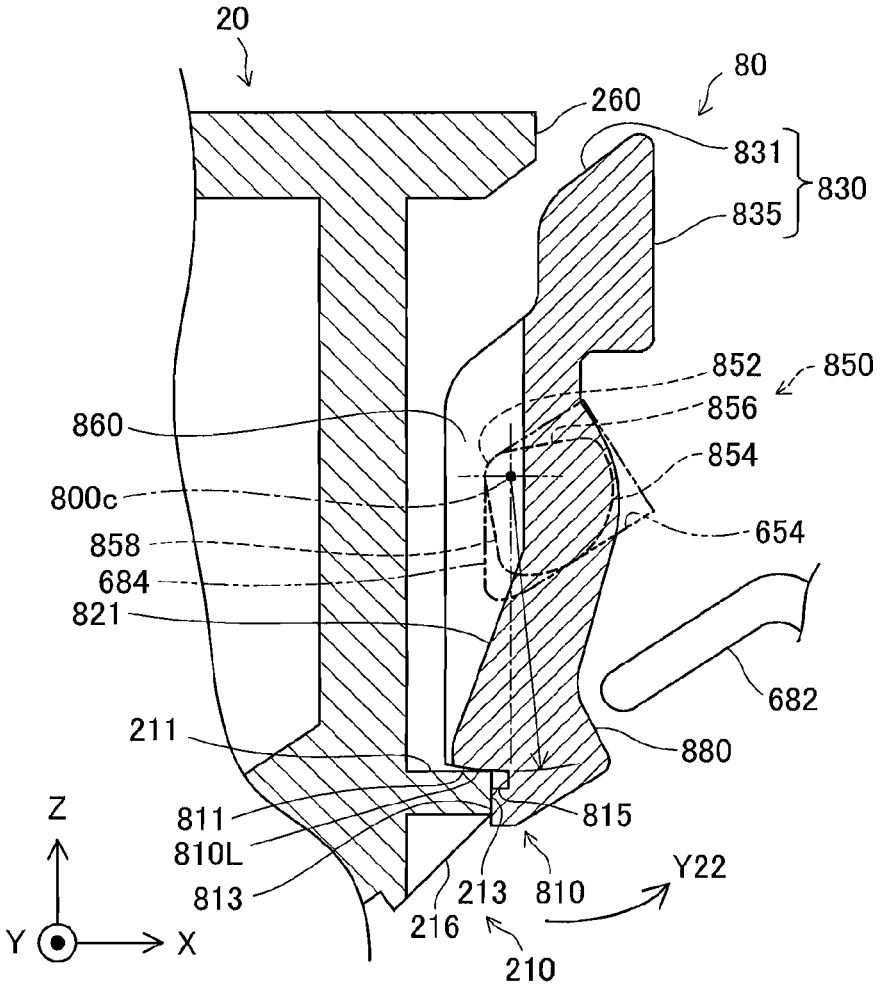
FIG. 23 is a sectional view showing the structure of the periphery of the lever in an attached state of the cartridge to the holder.

FIG. 23 is a sectional view showing the structure of the periphery of the lever 80 in the attached state of the cartridge 20 to the holder 60. The relationship between the shaft body 852 of the lever 80 and the bearing element 654 of the first retainer member 650 is described with reference to FIG. 23. FIG. 23 shows the cross section of the lever 80 locking the cartridge 20 taken on the plane passing through the first apparatus-side locking surface 811 and parallel to the X axis and the Z axis. The broken line in FIG. 23 shows the projected shape of the shaft body 850 of the lever 80, and the two-dot chain line shows the projected shape of the bearing element 654 and the block surface 684.

As clearly understood from FIG. 23, the axis of rotation 800*c* of the lever 80 is positioned through the contact of the inner arc-shaped surface 852 and the outer arc-shaped surface 854 of the shaft body 850 with the bearing element 654. Turning the lever 80 counterclockwise (seen from the +Y-axis direction) causes the radial side face 856 of the shaft body 850 to abut the bearing element 654. This restricts further counterclockwise rotation of the lever 80 (seen from the +Y-axis direction). Turning the lever 80 clockwise (seen from the +Y-axis direction) causes the radial side face 858 of the shaft body 850 to abut the block surface 684. This restricts further clockwise rotation of the lever 80 (seen from the +Y-axis direction). This ensures stable rotation of the lever 80 and keeps the cartridge 20 at the designed attachment position in the stable state.

During rotation of the lever 80, the elastic member 682 abuts an engagement rear face 880 of the lever 80 located on the −Z-axis direction side of the axis of rotation 800*c*. The elastic member 682 accordingly limits the rotatable range of the lever 80 during attachment and detachment of the cartridge 20 to and from the holder 60. In attachment of the cartridge 20 to the holder 60, the elastic member 682 abuts the engagement rear face 880 of the lever 80 and is elastically deformed, so as to press the engagement rear face 880 in the direction including the −X-axis direction component. This ensures the travel of the first apparatus-side restriction portion 810 of the lever 80 to the preset locking position (first locking position) 810L.

A-5. Attachment and Detachment of Cartridge 20 to and from Holder 60

FIGS. 24 to 27 show the procedure for attachment of the cartridge 20 to the holder 60 (attachment procedure). FIGS. 24 to 27 are sectional views corresponding to FIGS. 5 and 17 and are arranged in time series in this order.

Figure 24:
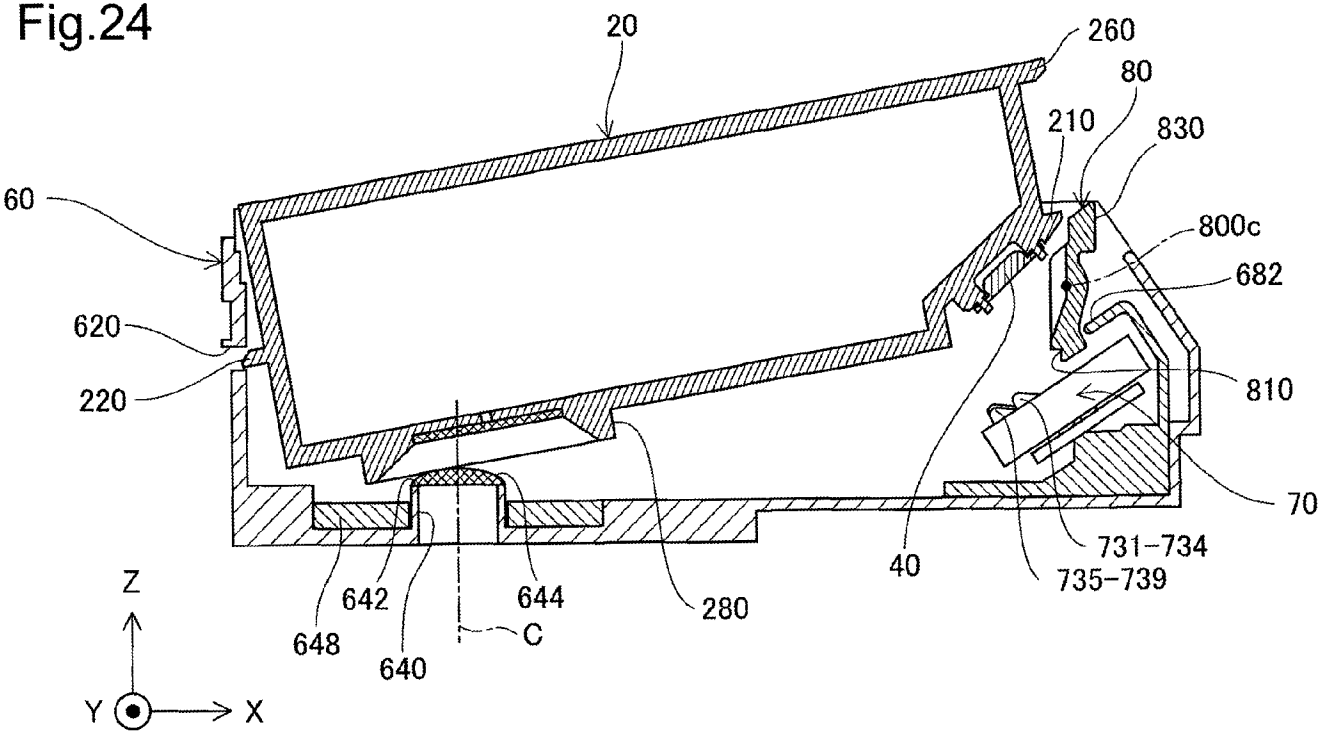
FIG. 24 shows the procedure for attachment of the cartridge to the holder.

For attachment of the cartridge 20 to the holder 60, the procedure first inserts the cartridge 20 through the top face of the holder 60 as shown in FIG. 24. The procedure then moves the cartridge 20 in the −Z axis direction to make the second cartridge-side restriction portion 220-side of the cartridge 20 enter first into the holder 60 and inserts the second cartridge-side restriction portion 220 into the second apparatus-side restriction portion 620. In the state of FIG. 24, the first cartridge-side restriction portion 210 of the cartridge 20 is located on the +Z-axis direction side of the first apparatus-side restriction portion 810 of the lever 80 in the holder 60.

Figure 25:
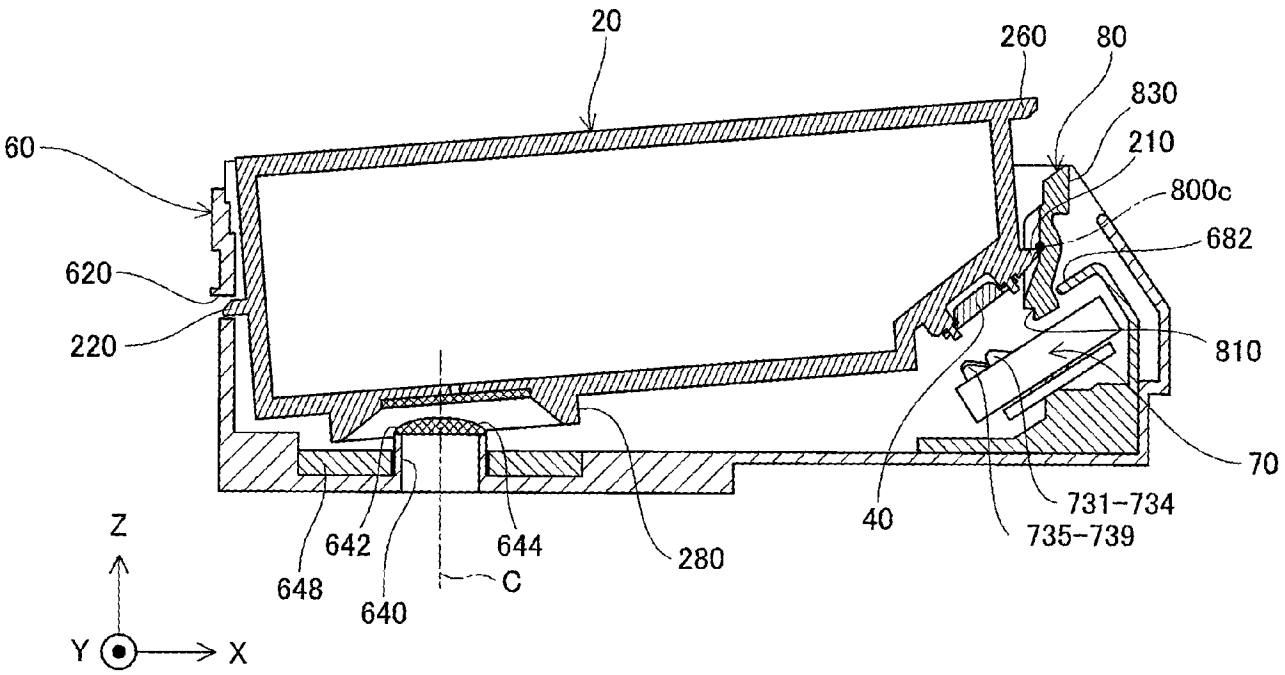
FIG. 25 shows the procedure for attachment of the cartridge to the holder.

The cartridge 20 is turned clockwise (seen from the +Y-axis direction) about the second cartridge-side restriction portion 220 inserted in the second apparatus-side restriction portion 620 as the pivot point of rotation from the state of FIG. 24, in order to press in the third face 203-side of the cartridge 20 toward the bottom wall member 601 of the holder 60. As shown in FIG. 25, the first cartridge-side restriction portion 210 then moves in the −Z-axis direction, while the motions of the cartridge 20 in the Y-axis direction and in the X-axis direction are restricted by the guide member 820 of the lever 80, i.e., the pair of guide walls 860*a* and 860*b* and the guide bottom wall 821 shown in FIG. 19.

Figure 26:
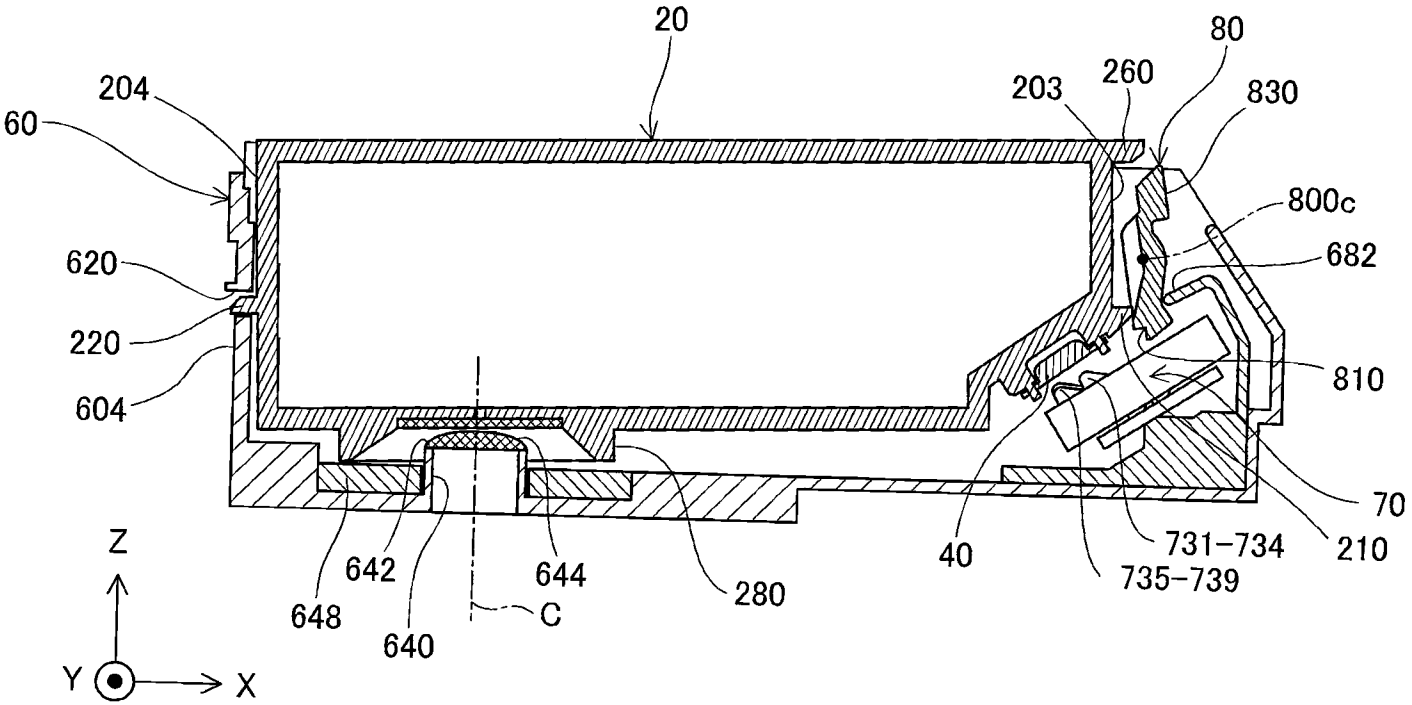
FIG. 26 shows the procedure for attachment of the cartridge to the holder.

When the cartridge 20 is further turned from the state of FIG. 25 to press in its third face 203-side, the first cartridge-side restriction portion 210 is further pressed in the −Z-axis direction. As shown in FIG. 26, the lever 80 is then pressed in the −X-axis direction by the first cartridge-side restriction portion 210 to turn counterclockwise (seen from the +Y-axis direction). The lever 80 abuts the elastic member 682 and receives the pressing force from the elastic member 682 in the direction to press back the lever 80 clockwise (seen from the +Y-axis direction). This pressing force is an external force including a −X-axis direction component. The rotatable range of the lever 80 is accordingly limited by the elastic member 682. This state of FIG. 26 where the lever 80 abuts the elastic member 682 and is pressed by the elastic member 682 maintains until the cartridge 20 is further pressed in and the first cartridge-side restriction portion 210 rides over the guide member 820 of the lever 80.

Figure 27:
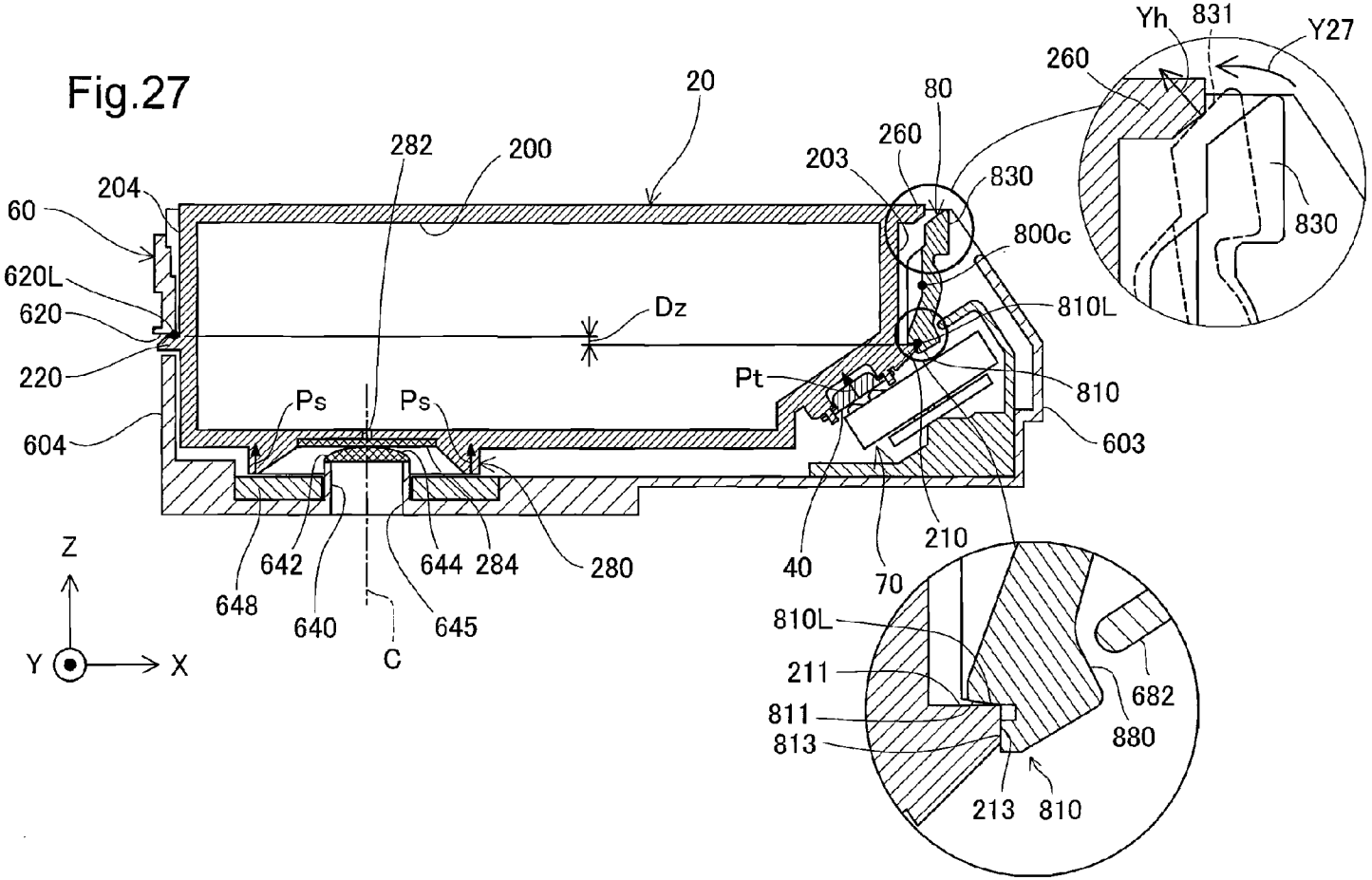
FIG. 27 shows the procedure for attachment of the cartridge to the holder.

When the cartridge 20 is further turned from the state of FIG. 26 to press in its third face 203-side, the first cartridge-side restriction portion 210 eventually rides over the guide member 820 of the lever 80. The lever 80 is then turned to move the first cartridge-side restriction portion 210 in the −X-axis direction as shown in FIG. 27. The first apparatus-side restriction portion 810 accordingly moves to the first locking position 810L and locks the first cartridge-side restriction portion 210 at the first locking position 810L. More specifically, as shown by the lower right close-up view, the first apparatus-side locking surface 811 (first part) of the first apparatus-side restriction portion 810 abuts the first cartridge-side locking surface 211 (first abutting part) of the first cartridge-side restriction portion 210, so as to restrict the motion of the cartridge 20 in the +Z-axis direction. The second apparatus-side locking surface 813 (second part) of the first apparatus-side restriction portion 810 also abuts the second cartridge-side locking surface 213 (second abutting part) of the first cartridge-side restriction portion 210, so as to restrict the motion of the cartridge 20 in the +X-axis direction. The printing material supply port 280 of the cartridge 20 is then connected with the printing material supply tube 640, while the second cartridge-side restriction portion 220 engages with the second apparatus-side restriction portion 620 and the first cartridge-side restriction portion 210 engages with the first apparatus-side restriction portion 810. This completes the attachment of the cartridge 20 to the holder 60. The proper attachment of the cartridge 20 at the designed attachment position makes electrical connection between the cartridge-side terminals 400 and the apparatus-side terminals 700, so as to allow signal transmission between the cartridge 20 and the printer 50.

According to this embodiment, as shown in FIGS. 23 and 27, the elastic member 682 is configured not to abut the lever 80 and thereby not to apply an external force to the lever 80 in the attached state of the cartridge 20 to the holder 60. This reduces the possibility of plastic deformation of the lever 80 by external force and the possibility of deviation of the first apparatus-side restriction portion 810 from the first locking position 810L. This accordingly ensures stable electrical connection between the cartridge-side terminals 400 and the apparatus-side terminals 700.

According to another embodiment, the elastic member 682 may be designed to abut the lever 80 and thereby apply a force to the lever 80 in the direction including the −X-axis direction component in the attached state of the cartridge 20 to the holder 60. In this application, the elastic member 682 continuously applies the force to the lever 80 in the direction including the −X-axis direction component, irrespective of the position of the lever 80. This rushes the first apparatus-side restriction portion 810 to the first locking position 810L for attachment of the cartridge 20 to the holder 60. This gives the hard click to inform the user of locking the cartridge 20 by the first apparatus-side restriction portion 810.

According to another embodiment, the elastic member 682 may be omitted. This application decreases the total number of parts.

The procedure of detachment of the cartridge 20 from the holder 60 is described. For detachment of the cartridge 20 from the holder 60, the user presses the operating member 830 in the −X-axis direction. In other words, the user applies the external force Pr (FIG. 5) to the operating member 830 in the direction including the −X-axis direction component. The lever 80 then moves the first apparatus-side restriction portion 810 around the axis of rotation 800*c* in the direction including the +X-axis direction component. Simultaneously the first cartridge-side locking surface 211 rotates and moves in the direction of arrow Y22 shown in FIG. 23. This disengages the first cartridge-side restriction portion 210 from the first apparatus-side restriction portion 810 and eliminates the restriction on the motion of the third face 203-side of the cartridge 20 in the +Z-axis direction. Eliminating the restriction on the motion of the cartridge 20 in the +Z-axis direction causes the third face 203-side of the cartridge 20 to move in the +Z-axis direction by the pressing force Pt from the contact mechanism 70. This shifts the state of FIG. 27 to the state of FIG. 26. The cartridge 20 is further turned counterclockwise (seen from the +Y-axis direction) about the second cartridge-side restriction portion 220 inserted in the second apparatus-side restriction portion 620 as the pivot point of rotation, in order to pull away the third face 203-side of the cartridge 20 from the bottom wall member 601 of the holder 60. This shifts the state of FIG. 26 to the state of FIG. 25 and further to the state of FIG. 24. The user may apply the external force to the projection 260 in the direction including the −X-axis direction component, in order to turn the cartridge 20. This operation turns the third face 203-side of the cartridge 20 counterclockwise (seen from the +Y-axis direction) and moves the third face 203-side of the cartridge 20 in the +Z-axis direction. The user holds the third face 203-side of the cartridge 20 and pulls away the second cartridge-side restriction portion 220 from the second apparatus-side restriction portion 620, so as to remove the cartridge 20 from the holder 60.

As shown in the close-up view of FIG. 27, the operating member 830 of the lever 80 includes the operating-member opposed surface 831. For removal of the cartridge 20 in the attached state from the holder 60, when the user presses the operating member 830, the operating-member opposed surface 831 is in contact with the projection 260. The operating-member opposed surface 831 is inclined in a direction including a −X-axis direction component and a +Z-axis direction component. Turning the lever 80 about the axis of rotation 800*c* in the direction of arrow Y27 causes the operating-member opposed surface 831 to be in contact with the projection 260 and presses the projection 260 in a direction Yh including the −X-axis direction component and the +Z-axis direction component. This facilitates detachment of the cartridge 20 from the holder 60. Even when the cartridge 20 is stuck by some part of the holder 60 and is not moved in the +Z-axis direction through the travel of the first cartridge-side locking surface 211 from the first locking position 810L in the +X-axis direction, the third face 203-side of the cartridge 20 can be moved in the +Z-axis direction by using the operating-member opposed surface 831 and the projection 260.

A-6. Attachment Detection Method Using Attachment Detection Terminals

Figure 28:
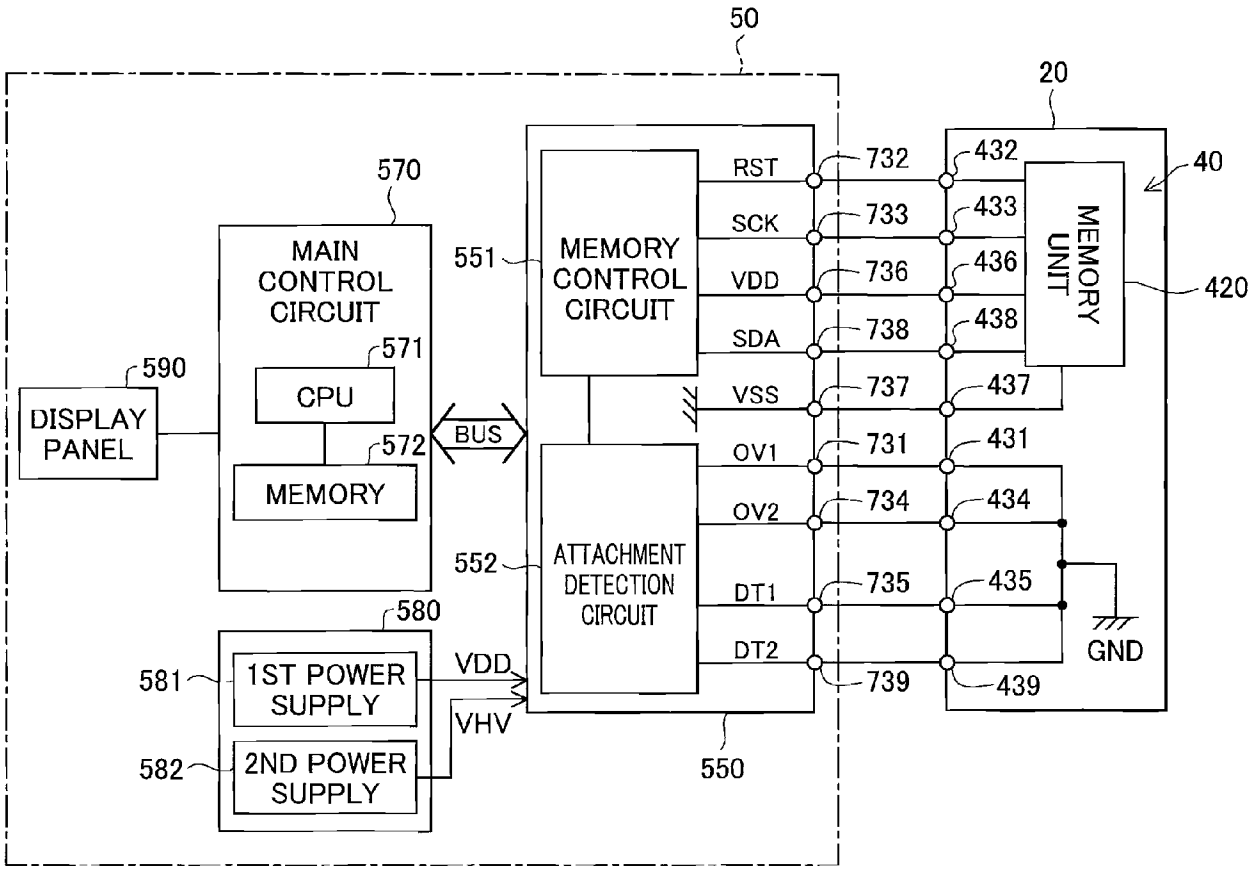
FIG. 28 is a block diagram illustrating the electrical structure.

FIG. 28 is a block diagram illustrating the electrical structure of the circuit board 40 of the cartridge 20 and the printer 50 according to the first embodiment. The printer 50 includes a display panel 590, a power circuit 580, a main control circuit 570 and a sub-control circuit 550. The display panel 590 serves as a display unit to notify the user of various information, for example, the operating condition of the printer 50 and the attachment state of the cartridge 20. The display panel 590 may be provided on an operation unit (not shown) visible from outside of the printer 50. The power circuit 580 includes a first power supply 581 to generate a first power-supply voltage VDD and a second power supply 582 to generate a second power-supply voltage VHV. The first power-supply voltage VDD is the ordinary power-supply voltage (e.g., rated voltage of 3.3 V) used for logic circuits. The second power-supply voltage VHV is the high voltage (e.g., rated voltage of 42 V) used to drive the head 540 (FIG. 2) for ink ejection. These voltages VDD and VHV are supplied to the sub-control circuit 550, while being supplied to the other circuits as needed basis. The main control circuit 570 includes a CPU 571 and a memory 572. The sub-control circuit 550 includes a memory control circuit 551 and an attachment detection circuit 552. The circuit structure including the main control circuit 570 and the sub-control circuit 550 is called "control circuit".

Among the nine terminals provided on the circuit board 40 of the cartridge 20 (FIG. 10), the reset terminal 432, the clock terminal 433, the power terminal 436, the ground terminal 437 and the data terminal 438 are electrically connected with the memory unit 420. The memory unit 420 is a nonvolatile memory without an address terminal In the memory unit 420, a memory cell to be accessed is determined, based on the pulse number of clock signal SCK input from the clock terminal 433 and command data input from the data terminal 438. The memory unit 420 receives data from the data terminal 438 or sends data to the data terminal 438, in synchronism with the clock signal SCK. The clock terminal 433 is used to supply the clock signal SCK from the sub-control circuit 350 to the memory unit 420. The printer 50 applies the power-supply voltage (for example, rated voltage of 3.3 V) for driving the memory unit 420 and the ground voltage (0 V) respectively to the power terminal 436 and to the ground terminal 437. The power-supply voltage for driving the memory unit 420 may be the first power-supply voltage VDD directly applied by the printer 50 or may be generated from the first power-supply voltage VDD to be lower than the first power-supply voltage VDD. The data terminal 438 is used for transmission of data signal SDA between the sub-control circuit 550 and the memory unit 420. The reset terminal 432 is used to supply reset signal RST from the sub-control circuit 550 to the memory unit 420. The four attachment detection terminals 431, 434, 435 and 439 are interconnected by wiring in the circuit board 40 of the cartridge 20 (FIG. 3) and are all grounded. For example, the attachment detection terminals 431, 434, 435 and 439 are connected with the ground terminal 437 to be grounded. According to another embodiment, the attachment detection terminals 431, 434, 435 and 439 may be grounded by any connection path without the ground terminal 437. As clearly understood from this description, the attachment detection terminals 431, 434, 435 and 439 may be connected with part of the memory terminals (or memory unit 420), but is preferably not connected with any memory terminals other than the ground terminal 437 or the memory unit 420. Non-connection of the attachment detection terminals with the memory terminal or the memory unit results in application of no signal or voltage other than an attachment check signal to the attachment detection terminals and thus ensures the accurate attachment detection. The four attachment detection terminals 431, 434, 435 and 439 are interconnected by wiring in the illustrated example of FIG. 28, but part of the connection path may be replaced by a resistance.

In FIG. 28, path names SCK, VDD, SDA, RST, OV1, OV2, DT1 and DT2 are assigned to the respective connection paths connecting the apparatus-side terminals 731 to 739 with the cartridge-side terminals 431 to 439 of the circuit board 40. The signal names are used for the path names with respect to the connection paths to the memory unit 420.

Figure 29:
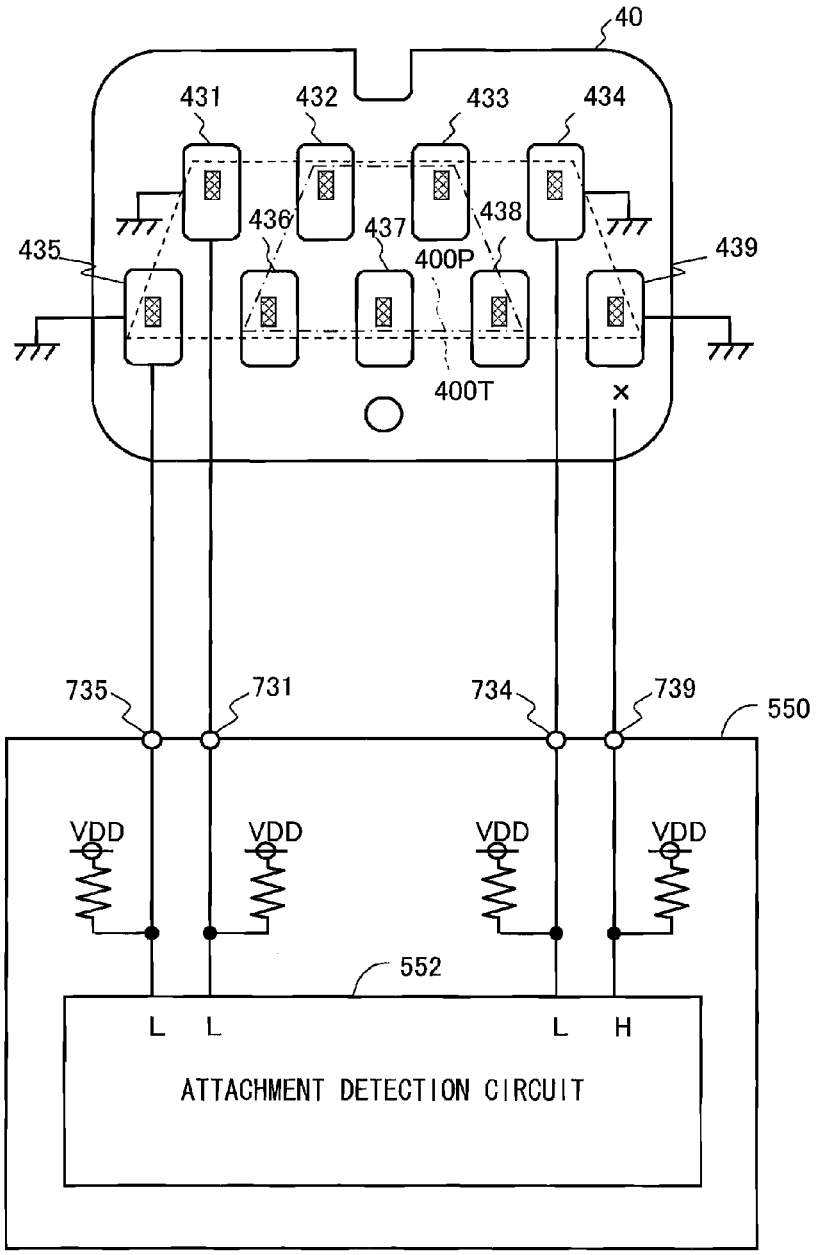
FIG. 29 illustrates the connection between the circuit board and an attachment detection circuit.

FIG. 29 illustrates the connection between the circuit board 40 and the attachment detection circuit 552. The four attachment detection terminals 431, 434, 435 and 439 of the circuit board 40 are connected with the attachment detection circuit 552 via the corresponding apparatus-side terminals 731, 734, 735 and 739. The four attachment detection terminals 431, 434, 435 and 439 of the circuit board 40 are grounded. The connection paths between the apparatus-side terminals 731, 734, 735 and 739 and the attachment detection circuit 552 are respectively connected to the power-supply voltage VDD (rated voltage of 3.3 V) in the sub-control circuit 550 via pull-up resistance.

In the illustrated example of FIG. 29, the three terminals 431, 434 and 435 of the four attachment detection terminals 431, 434, 435 and 439 on the circuit board 40 have good connection with the corresponding apparatus-side terminals 731, 734 and 735. The attachment detection terminal 439, however, has poor connection with the corresponding apparatus-side terminal 739. The voltage level of the connection paths for the three apparatus-side terminals 731, 734 and 735 in the good connection state is L level (ground voltage level), whilst the voltage level of the connection path for the apparatus-side terminal 739 in the poor connection state is H level (power-supply voltage VDD level). The attachment detection circuit 552 may check the voltage levels of these connection paths, so as to identify the good/poor connection state with respect to each of the four attachment detection terminals 731, 734, 735 and 739.

The contact portions "cp" of the four attachment detection terminals 431, 434, 435 and 439 on the circuit board 40 are located outside a first area 400P, which includes the contact portions "cp" of the memory terminals 432, 433, 436, 437 and 438. The contact portions "cp" of the four attachment detection terminals 431, 434, 435 and 439 are located at four corners of a quadrilateral second area 400T, which includes the first area 400P. The first area 400P is preferably a smallest possible quadrilateral including the contact portions "cp" of the five memory terminals 432, 433, 436, 437 and 438. The second area 400T is preferably a smallest possible quadrilateral including all the contact portions "cp" of the cartridge-side terminals 431 to 439.

In the state of good contact for all the four attachment detection terminals 431, 434, 435 and 439, the cartridge 20 has no significant tilt and ensures the good contact for the memory terminals 432, 433, 436, 437 and 438. In the state of poor contact for any one or more of the four attachment detection terminals 431, 434, 435 and 439, on the other hand, the cartridge 20 has a significant tilt and may cause the poor contact for any one or more of the memory terminals 432, 433, 436, 437 and 438. According to a preferable embodiment, in the state of poor contact for any one or more of the four attachment detection terminals 431, 434, 435 and 439, the attachment detection circuit 552 displays information (character string or image) indicating the failed attachment on the display panel 390 to notify the user of the failed attachment.

The contact portions "cp" of the attachment detection terminals 431, 434, 435 and 439 are arranged at the four corners surrounding the first area 400P including the contact portions "cp" of the memory terminals 432, 433, 436, 437 and 438, because of the following reason. In the attached state of the cartridge 20 to the holder 60, there is a certain margin for tilting the cartridge 20, so that the circuit board 40 of the cartridge 20 may be inclined relative to the contact mechanism 70 of the holder 60. For example, tilting the cartridge 20 to make the terminals 431 to 434 (more specifically their contact portions) in the upper line R2 (FIG. 10A) on the circuit board 40 more distant from the contact mechanism 70 than the terminals 435 to 439 (more specifically their contact portions) in the lower line R1 (FIG. 10A) may result in the poor contact for any of the terminals 431 to 434 in the upper line R2. Tilting the cartridge 20 to make the terminals 435 to 439 (more specifically their contact portions) in the lower line R1 on the circuit board 40 more distant from the contact mechanism 70 than the terminals 431 to 434 (more specifically their contact portions) in the upper line R2 may result in the poor contact for any the terminals 435 to 439 in the lower line R1. Tilting the cartridge 20 to make the left edge of the circuit board 40 (FIG. 10A) more distant from the contact mechanism 70 than the right edge may result in the poor contact for any of the terminals 431, 432, 435, 436 and 437 on the left side of the circuit board 40. Tilting the cartridge 20 to make the right edge of the circuit board 40 more distant from the contact mechanism 70 than the left edge may result in the poor contact for any of the terminals 433, 434, 437, 438 and 439 on the right side of the circuit board 40. The poor contact may cause an error in reading data from the memory unit 420 or in writing data into the memory unit 420. Checking the contact portions "cp" of all the four attachment detection terminals 431, 434, 435 and 439, which are arranged at the four corners outside the first area 400P including the contact portions "cp" of the memory terminals 432, 433, 436, 437 and 438, for the good/poor contact advantageously prevents the poor contact and a resulting access error in the memory unit 420 due to such tilting of the cartridge 20.

A-7. Advantageous Effects of Embodiment

A-7-1. Comparison with PTL 1 to PTL 3

The advantageous effects of this embodiment compared with the structures disclosed in PTL1 to PTL 3 mentioned previously.

In the printing material supply system 10 according to this embodiment, the lever 80 is provided on the holder 60, and the first cartridge-side restriction portion 210 is provided on the cartridge 20. The cartridge-side restriction portion 210 is located on the −Z-axis direction side of the axis of rotation 800*c* of the lever 80. This structure of the embodiment does not require any engagement member for engaging with the holder at the position between the axis of rotation and the operating member of the lever, unlike the structures of PTL1 and PTL2 including the lever provided on the cartridge. There is accordingly no need to make a relatively large distance between the lever and the cartridge side face. The structure of the embodiment accordingly shortens the distance between the lever 80 and the third face 203 of the cartridge 20, i.e., the dimension in the X-axis direction, while shortening the length of the lever, i.e., the dimension in the Z-axis direction. This allows significant size reduction of the printer 50 and the whole printing material supply system 10, as well as size reduction of packaging for transportation and distribution of the cartridges 20, which advantageously reduces the transportation cost and the parts cost. This advantageous effect is not achieved by simply providing the lever on the printer holder instead of the cartridge as described in PTL3. This advantageous effect is achieved by providing the axis of rotation 800*c* of the lever 80 between the operating member 830 and the first apparatus-side restriction portion 810 and locating the cartridge-side restriction portion 210 on the −Z-axis direction side of the axis of rotation 800*c* of the lever 80.

The printing material supply system 10 according to the embodiment includes the relatively short lever 80 and the first cartridge-side restriction portion 210 of the small size and the simple structure (e.g., projection). This increases the rigidity of the lever 80 and the first cartridge-side restriction portion 210, compared with the structures described in PTL1 and PTL2, and allows the relatively high-rigidity material to be selected for the lever 80 and the first cartridge-side restriction portion 210 (cartridge 20). This results in significantly reducing the possibility of plastic deformation of the lever 80 and the first cartridge-side restriction portion 210. In the attached state, the cartridge 20 can be kept at the proper position in the holder 60, which maintains the normal or good contact between the cartridge-side terminals 431 to 439 and the apparatus-side terminals 731 to 739 and reduces the poor continuity. Since the first cartridge-side restriction portion 210 of this embodiment has the small size and the simple structure, no special care to prevent plastic deformation of the lever is required in packaging for transportation and distribution of the cartridges 20, especially in vacuum packaging, unlike the cartridges of PTL1 and PTL2. This improves the user's convenience. Providing the projection as the first cartridge-side restriction portion 210 as described in the embodiment is especially preferable for this advantageous effect.

In the printing material supply system 10 according to the embodiment, the cartridge-side restriction portion 210 is located on the −Z-axis direction side of the axis of rotation 800*c* of the lever 80. As described previously, the apparatus-side terminals 731 to 739 generate the pressing force Pt in the direction of pressing back the circuit board 40 (i.e., in the direction including the +Z-axis direction component and the −X-axis direction component) in the attached state of the cartridge 20. This pressing force Pt is expected to move the cartridge 20 in the +Z-axis direction in the attached state. In the printing material supply system 10 of the embodiment, however, the axis of rotation 800*c* of the lever 80 is located on the −Z-axis direction side of the first cartridge-side restriction portion 210, so that the lever 80 restricts the motion of the cartridge 20 from the +Z-axis direction side to the −Z-axis direction side.

According to this embodiment, the first cartridge-side restriction portion 210 is located on the −Z-axis direction side and on the −X-axis direction side of the axis of rotation 800*c* of the lever 80. When the cartridge 20 moves in the +Z-axis direction, rotational moment arises on the lever 80 as shown by arrow M in FIG. 5. This moment acts to cause the first cartridge-side restriction portion 210 to be strongly pressed in the −X-axis direction by the first apparatus-side restriction portion 810. This moment also acts to move the first apparatus-side restriction portion 810 of the lever 80 in accordance with moving the cartridge 20 in the −X-axis direction by the X-axis direction component of the pressing force Pt. The cartridge 20 in the attached state accordingly receives the force to be pressed against the apparatus-side bottom wall member 601 and the second devise-side side wall member 604. This structure of the embodiment prevents the cartridge 20 from being unintentionally uncoupled from the holder 60, thus maintaining the normal or good contact between the cartridge-side terminals 431 to 439 and the apparatus-side terminals 731 to 739 and reducing the poor continuity.

As shown in FIG. 27, the first cartridge-side restriction portion 210 includes the first cartridge-side locking surface 211 that abuts the first part 811 of the first apparatus-side restriction portion 810 to restrict the motion of the cartridge 20 in the +Z-axis direction, and the second cartridge-side locking surface 213 that abuts the second part 812 of the first apparatus-side restriction portion 810 to restrict the motion of the cartridge 20 in the +X-axis direction. This ensures production of the rotational moment as shown by the arrow M in FIG. 5 and more effectively reduces the poor continuity between the cartridge-side terminals 431 to 439 and the apparatus-side terminals 731 to 739.

As shown in FIG. 12, according to this embodiment, the first cartridge-side restriction portion 210 has the second portion 214. The first cartridge-side restriction portion 210 reduces the possibility that the first cartridge-side restriction portion 210 is locked at the position on the −Z-axis direction side of the first apparatus-side restriction portion 810 in attachment of the cartridge 20 to the holder 60. In the course of attachment of the cartridge 20 to the holder 60, the user may press the cartridge 20 deeper in the −Z-axis direction into the holder 60 than the state of FIG. 27. Even in this case, the second portion 214 of the first cartridge-side restriction portion 210 abuts the second apparatus-side locking surface 813 of the lever 80, so as to prevent the first cartridge-side restriction portion 210 from being located on the −Z-axis direction side of the first apparatus-side restriction portion 810. This reduces the possibility that the first cartridge-side restriction portion 210 is locked by the first apparatus-side restriction portion 810 at the unintended locking position.

A-7-2. Reduction of Effects of External Force in Attached State of Cartridge

Figure 30:
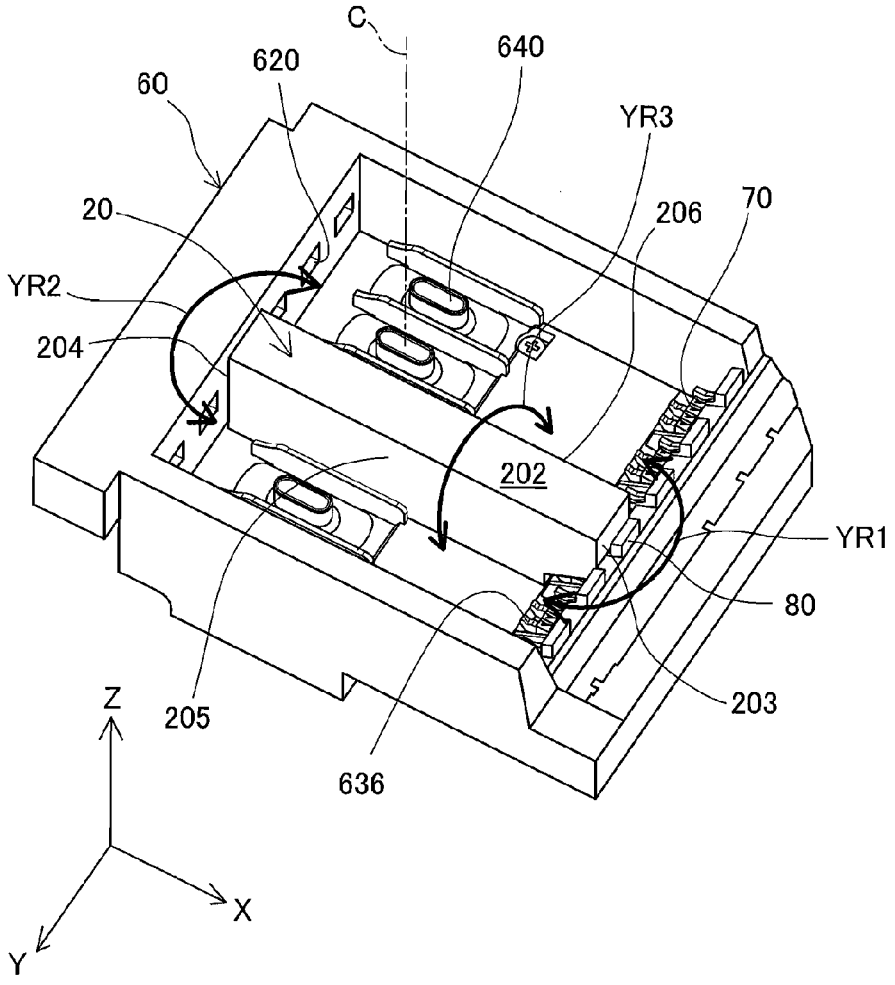
FIG. 30 shows the external force applied to the cartridge in the attached state.

FIG. 30 shows the external force applied to the cartridge 20 in the attached state. During printing operation of the printer 50, the holder 60 and the cartridge 20 move in the main scanning direction (Y-axis direction or width direction of the cartridge 20). The cartridge 20 accordingly receives the external force (inertial force) in the width direction. The cartridge 20 receiving the external force may turn about the printing material supply port 280 (FIG. 27) and the printing material supply tube 640 in the rotating direction including the width direction component (Y-axis direction component). More specifically, the third face 203-side of the cartridge 20 may turn in the direction of arrow YR1, while the fourth face 204-side of the cartridge 20 may turn in the direction of arrow YR2. The second face 202-side of the cartridge 20 may also turn in the direction of arrow YR3. The direction of arrow YR1 and the direction of arrow YR2 are the rotating direction about the Z axis, which includes the Y-axis direction component (width direction component). The direction of arrow YR3 is the rotating direction about the X axis, which includes the Y-axis direction component (width direction component).

Moving the cartridge 20 in the direction of arrow YR3 causes either the fifth face 205 or the sixth face 206 of the cartridge 20 to be pulled up in the +Z-axis direction. As described previously, however, such motion of the cartridge 20 in the +Z-axis direction is restricted by the lever 80. According to this embodiment, the first cartridge-side restriction portion 210 is close to the intersecting part 295 as shown in FIG. 13. In other words, the first cartridge-side restriction portion 210 is close to the board end 405 of the circuit board 40. The first cartridge-side restriction portion 210 is arranged as close as possible to the cartridge-side terminals 400. Since the first cartridge-side restriction portion 210 is locked by the lever 80, the periphery of the first cartridge-side restriction portion 210 has substantially no position shift by the external force. Providing the cartridge-side terminals 400 at the location of extremely small position shift effectively prevents the positional misalignment of the respective terminals 431 to 439 of the cartridge-side terminals 400 relative to the holder 60, thus maintaining the stable electrical connection between the cartridge-side terminals 400 and the apparatus-side terminals 700. In order to ensure this advantageous effect, it is preferable to locate at least part of the first cartridge-side restriction portion 210 (specifically the first cartridge-side locking surface 211) between the first outer part 435P and the second outer part 439P (FIG. 10A) in the Y-axis direction (width direction) (when the cartridge 20 is viewed from the third face 203-side in the −X-axis direction).

As shown in FIG. 7, according to this embodiment, the corner section 265 of the cartridge 20 has the step (seventh face) 207 extended in the +Z-axis direction from the first face 201. The seventh face 207 is located on the −X-axis direction side and on the −Z-axis direction side of the sloped surface (eighth face) 208. The seventh face 207 has the third cartridge-side restriction portion 250. As shown in FIG. 2 and FIGS. 14 to 16, the holder 60 has the third apparatus-side restriction portion (projection) 636. The third cartridge-side restriction portion 250 is in contact with the projection 636. This further restricts the motion of the third face 203-side of the cartridge 20 in the width direction about the printing material supply tube 640 and the printing material supply port 280. The third cartridge-restriction portion 250 is structured preferably as the pair of projection members protruded from the seventh face 207 in the +X-axis direction to receive the projection 636 therebetween as described in the embodiment. This simple structure effectively restricts the motion of the third face 203-side of the cartridge 20 in the width direction about the printing material supply tube 640 and the printing material supply port 280.

As shown in FIG. 13, according to this embodiment, the surface 408 of the circuit board 40 and the third cartridge-side restriction portion 250 are arranged to partly overlap each other in the X-axis direction (when the cartridge 20 is viewed from the first face 201-side in the +Z-axis direction). This further effectively restricts the motion of the cartridge 20 in the direction of arrow YR1 and thereby prevents the motion (deviation) of the cartridge-side terminals 400 relative to the holder 60.

In the above description, the external force in the width direction applied to the cartridge 20 is the inertial force produced by the movement of the cartridge 20 in the main scanning direction. The external force applied to the cartridge 20 is, however, not restricted to such inertial force. For example, in the off-carriage type printer, only the print head moves in the main scanning direction, while the cartridge 20 attached to the stationary holder does not move in the main scanning direction. In the off-carriage type printer, however, the cartridge 20 may receive an external force. More specifically, an external force (inertial force) may be applied to the cartridge 20 due to, for example, vibration arising from the movement of the print head in the main scanning direction.

A-7.-3. Reduction of Tilting of Cartridge 20 in Attached State

As shown in FIG. 12, according to this embodiment, the first cartridge-side restriction portion 210 is provided to intersect the plane Yc passing through the center of the width (Y-axis direction length) of the cartridge 20. As shown in FIG. 5, the cartridge 20 in the attached state receives the pressing forces Ps and Pt including the +Z-axis direction component from the holder 60. These pressing forces Ps and Pt press the first cartridge-side restriction portion 210 against the first apparatus-side restriction portion 810 of the lever 80. Even when the cartridge 20 in the attached state is shaky about the X axis or the Z axis by the external force, the first cartridge-side restriction portion 210 hardly moves in the vicinity of the position intersecting the plane Yc.

The first cartridge-side restriction portion 210 is located close to the intersecting part 295, i.e., close to the board end 405. Providing the first cartridge-side restriction portion 210 of little motion at the position very close to the cartridge-side terminals 400 ensures the stable electrical connection between the cartridge-side terminals 400 and the contact mechanism 70.

The effective part of the first cartridge-side restriction portion 210 specifically serving to restrict the position of the cartridge-side terminals 400 is the first cartridge-side locking surface 211. It is thus preferable to locate the first cartridge-side locking surface 211 as close as possible to the cartridge-side terminals 400. Omitting the third portion 215 of the first cartridge-side restriction portion 210 and locating the first portion 212 in contact with the first side 290 enable the first cartridge-side locking surface 211 to be closer to the intersecting part 295 or the board end 405. This further ensures the stable electrical connection between the cartridge-side terminals 400 and the contact mechanism 70.

According to this embodiment, as shown in FIG. 10, among the contact portions "cp" of the respective cartridge-side terminals 400, the ground terminal 437 having the contact portion "cp" on the center in the Y-axis direction is provided at the position intersecting the plane Yc. The contact portions "cp" of the other terminals 431 to 436, 438 and 439 are arranged to be symmetrical with respect to the line of intersection of the plane Yc and the ground terminal 437 as the axis. The plane Yc has especially little motion, since the position of the first cartridge-side restriction portion 210 is fixed. The cartridge-side terminals 400 are provided on the plane Yc of little motion or its neighborhood. In addition to providing the first cartridge-side restriction portion 210 at the position very close to the cartridge-side terminals 400, locating the cartridge-side terminals 400 on the plane Yc or its neighborhood further ensures the stable electrical connection between the cartridge-side terminals 400 and the contact mechanism 70.

A-7-4. Fine Adjustment of Tilted Cartridge 20 in Attached State

According to this embodiment, the first cartridge-side restriction portion 210 (more specifically, the first cartridge-side locking surface 211) is located not outside but inside the range 40Y in the Y-axis direction between the first outer part 435P located on the most +Y-axis direction side of the cartridge-side terminals 400 and the second outer part 439P located on the most −Y-axis direction side of the cartridge-side terminals 400. After the cartridge 20 is attached to the holder 60, the cartridge-side terminals 400 receive the force of +Z-axis direction component from the apparatus-side terminals 700, so as to finely adjust the tilt of the cartridge 20 or more specifically the direction of the sloped surface 408, on which the cartridge-side terminals 400 are provided. The manufacturing error may vary the positions of the respective apparatus-side terminals 731 to 739 from the apparatus-side sloped surface 708 or the horizontality of the first cartridge-side locking surface 211 of the first cartridge-side restriction portion 210. Even in such cases, the fine adjustment of the direction of the sloped surface 408 ensures the stable electrical connection between the cartridge-side terminals 400 and the apparatus-side terminals 700.

Figure 31:
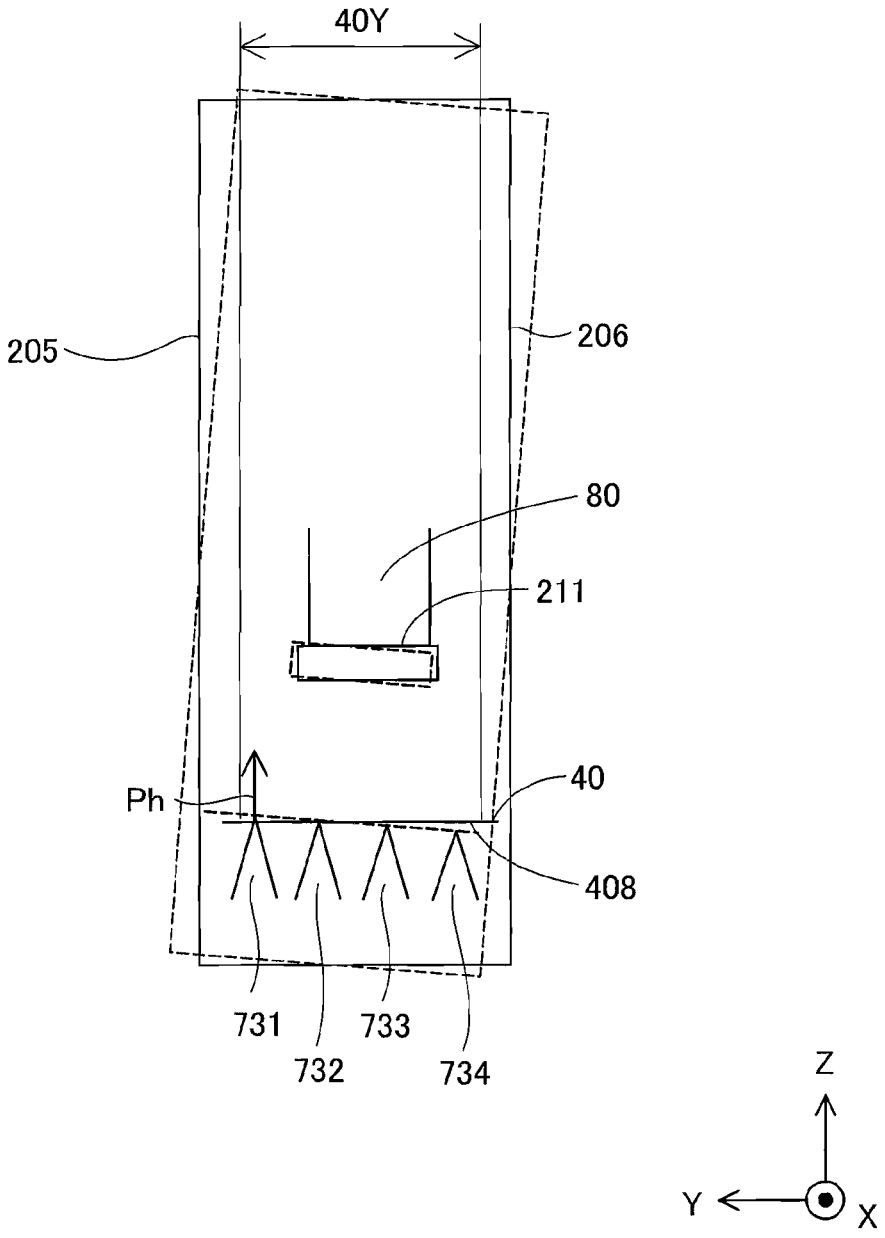
FIG. 31 shows fine adjustment of the direction of a sloped surface.

FIG. 31 shows fine adjustment of the direction of the sloped surface 408. The position of the cartridge 20 after fine adjustment of the attitude of the cartridge 20 is shown by the broken line. For example, it is assumed that the attachment detection terminal 731 of the apparatus-side terminals 700 protruded from the apparatus-side sloped surface 708 (FIG. 18) is deviated in the +Z-axis direction from the designed position. In this case, the sloped surface 408 receives force Ph in a direction including the +Z-axis direction component from the attachment detection terminal 731. Locating the first cartridge-side locking surface 211 within the range 40Y allows more rotation of the cartridge 20 about the X axis. In other words, application of the force Ph to the sloped surface 408 enables fine adjustment of the attitude of the cartridge 20. In the illustrated example of FIG. 31, the attitude of the cartridge 20 is finely adjusted to be tilted toward the sixth face 206-side.

A-7-5. Advantageous Effects of Second Cartridge-Side Restriction Element 220

The cartridge 20 has the second cartridge-side restriction portion 220 on the fourth face 204 (FIG. 27), which serves to restrict the motion of the cartridge 20 from its +X-axis direction sides in the +Z-axis direction. This further ensures the stable electrical connection between the cartridge-side terminals 400 and the apparatus-side terminals 700.

According to this embodiment, the second cartridge-side restriction portion 220 is the projection protruded from the fourth face 204 in the −X-axis direction. The second cartridge-side restriction portion 220 is inserted into the second apparatus-side restriction portion 620 (FIG. 3) in the form of the through hole of the holder 60. The user turns the cartridge 20 about the vicinity of the second cartridge-side restriction portion 220 inserted in the second apparatus-side restriction portion 620 (FIG. 3) for attachment and detachment of the cartridge 20 to and from the holder 60. The second apparatus-side restriction portion 620 accordingly serves as the guide for attachment and detachment of the cartridge 20 to and from the holder 60. This structure facilitates attachment and detachment of the cartridge 20 to and from the holder 60. The second cartridge-side restriction portion 220 in the form of the projection can be readily provided on the fourth face 204 of the cartridge 20.

A-7-6. Advantageous Effects of Projection 260

As shown in FIG. 27, according to this embodiment, the cartridge 20 has the projection 260 on the +Z-axis direction side of the first cartridge-side restriction portion 210 on the third face 203. For detachment of the cartridge 20 from the holder 60, applying the force to the operating member 830 of the lever 80 from the +X-axis direction side to the −X-axis direction side causes the operating member 830 to be in contact with the projection 260 and press the projection 260 in the direction Yh including the +Z-axis direction component. The projection 260 accordingly receives the force of +Z-axis direction component. This facilitates detachment of the cartridge 20 from the holder 60 by using the operating member 830. Even when the cartridge 20 is stuck by some part of the holder 60 and is not moved in the +Z-axis direction through the travel of the first cartridge-side locking surface 211 from the first locking position 810L in the +X-axis direction, the third face 203-side of the cartridge 20 can be moved in the +Z-axis direction by using the projection 260.

Although the external force is directly applied from the operating member 830 to the projection 260 according to the embodiment, the external force may not be applied from the operating member 830 to the projection 260. Turning the operating member 830 disengages the first apparatus-side restriction portion 810 from the first cartridge-side restriction portion 210 and eliminates the restriction on the motion of the third face 203-side of the cartridge 20 in the +Z-axis direction. Eliminating the restriction on the motion of the cartridge 20 in the +Z-axis direction causes the third face 203-side of the cartridge 20 to move in the +Z-axis direction by the pressing force Pt from the contact mechanism 70. The projection 260 of the cartridge 20 simultaneously moves in the direction Yh. The user holds the periphery of the projection 260 moving in the direction Yh and readily detaches the cartridge 20 from the holder 60. Providing the projection 260 improves the operability for detachment of the cartridge 20 from the holder 60 even without direct application of the external force from the operating member 830 to the projection 260.

A-7-7. Advantageous Effects of Position of Printing Material Supply Port 280

As shown in FIG. 27, according to this embodiment, the printing material supply port 280 is provided at the position closer to the fourth face 204 than the third face 203 on the first face 201. The distance between the outer surface of the printing material supply port 280 and the third face 203 in the X-axis direction is accordingly greater than the distance between the outer surface of the printing material supply port 280 and the fourth face 204. The cartridge-side terminals 400 are provided on the sloped surface 408 adjacent to the third face 203. In other words, the printing material supply port 280 is provided at the position away from the cartridge-side terminals 400. This reduces the possibility that ink adheres to the cartridge-side terminals 400 and prevents the poor contact between the cartridge-side terminals 400 and the apparatus-side terminals 700.

A-7-8. Advantageous Effects of Ground Terminal 437

According to this embodiment, as shown in FIG. 10A, among the contact portions "cp" of the cartridge-side terminals 400, the ground terminal 437 having the contact portion "cp" on the center in the Y-axis direction is provided at the position intersecting the plane Yc passing through the center of the width (Y-axis direction length) of the cartridge 20. The ground terminal 437 is configured to be in contact with the contact mechanism 70 prior to the other cartridge-side terminals 431 to 436, 438 and 439 in the course of attachment of the cartridge 20 to the holder 60. The pressing force first applied from the holder 60 to the circuit board 40 is thus generated on the substantial center of the width or the Y-axis direction length of the cartridge 20. This prevents the pressing force applied to the circuit board 40 from acting to tilt the cartridge 20 in the Y-axis direction and thereby enables the attachment of the cartridge 20 at the designed attachment position. Such contact of the ground terminal 437 with the contact mechanism 70 of the holder 60 prior to the other cartridge-side terminals 431 to 436, 438 and 439 advantageously prevents or reduces the high voltage-induced troubles and failures by the grounding function of the ground terminal 437, even when an unexpected high voltage is applied to the cartridge 20.

A-7-9. Advantageous Effects of Shape of First Device-Side Locking Surface 811

As shown in FIG. 21, the first apparatus-side locking surface 811 is the curved surface in the arc shape about the axis of rotation 800*c* on the cross section parallel to the X axis and the Z axis. This ensures the smooth operations for attachment and detachment of the cartridge 20 to and from the holder 60. Forming the first apparatus-side locking surface 811 as the curved surface decreases the press-back amount in the +Z-axis direction by the elastic member 648 (FIG. 27) in the course of attachment of the cartridge 20 to the holder 60. This ensures the good electrical contact between the cartridge-side terminals 400 and the apparatus-side terminals 700.

Figure 32A:
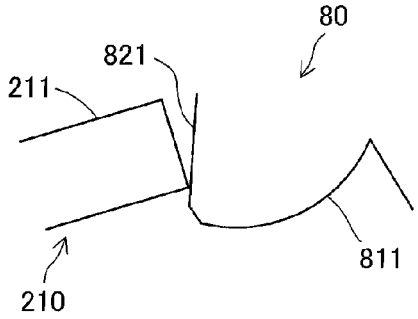
FIGS. 32A to 32F show one example of advantageous effect.
Figure 32D:
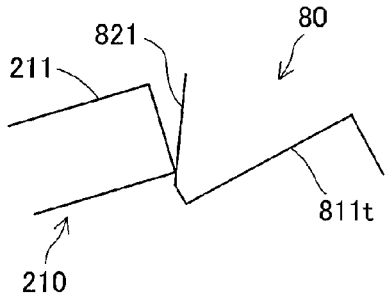
Figure 32B:
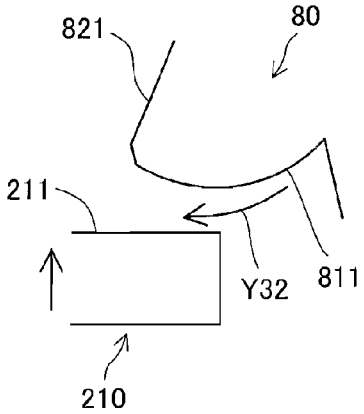
Figure 32E:
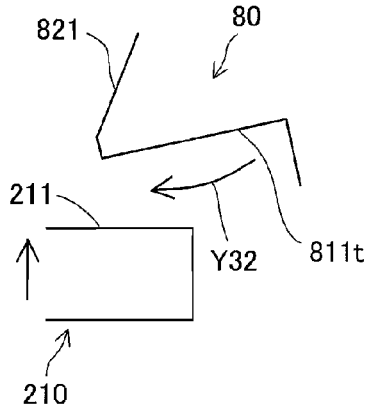
Figure 32C:
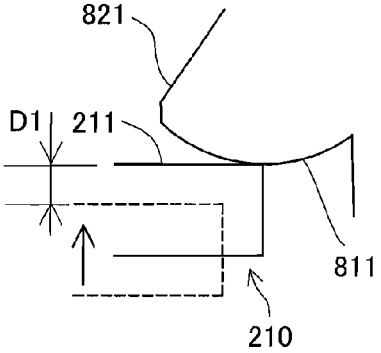
Figure 32F:
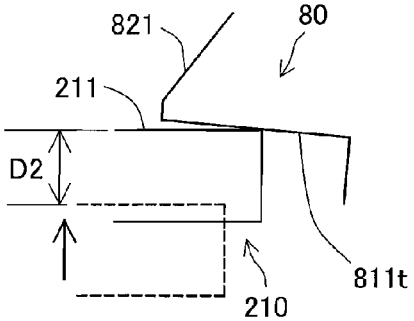

One example of such advantageous effect is described with reference to FIGS. 32A to 32F. The vertical direction of FIGS. 32A to 32F corresponds to the Z-axis direction; the upward direction of the drawings corresponds to the +Z-axis direction and the downward direction corresponds to the −Z-axis direction. FIGS. 32A to 32C show attachment of a cartridge using the first apparatus-side locking surface 811 formed as the curved surface and are arranged in time series in this order. FIGS. 32D to 32F show attachment of a cartridge using a first apparatus-side locking surface 811*t* formed as a plane and are arranged in times series in this order.

As shown in FIG. 32A, for attachment of the cartridge 20 to the holder 60, the first cartridge-side restriction portion 210 moves in the −Z-axis direction while abutting the guide bottom wall 821. As shown in FIG. 32B, when the first cartridge-side restriction portion 210 moves through the guide bottom wall 821 further in the −Z axis direction, the first apparatus-side locking surface 811 moves in the direction of arrow Y32.

When the user strongly presses the cartridge 20 in the −Z-axis direction, the first cartridge-side restriction portion 210 is located on the −Z-axis direction side of the first apparatus-side locking surface 811. When the user loses hold of the cartridge 20, the cartridge 20 is pressed upward in the +Z-axis direction by the pressing forces Ps and Pt of the elastic member 648 and the apparatus-side terminals 700. As shown in FIG. 32C, the pressed-up amount of the first cartridge-side restriction portion 210 of the cartridge 20 is D1 when the first apparatus-side locking surface 811 is formed as the curved surface.

As shown in FIGS. 32D to 32F, when the first apparatus-side locking surface 811*t* is formed as the plane, the pressed-up amount of the first cartridge-side restriction portion 210 is D2, which is greater than D1.

In the attached state of the cartridge 20, the first apparatus-side locking surface 811 formed as the curved surface can be located on the more −Z-axis direction side than the first apparatus-side locking surface 811*t* formed as the plane. This reduces the pressed-up amount of the first cartridge-side restriction portion 210.

According to this embodiment, the first apparatus-side locking surface 811 located at the preset or first locking position 810L is close to the axis of rotation 800*c* in the X-axis direction (FIG. 21). This reduces the moving distance of the first apparatus-side locking surface 811 in the Z-axis direction even when the actual locking position is deviated in the X-axis direction from the first locking position 810L. This accordingly prevents deviation of the cartridge 20 in the Z-axis direction relative to the holder 60.

A-7-10. Other Advantageous Effects

According to this embodiment, in the attached state, the axis of rotation 800*c* of the lever 80 is located on the +Z-axis direction side and on the +X-axis direction side of the first locking position 810L (FIG. 27). The first apparatus-side locking surface 811 of the lever 80 moves in the −X-axis direction to be unlocked or disengaged from the cartridge 20 (FIG. 27). In other words, the unlocking or disengaging direction (i.e., the direction including the +X-axis direction component) is opposite to the direction of moving the first apparatus-side restriction portion 810 (i.e., the direction including the −X-axis direction component) by the force applied from the cartridge 20 to the lever 80 with respect to the X-axis direction component. This reduces the possibility that the first cartridge-side restriction portion 210 is disengaged from the first apparatus-side locking surface 811 in the attached state and thereby ensures stable electrical connection between the cartridge-side terminals 400 and the apparatus-side terminals 700.

The first apparatus-side restriction portion 810 also has the second apparatus-side locking surface 813 to restrict motion of the cartridge 20 in the +X-axis direction (FIG. 27). This structure prevents the first apparatus-side restriction portion 810 from being moved in a specific direction including the −X-axis direction component by the pressing force Pt from the cartridge 20 in the attached state. This more effectively reduces the possibility that the first cartridge-side restriction portion 210 is disengaged from the first apparatus-side locking surface 811.

According to this embodiment, the second apparatus-side side wall member 604 of the printer 50 has the second apparatus-side restriction portion 620 that engages with the second cartridge-side restriction portion 220 to restrict motion of the cartridge 20 in the +Z-axis direction. This structure restricts motion of the cartridge 20 in the +Z-axis direction from both sides of the X-axis direction. This more effectively prevents the positional misalignment of the respective cartridge-side terminals 400 to the cartridge mounting structure 60 and thereby further ensures the stable electrical connection between the cartridge-side terminals 400 and the apparatus-side terminals 700. The second apparatus-side restriction portion 620 is provided in the form of a recess or a through hole. This facilitates formation of the second apparatus-side restriction portion 620 to receive the second cartridge-side restriction portion 220 provided in the form of a projection.

According to this embodiment, the operating-member opposed surface 831 is inclined in the specific direction including the −X-axis direction component and the +Z-axis direction component in the attached state. More specifically, the operating-member opposed surface 831 is inclined in the specific direction including the −X-axis direction component and the +Z-axis direction component in the state that the operating-member opposed surface 831 is in contact with the projection 260. This facilitates the operating member 830 to apply an external force in the +Z-axis direction to the projection 260.

B. Second Embodiment

Figure 33:
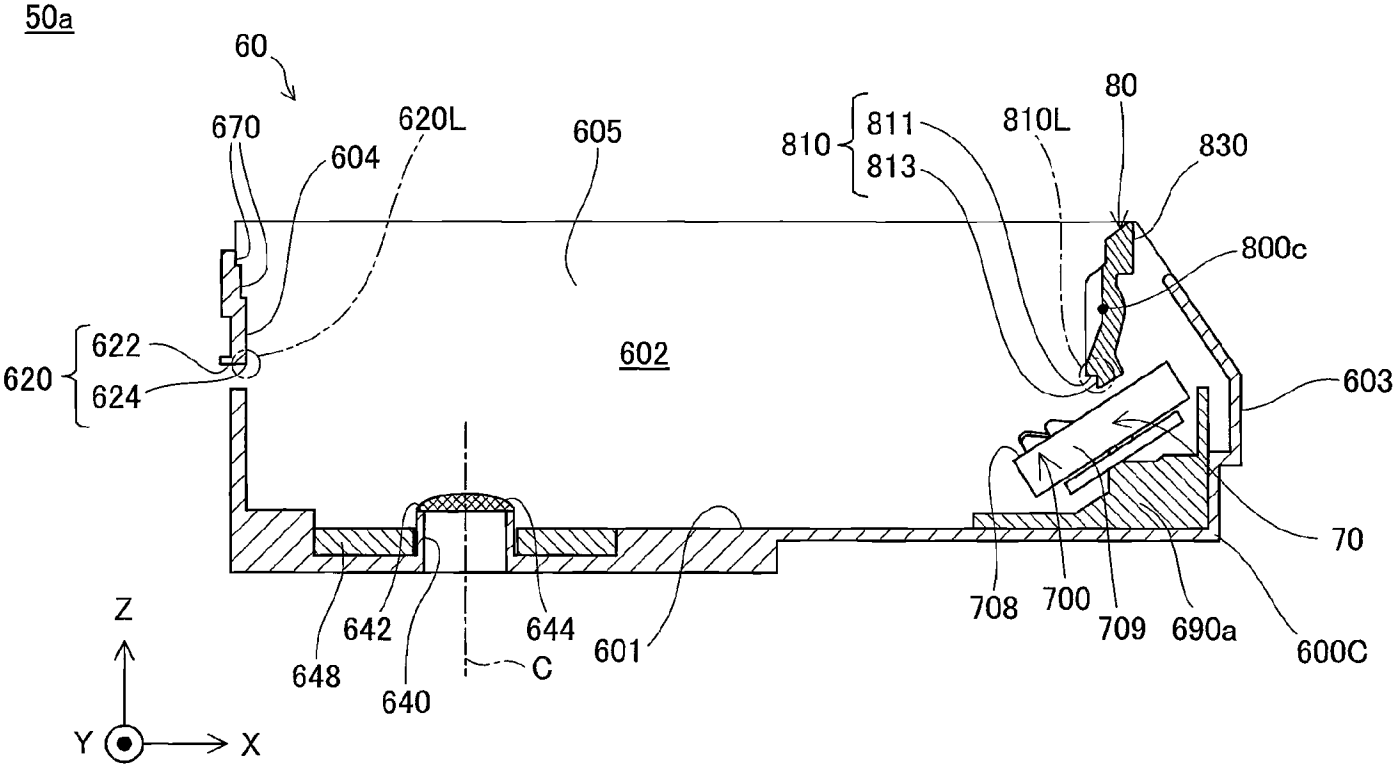
FIG. 33 illustrates a printer according to a second embodiment.

FIG. 33 illustrates a printer 50*a* according to a second embodiment. FIG. 33 shows the cross section corresponding to the cross section of FIG. 17 according to the first embodiment. The difference from the printer 50 of the first embodiment is that a retainer 690*a* does not have the elastic member 682. Otherwise the printer 50*a* of the second embodiment has the same structure as that of the printer 50 of the first embodiment. The like elements are expressed by the like symbols and are not specifically explained here. The cartridge 20 attached to the printer 50*a* has the same structure as the cartridge 20 attached to the printer 50 of the first embodiment.

As shown in FIG. 33, the retainer 690*a* does not have an elastic member to press the lever 80 in the direction including the −X-axis direction component. The lever 80 is, however, designed to locate its first apparatus-side locking surface 811 at the first locking position 810L by its dead weight, so that the first cartridge-side locking surface 211 of the cartridge 20 is locked by the first apparatus-side locking surface 811 of the lever 80.

The printer 50*a* of the second embodiment has the similar advantageous effects to those of the printer 60 of the first embodiment. Additionally, the structure of the retainer 690 without an elastic member reduces the possible damage or breakage of the retainer 690 and decreases the total number of parts to reduce the manufacturing cost of the printer 50*a*.

C. Third Embodiment

Figure 34:
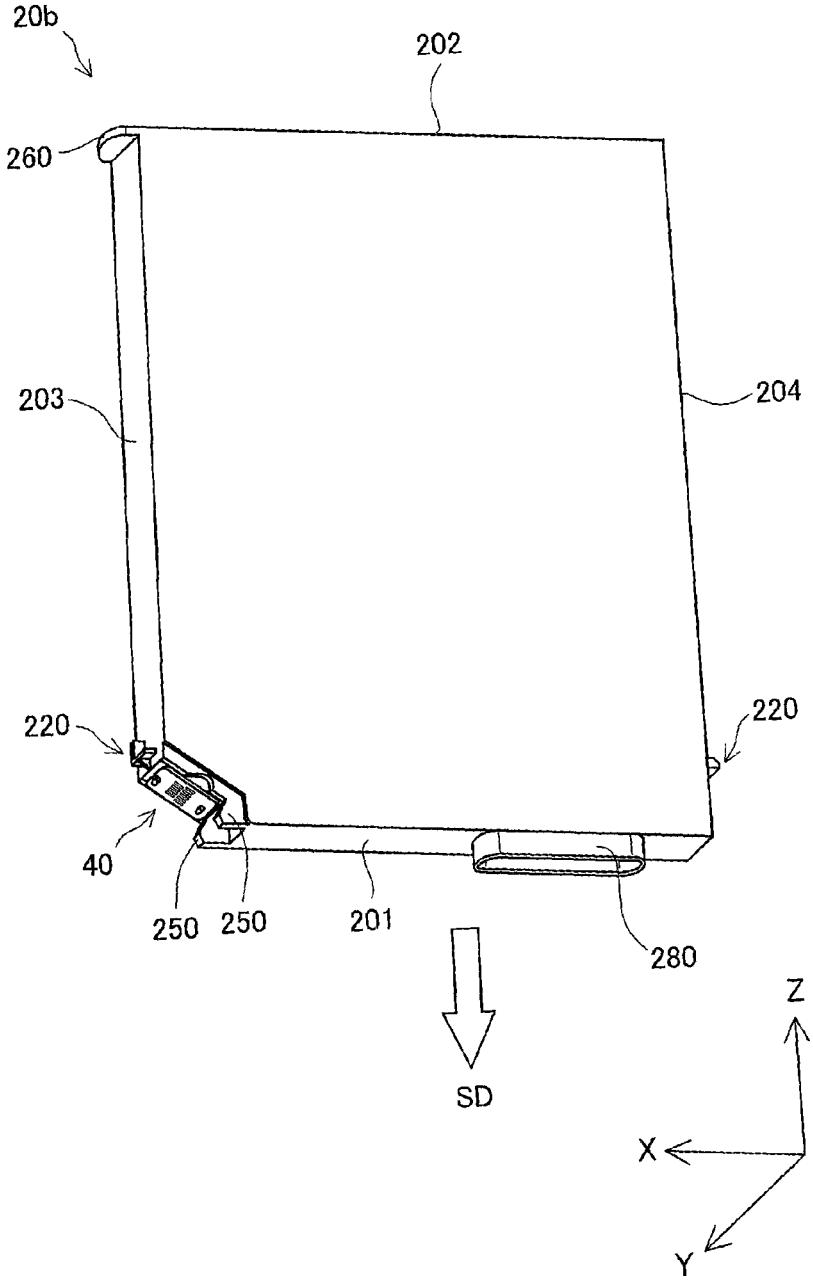
FIG. 34 is a perspective view illustrating the appearance of a cartridge according to a third embodiment.

FIG. 34 is a perspective view illustrating the appearance of a cartridge 20*b* according to a third embodiment. The difference from the cartridge 20 of the first embodiment (FIG. 7) is the size of the cartridge 20*b*. Otherwise the cartridge 20*b* of the third embodiment has the same structure as that of the cartridge 20 of the first embodiment. The like elements are expressed by the like symbols and are not specifically explained here. A printer of the third embodiment is adopted for the cartridge 20*b* but has the same structure as that of the holder 60 and the respective members (for example, lever 80) provided on the holder 60 of the first embodiment.

The cartridge 20*b* has the greater dimensions than those of the cartridge 20 of the first embodiment and is capable of containing a greater amount of ink. The cartridge 20*b* is attachable to a cartridge mounting structure of a large inkjet printer that is capable of printing large paper (e.g., sizes A2 to A0). The cartridge 20*b* is attached to the cartridge mounting structure of the large inkjet printer in the −Z-axis direction as the attachment direction SD. According to this embodiment, the −Z-axis direction is the horizontal direction. In the attached state of the cartridge 20*b* to the cartridge mounting structure, the X-axis direction is the vertical direction. More specifically, the +X-axis direction is the vertically upward direction, and the −X-axis direction is the vertically downward direction.

D. Modifications of Cartridge Structure

Figure 35A:
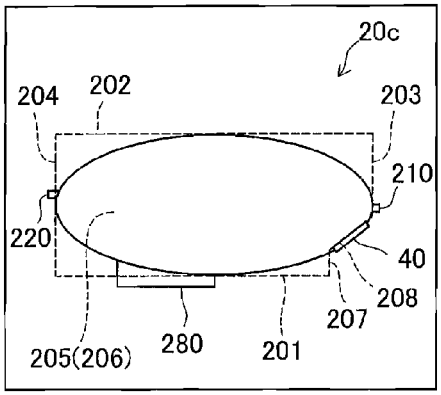
FIGS. 35A to 35F are conceptual diagrams showing cartridge outer shapes according to other embodiments.
Figure 35B:
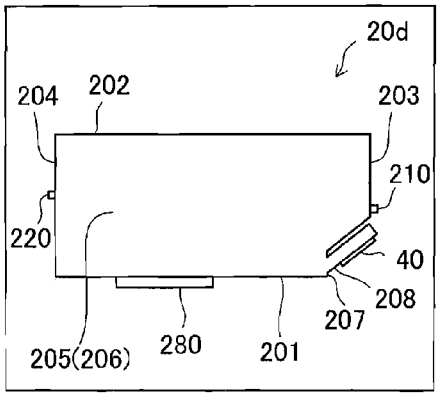
Figure 35C:
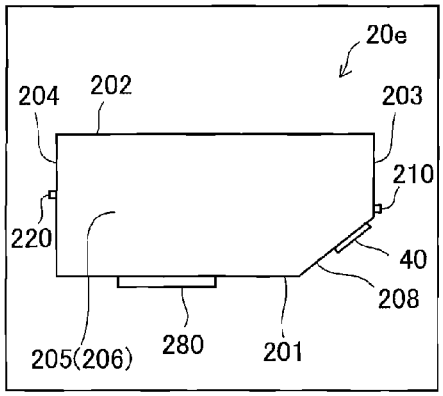
Figure 35D:
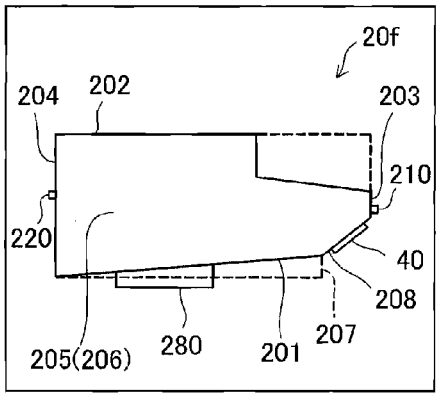
Figure 35E:
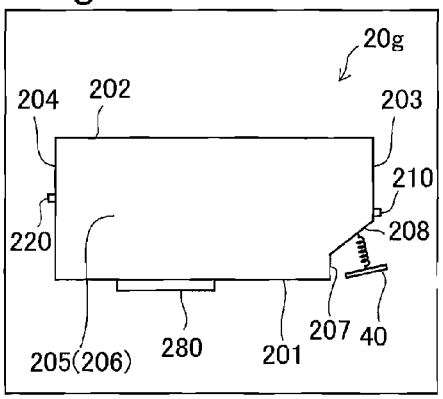
Figure 35F:
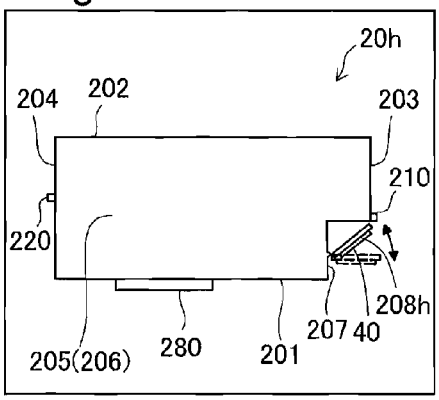
Figure 36:
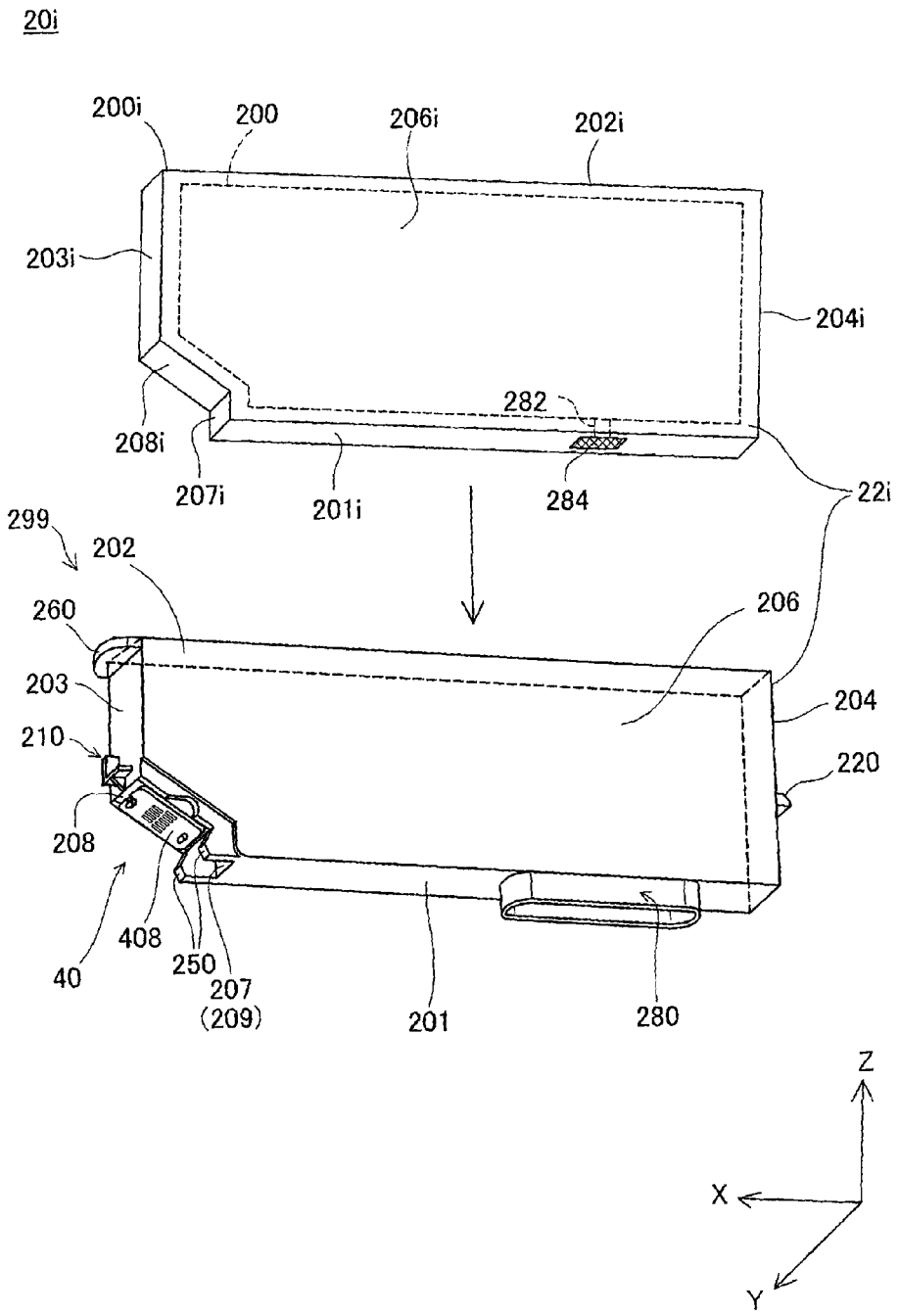
FIG. 36 is a perspective view illustrating the structure of a cartridge with an adapter according to one embodiment.
Figure 37:
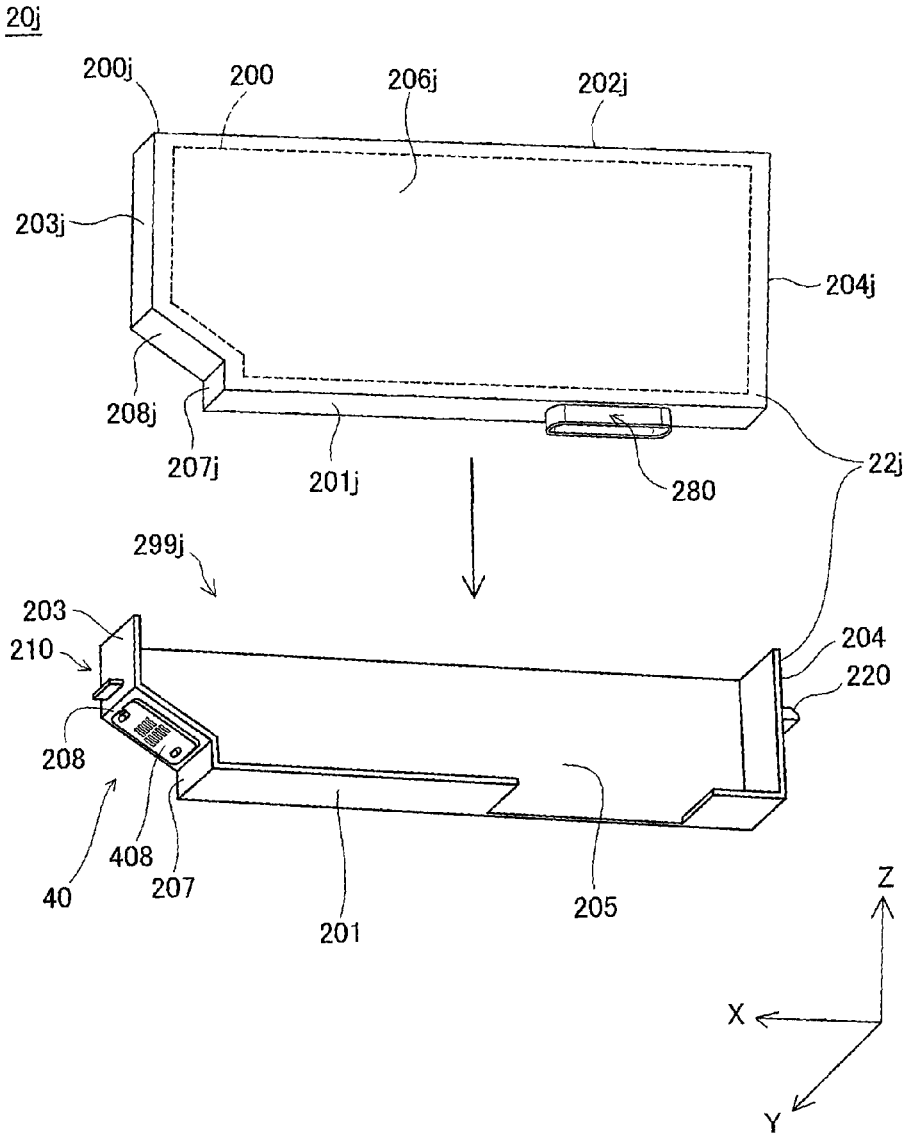
FIG. 37 is a perspective view illustrating the structure of a cartridge with an adapter according to another embodiment.

FIGS. 35 to 37 show modifications of cartridge structure. These cartridges are designed for the printer having the same structure as that of the printer 50 according to the first embodiment. The like elements of these cartridges to those of the cartridge 20 of the first embodiment are expressed by the like symbols.

D-1. Modifications of Cartridge Outer Shape

FIGS. 35A to 35F are conceptual diagrams showing cartridge outer shapes according to other embodiments. A cartridge 20*c* shown in FIG. 35A has a housing 22*c* of an elliptical or oval side face. The cartridge 20*c* has the first cartridge-side restriction portion 210 and the circuit board 40 provided on the front face. The printing material supply port 280 is formed on the bottom face of the cartridge 20*c*, and the second cartridge-side restriction portion 220 is provided on the rear face of the cartridge 20*c*. This cartridge 20*c* has a fixed width, when the cartridge 20*c* is seen from its front face side. This cartridge 20*c* is compatible with the cartridge 20 shown in FIG. 7, as long as the first and second cartridge-side restriction portions 210 and 220, the circuit board 40 and the printing material supply port 280 are structured to be connectable with the corresponding parts in the printer 50.

A cartridge 20*d* shown in FIG. 35B has an approximate rectangular parallelepiped shape like the cartridge 20 shown in FIG. 7. The large difference from the cartridge 20 of FIG. 7 is that the eighth face 208 is not continuous from the lower end of the third face 203. Cartridges 20*e* and 20*f* shown in FIGS. 35C and 35D have no seventh face, which is included in the cartridge 20 of FIG. 7. A cartridge 20*g* shown in FIG. 35E has the circuit board 40 mounted on the eighth face 208 by means of a spring. A cartridge 20*h* shown in FIG. 35F has a movable face 208*h*, in place of the eighth face 208, and the circuit board 40 mounted on the movable face 208*h*. These cartridge 20*c* to 20*g* are also compatible with the cartridge 20 shown in FIG. 7, as long as the first and second cartridge-side restriction portions 210 and 220, the circuit board 40 and the printing material supply port 280 are structured to be connectable with the corresponding parts in the printer 50.

As clearly understood from the examples shown in FIGS. 35A to 35F, there are various other modifications of cartridge outer shape. In the case of the cartridge having the outer shape other than the approximate rectangular parallelepiped, as shown by the broken lines in FIGS. 35A and 35D, the six faces of the rectangular parallelepiped, i.e., the bottom face 201 (first face), the top face 202 (second face), the front face 203 (third face), the rear face 204 (fourth face), the left side face 205 (fifth face) and the right side face 206 (sixth face) can be virtually assumed. In the specification hereof, the terms "face" and "plane" mean both the vertical plane or the non-actual plane as shown in FIG. 35A or 35D and the actual plane as shown in FIGS. 7 and 8. The terms "face" and "plane" include both planar surfaces and curved surfaces.

D-2. Cartridge with Adapter

FIG. 36 is a perspective view illustrating the structure of a cartridge 20*i* with an adapter according to one embodiment. This cartridge 20*i* is separable to a container assembly 200*i* including the printing material chamber 200 and an adapter 299. After the printing material in the printing material chamber 200 is used up, the user replaces the container assembly 200*i* with a new one or refills the printing material into the container assembly 200*i*. The adapter 299 is reusable. This cartridge 20*i* is compatible with the cartridge 20 of the first embodiment shown in FIG. 7.

A housing 22*i* for the cartridge 20*i* is structured as a combination of a housing for the container assembly 200*i* and a housing for the adapter 299*i*. The container assembly 200*i* includes the printing material chamber 200 configured to contain ink, the printing material flow path 282 configured to supply ink or printing material to the printing material supply port and the resin foam 284. The container assembly 200*i* has a second face 202*i* corresponding to the second face 202 of the cartridge 20*i*. The container assembly 200*i* also has a first face 201*i*, a third face 203*i*, a fourth face 204*i*, a fifth face (not shown), a sixth face 206*i*, a seventh face 207*i* and an eighth face 208*i* respectively corresponding to the first face 201 and the third to the eighth faces 203 to 208 of the cartridge 20*i*. The first face 201*i* and the second face 202*i* are opposed to each other in the Z-axis direction; the first face 201*i* is located on the −Z-axis direction side and the second face 202*i* is located on the +Z-axis direction side. The third face 203*i* and the fourth face 204*i* are opposed to each other in the X-axis direction; the third face 203*i* is located on the +X-axis direction side and the fourth face 204*i* is located on the −X-axis direction side. The fifth face (not shown) and the sixth face 206*i* are opposed to each other in the Y-axis direction; the fifth face (not shown) is located on the −Y-axis direction side and the sixth face 206*i* is located on the +Y-axis direction side. The seventh face 207*i* and the eighth face 208*i* form the connection faces of connecting the first face 201*i* with the third face 203*i*. The seventh face 207*i* is perpendicular to the first face 201*i* and forms a plane parallel to the Y axis and the Z axis (YZ plane). The seventh face 207*i* as the step is vertically-angled relative to the first face 201*i*. The seventh face 207*i* is accordingly extended from the first face 201*i* in the +Z-axis direction. The seventh face 207*i* is located on the −X-axis direction side and on the −Z-axis direction side of the eighth face 208*i*. The eighth face 208*i* connects the seventh face 207*i* with the third face 203*i* and is a sloped surface inclined in the direction including a +X-axis direction component and a −Z-axis direction component. The eighth face 208*i* is inclined to the first face 201*i* and the third face 203*i* and is perpendicular to the fifth face (not shown) and the sixth face 206*i*. In other words, the eighth face 208*i* is inclined to the XY plane and the YZ plane and is perpendicular to the XZ plane.

The adapter 299 has the faces corresponding to the first face 201, the third face 203, the fourth face 204, the fifth face 205, the sixth face 206, the seventh face 207 and the eighth face 208 of the cartridge 20*i*. The face of the adapter 299 corresponding to the second face 202 of the cartridge 20*i* is an opening. The adapter 299 has an inner space to receive the container assembly 200*i*. The first face 201 of the adapter 200 has the printing material supply port 280. Otherwise the cartridge 20*i* has the similar structure to that of the cartridge 20 of the first embodiment sown in FIG. 7 with our without some variations. The cartridge 20*i* may thus be structured as the combination of the container assembly 200*i* and the adapter 299 as described above.

FIG. 37 is a perspective view illustrating the structure of a cartridge 20*j* with an adapter according to another embodiment. This cartridge 20*j* is separable to a container assembly 200*j* including the printing material chamber 200 and an adapter 299*j*. After the printing material in the printing material chamber 200 is used up, the user may replace the container assembly 200*j* with a new one or refill the printing material into the container assembly 200*j*. The adapter 299 is reusable. This cartridge 20*j* is compatible with the cartridge 20 of the first embodiment shown in FIG. 7.

A housing 22*j* for the cartridge 20*j* is structured as a combination of a housing for the container assembly 200*j* and a housing for the adapter 299*j*. The container assembly 200*j* includes the printing material chamber 200 configured to contain ink and the printing material supply port 280. The container assembly 200*j* has a second face 202*j* and a sixth face 206*j* respectively corresponding to the second face 202 and the sixth face 206 of the cartridge 20*j*. The container assembly 200*j* also has a first face 201*j*, a third face 203*j*, a fourth face 204*j*, a fifth face (not shown), a seventh face 207*j* and an eighth face 208*j* respectively corresponding to the first face 201, the third face 203, the fourth face 204, the fifth face 205, the seventh face 207 and the eighth face 208 of the cartridge 20*j*. The first face 201*j* and the second face 202*j* are opposed to each other in the Z-axis direction; the first face 201*j* is located on the −Z-axis direction side and the second face 202*j* is located on the +Z-axis direction side. The third face 203*j* and the fourth face 204*j* are opposed to each other in the X-axis direction; the third face 203*j* is located on the +X-axis direction side and the fourth face 204*j* is located on the −X-axis direction side. The fifth face (not shown) and the sixth face 206*j* are opposed to each other in the Y-axis direction; the fifth face (not shown) is located on the −Y-axis direction side and the sixth face 206*j* is located on the +Y-axis direction side. The seventh face 207*j* and the eighth face 208*j* form the connection faces of connecting the first face 201*j* with the third face 203*j*. The seventh face 207*j* is perpendicular to the first face 201*j* and forms a plane parallel to the Y axis and the Z axis (YZ plane). The seventh face 207*j* as the step is vertically-angled relative to the first face 201*j*. The seventh face 207*j* is accordingly extended from the first face 201*j* in the +Z-axis direction. The seventh face 207*j* is located on the −X-axis direction side and on the −Z-axis direction side of the eighth face 208*j*. The eighth face 208*j* connects the seventh face 207*j* with the third face 203*j* and is a sloped surface inclined in the direction including a +X-axis direction component and a −Z-axis direction component. The eighth face 208*j* is inclined to the first face 201*j* and the third face 203*j* and is perpendicular to the fifth face (not shown) and the sixth face 206*j*. In other words, the eighth face 208*j* is inclined to the XY plane and the YZ plane and is perpendicular to the XZ plane.

The adapter 299*j* has the faces corresponding to the first face 201, the third face 203, the fourth face 204 and the fifth face 205 of the cartridge 20*j*. The faces of the adapter 299*j* forming the second face 202 and the sixth face 206 of the cartridge 20*j* are openings. The adapter 299*j* has an inner space to receive the container assembly 200*j*. The adapter 299*j* also has an opening in part of the first face 201. The printing material supply port 280 provided in the container assembly 200*j* is exposed on the opening provided on the first face 201 of the adapter 299*j* and is connected with the printing material supply tube 640 (FIG. 2). The cartridge 20*j* has a first cartridge-side restriction portion 210 of the simpler structure than that of the first embodiment (FIG. 7) but may have the first cartridge-side restriction portion 210 of the same structure as that of the first embodiment (FIG. 7). The cartridge 20*j* has the third face 203 and the fourth face 204 of the lower heights (shorter Z-axis direction lengths) than those of the third face 203 and the fourth face 204 of the first embodiment but may have the third face 203 and the fourth face 204 of the same heights (same Z-axis direction lengths) as those of the first embodiment. The cartridge 20*j* does not have the projection 260 but may have the projection 250 like the first embodiment. Otherwise the cartridge 20*j* has the similar structure to that of the cartridge 20 of the first embodiment sown in FIG. 7 with or without some variations. The cartridge 20*j* may thus be structured by the combination of the container assembly 200*j* and the adapter 299*j* as described above.

Figure 38:
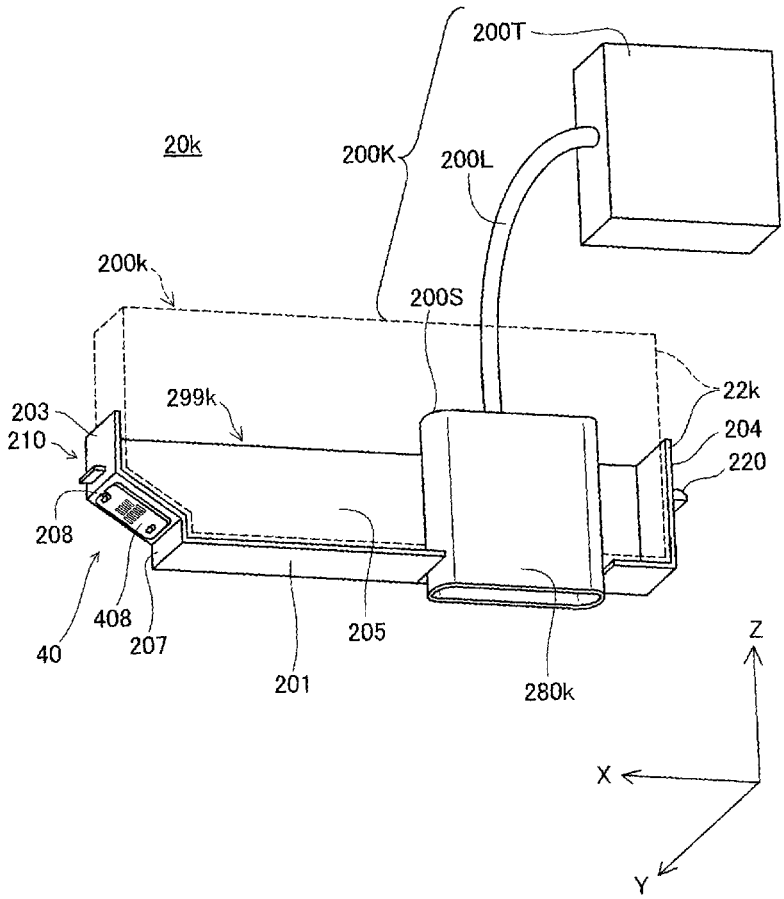
FIG. 38 is a perspective view illustrating the structure of a cartridge with an adapter according to another embodiment.

FIG. 38 is a perspective view illustrating the structure of a cartridge 20*k* with an adapter according to another embodiment. The cartridge 20*k* includes an adapter 299*k*, an external tank 200T, a tube 200L and an auxiliary adapter 200S. The adapter 299*k* has the same structure as that of the adapter 299*j* described above with reference to FIG. 37. The external tank 200T contains printing material and is located outside the printer 50 shown in FIG. 1. The auxiliary adapter 200S has a printing material supply port 280*k*. The tube 200L is used to supply the printing material from the external tank 200T to the auxiliary adapter 200S. The external tank 200T, the auxiliary adapter 200S and the tube 200L serves as a container assembly 200*k* configured to contain ink or printing material. As shown by the broken line in FIG. 38, the cartridge 20*k* of this embodiment is thus assumed to have the container assembly 200*k*. The cartridge 20*k* of this embodiment is thus separable to the container assembly 200*k* and the adapter 299*k*, like the cartridge 20*i* shown in FIG. 36 and the cartridge 20*j* shown in FIG. 37. After the printing material in the external tank 200T is used up, the user may replace the external tank 200T with a new one or refill the printing material into the external tank 200T. The adapter 299*k* is reusable. This cartridge 20*k* is compatible with the cartridge 20 of the first embodiment shown in FIG. 7.

A housing 22*k* of the cartridge 20*k* is structured as a combination of a housing for the virtual container assembly 200*k* and a housing for the adapter 299*k*. The structure of the virtual container assembly 200*k* and the structure of the adapter 299*k* are similar to the structure of the cartridge 20*j* described above with reference to FIG. 37 with our without some variations. Otherwise the cartridge 20*k* has the similar structure to that of the cartridge 20 of the first embodiment sown in FIG. 7 with or without some variations. The cartridge 20*k* may thus be structured by the combination of the container assembly 200*k* and the adapter 299*k* as described above.

E. Modification of Lever

According to the above embodiment, the elastic member 682 is provided separately from the lever 80 (FIG. 22). The lever 80 may be made of an elastically deformable material. A modification of the lever is described with reference to FIGS. 39 and 40.

Figure 39A:
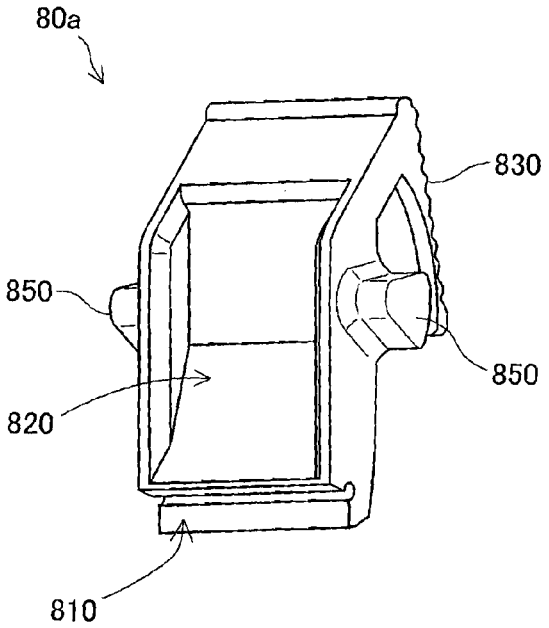
FIGS. 39A and 39B illustrate the structure of a lever according to one modification.
Figure 39B:
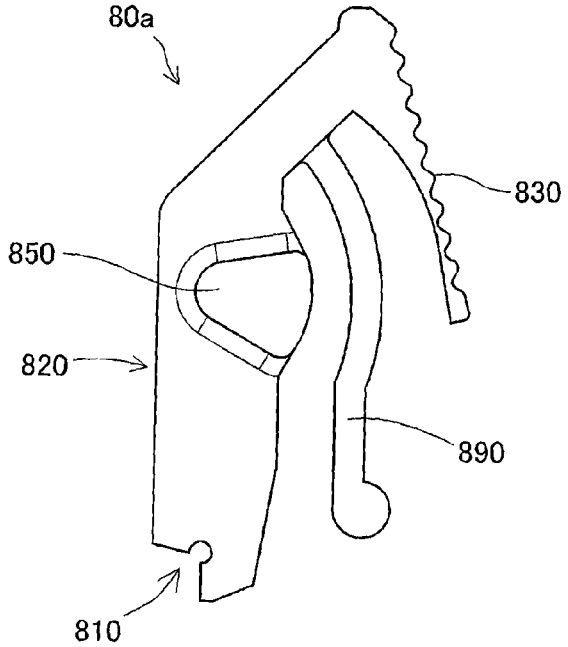

FIGS. 39A and 39B illustrate the structure of a lever 80*a* according to one modification. FIG. 39A is a perspective view showing the appearance of the lever 80*a*, and FIG. 39B is a side view showing the appearance of the lever 80*a*. The differences from the lever 80 of the first embodiment are that the lever 80*a* additionally has an arm member 890 to be elastically deformable, has an operating member 830*a* of a different shape and does not include the groove 870. Otherwise the lever 80*a* has the similar structure to that of the lever 80 according to the first embodiment (FIG. 19). The lever 80*a* is made of a synthetic resin, such as polypropylene.

Figure 40:
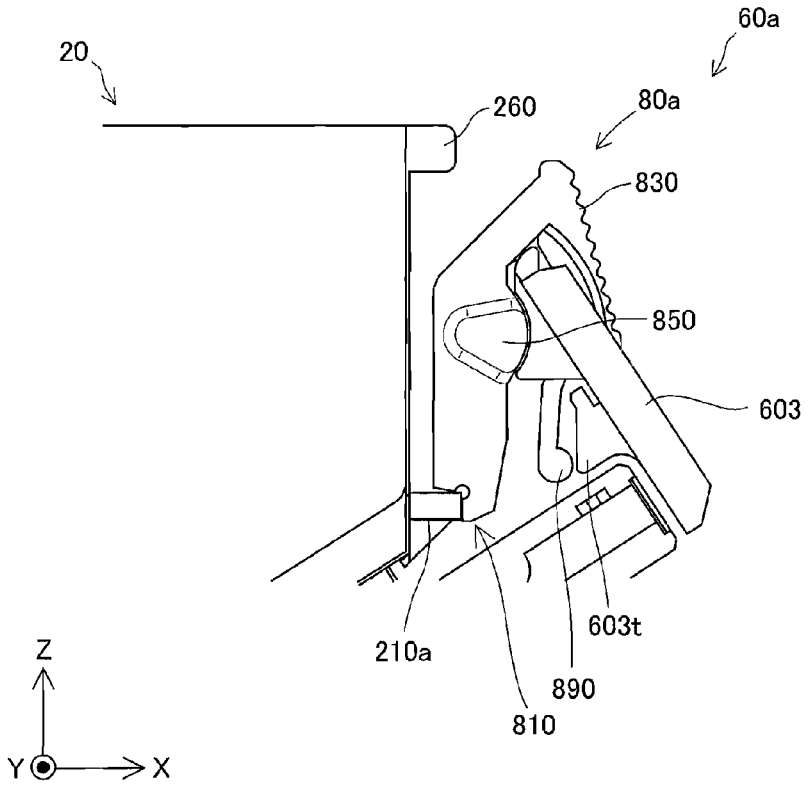
FIG. 40 illustrates attachment of the cartridge to a holder according to one modification.

FIG. 40 illustrates attachment of the cartridge 20 to a holder 60*a*. According to this embodiment, the cartridge 20 has a first cartridge-side restriction portion 210*a* without the second portion 214 (FIG. 12). The shaft body 850 of the lever 80*a* is attached to the first apparatus-side side wall member 603. When the lever 80*a* is turned about the shaft body 850, the arm member 890*a* abuts a projection 603*t* formed as part of the first apparatus-side side wall member 603 to be elastically deformed.

F. Modifications of Cartridge-Side Terminals

Figure 41A:
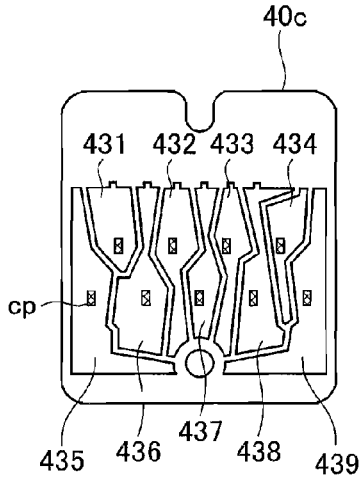
FIGS. 41A to 41C show modifications of the terminal shape.
Figure 41B:
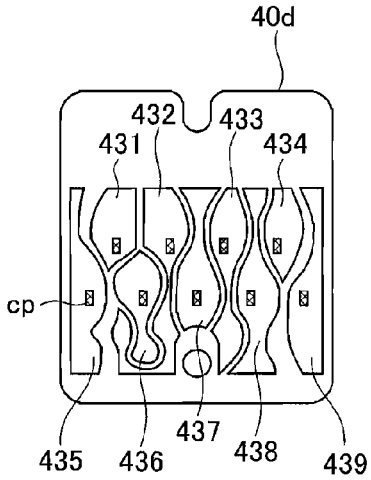
Figure 41C:
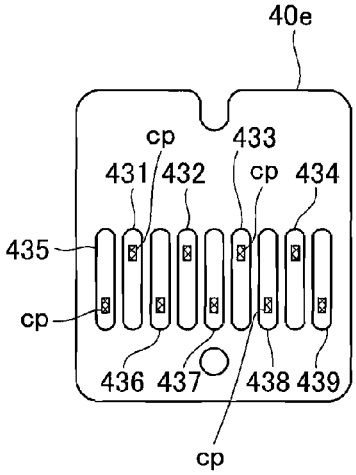

FIGS. 41A to 41C show modifications of the terminal shape on the circuit board. The difference from the circuit board 40 shown in FIG. 10A is that circuit boards 40*c* to 40*e* have different shapes of the terminals 431 to 439. The respective terminals on the circuit board 40*c* shown in FIG. 41A and on the circuit board 40*d* shown in FIG. 41B have irregular shapes, instead of the approximate rectangular shape according to the first embodiment (FIG. 10A). In the circuit board 40*e* shown in FIG. 41C, the nine terminals 431 to 439 are arrayed in one line, wherein the attachment detection terminals 435 and 439 are located on both ends, and the attachment detection terminals 431 and 434 are respectively located between the attachment detection terminal 435 and the power terminal 436 and between the attachment detection terminal 439 and the data terminal 438. In these circuit boards 40*c* to 40*e*, the contact portions "cp" of these terminals 431 to 439, which are in contact with the apparatus-side terminals corresponding to these terminals 431 to 439, have the same arrangement as that of the circuit board 400 shown in FIG. 10A. The individual terminals may have the shapes of various variations as long as the contact portions "cp" have the same arrangement.

G. Modifications

The foregoing has described the invention in detail with reference to the illustrative embodiments. The invention is, however, not limited to the above embodiments, but a multiplicity of variations and modifications may be made to the embodiments without departing from the scope of the invention. Some examples of possible modifications are described below.

G-1. First Modification

According to the above embodiment, the second cartridge-side restriction portion 220 is provided in the form of a projection on the fourth face 204. This structure is, however, not restrictive but any suitable structure may be adopted to engage the fourth face 204-side with the second apparatus-side side wall member 604 of the holder 60. According to one embodiment, the outer surface itself of the fourth face 204 of the cartridge 20 may be in contact with and engaged with the second apparatus-side side wall member 604. According to another embodiment, an elastic member made of, for example, rubber may be provided on the fourth face 204 to restrict the motion of the fourth face 204-side of the cartridge 20 in the +Z-axis direction through the friction of the second apparatus-side side wall member 604 against the elastic member. In the latter embodiment, the second apparatus-side restriction portion 620 provided on the second apparatus-side side wall member 604 (FIG. 15) may be omitted.

The second cartridge-side restriction portion 220 is the projection according to the above embodiment, but may be another form, for example, formed in a concave shape. In this latter application, the second apparatus-side restriction portion 620 provided on the second apparatus-side side wall member 604 may be a projection. According to another embodiment, the holder 60 may have an additional member configured to press the fourth face 204-side of the second face 202 of the cartridge 20 in the −Z-axis direction. For example, the holder 60 may have a slidable rod member. After the cartridge 20 is placed in the cartridge chamber 602, the fourth face 204-side of the second face 202 of the cartridge 20 may be pressed by the rod member.

G-2. Second Modification

The first cartridge-side locking surface 211 is located within the range 40Y according to the above embodiment (FIG. 12) but may be extended outside of the range 40Y.

G-3. Third Modification

The present invention is not restricted to the inkjet printer and its ink cartridge but is applicable to any of various liquid ejection devices configured to eject a liquid other than ink and its liquid container, for example, liquid ejection devices and their liquid containers given below:

(1) image recording device, such as a facsimile machine;

(2) color material ejection device used to manufacture color filters for image display devices, e.g., liquid crystal displays;

(3) electrode material ejection device used to form electrodes of, for example, organic EL (electroluminescence) displays and field emission displays (FED);

(4) liquid ejection device configured to eject a bioorganic material-containing liquid used for manufacturing biochips;

(5) sample ejection device used as a precision pipette;

(6) lubricating oil spray device;

(7) resin solution spray device;

(8) liquid spray device for pinpoint spray of lubricating oil at precision machinery including watches and cameras;

(9) liquid ejection device configured to eject transparent resin solution, such as ultraviolet curable resin solution, onto the substrate, so as to manufacture a hemispherical microlens (optical lens) used for, for example, optical communication elements;

(10) liquid spray device configured to spray an acidic or alkaline etching solution, in order to etch the substrate; and

(11) liquid ejection device equipped with liquid ejection head for ejecting a very small volume of droplets of another arbitrary liquid.

The "liquid droplet" means a state of liquid ejected from the liquid ejection device and may be in a granular shape, a teardrop shape or a tapered threadlike shape. The "liquid" herein may be any material ejectable by the liquid ejection device. The "liquid" may be any material in the liquid phase. For example, liquid-state materials of high viscosity or low viscosity, sols, gel water, various inorganic solvents and organic solvents, solutions, liquid resins and liquid metals (metal melts) are included in the "liquid". The "liquid" is not restricted to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiment and liquid crystal. The "ink" includes general water-based inks and oil-based inks, as well as various liquid compositions, such as gel inks and hot-melt inks.

G-4. Fourth Modification

The invention may be accomplished by the following variations.

First Variation:

A printing apparatus adapted to have a cartridge, which contains a printing material, detachably mounted thereon, comprising:

a cartridge chamber formed in a concave shape to receive a plurality of the cartridges in array and configured to have a bottom face and an opening opposed to the bottom face;

a printing material supply tube located on the bottom face of the cartridge chamber to be connected with the cartridge and configured to allow distribution of the printing material contained in the cartridge;

apparatus-side terminals arranged to be in contact with cartridge-side terminals provided as terminals on the cartridge and apply a force of pressing up the cartridge from the bottom face side toward the opening side of the cartridge chamber, wherein the bottom face side of the cartridge chamber represents a lower side and the opening side of the cartridge chamber represents an upper side; and a lever located on the upper side of the apparatus-side terminals and on an identical side with the apparatus-side terminals relative to the printing material supply tube and used for attachment and detachment of the cartridge to and from the printing apparatus, wherein the lever is structured to rotate about an axis of rotation that is parallel to the arrayed direction of the cartridges, the lever has a first apparatus-side locking portion located on the lower side of the axis of rotation and configured to engage the cartridge and thereby restrict motion of the cartridge toward the opening side, wherein the first apparatus-side locking portion is moved in a direction away from the cartridge to disengage the cartridge, and the engagement position between the first apparatus-side locking portion and the cartridge is located on the lower side of the axis of rotation and closer to the printing material supply tube than the axis of rotation.

Second Variation:

A printing apparatus adapted to have a cartridge, which contains a printing material, detachably mounted thereon, comprising:

a cartridge chamber arranged to receive the cartridge therein and structured to have an opening, which the cartridge passes through for attachment or detachment;

a printing material supply tube formed in a first face, which is one surface of the cartridge chamber, to be connected with the cartridge;

apparatus-side terminals arranged to be in contact with cartridge-side terminals and apply a force of pressing up the cartridge; and a lever located on an identical side with the apparatus-side terminals relative to the cartridge and at a position closer to the opening than the apparatus-side terminals, wherein the lever is structured to rotate about an axis of rotation that is parallel to an arrayed direction of the cartridge, the lever has a first apparatus-side locking portion configured to engage the cartridge and thereby restrict motion of the cartridge, wherein the first apparatus-side locking portion is moved in a direction away from the cartridge to disengage the cartridge, and the engagement position between the first apparatus-side locking portion and the cartridge is located closer to the apparatus-side terminals and closer to the printing material supply tube than the axis of rotation.

In the printing apparatus according to the first variation or according to the second variation, in the attached state of the cartridge to the printing apparatus, an external force is applied to rotate the cartridge relative to the lever about the axis of rotation in a direction opposite to the unlocking or disengaging direction. This reduces the possibility that the cartridge is disengaged from the first apparatus-side locking portion and thereby ensures the stable electrical connection between the cartridge-side terminals and the apparatus-side terminals.

Any of various features and specifications included in the respective aspects and embodiments described in Summary may be added to either of the first variation and the second variation.

What is claimed is:

1. A printing apparatus adapted to have a cartridge detachably mounted thereon, wherein three space axes orthogonal to one another are represented by an X-axis, a Y-axis and a Z-axis of the cartridge, the cartridge comprising:

a first face located on a −Z-axis direction side and a second face located on a +Z-axis direction side, as two surfaces opposed to each other in the Z-axis direction;

a third face located on a +X-axis direction side and a fourth face located on a −X-axis direction side, as two surfaces opposed to each other in the X-axis direction;

a fifth face located on a −Y-axis direction side and a sixth face located on a +Y-axis direction side, as two surfaces opposed to each other in the Y-axis direction;

a cartridge-side corner section arranged to connect the first face with the third face;

a printing material supply port placed on the first face and configured to supply printing material to the printing apparatus;

a first cartridge-side restriction portion placed on the third face;

a sloped surface arranged to form part of the cartridge-side corner section and inclined in a specific direction including the +X-axis direction component and the −Z-axis direction component; and a plurality of cartridge-side terminals located on the sloped surface, wherein the X axis, the Y axis and the Z axis with respect to the printing apparatus in an attached state of the cartridge to the printing apparatus respectively correspond to an X axis, a Y axis and a Z axis of the printing apparatus, the printing apparatus comprising:

a cartridge mounting structure configured to have: (i) an apparatus-side bottom wall member opposed to the first face of the cartridge in the attached state; (ii) a first apparatus-side side wall member opposed to the third face of the cartridge in the attached state; and (iii) a second apparatus-side side wall member opposed to the fourth face of the cartridge in the attached state;

a printing material supply tube structured to have a central axis parallel to the Z-axis, a base end provided on the apparatus-side bottom wall member and a peripheral end to be connected with the printing material supply port;

a plurality of apparatus-side terminals located in an apparatus-side corner section where the apparatus-side bottom wall member intersects the first apparatus-side side wall member, wherein in the attached state, the respective apparatus-side terminals are in contact with the respective cartridge-side terminals to apply a force to the cartridge in a specific direction including the +Z-axis direction component; and a lever placed on the first apparatus-side side wall member in a rotatable manner to be used for attachment and detachment of the cartridge to and from the printing apparatus, wherein the lever is structured to have: an operating member located at the +Z-axis direction end and configured to receive an external force applied by a user; and a first apparatus-side locking portion located at the −Z-axis direction end, wherein in the attached state, the first apparatus-side locking portion engages with the first cartridge-side restriction portion of the cartridge, so as to restrict motion of the cartridge in the +Z-axis direction, the lever additionally has an axis of rotation at a specific position between the operating member and the first apparatus-side locking portion, wherein in the attached state, the axis of rotation is located on the +Z-axis direction side and on the +X-axis direction side of a specified locking position where the first apparatus-side locking portion engages with the first cartridge-side restriction portion, and when an external force is applied to the operating member of the lever from the +X-axis direction to the −X-axis direction, the lever moves the first apparatus-side locking portion about the axis of rotation from the specified locking position toward the +X-axis direction and disengages the first apparatus-side locking portion from the first cartridge-side restriction portion, so as to eliminate the restriction of the motion of the cartridge.

2. The printing apparatus according to claim 1, wherein the lever additionally has a second apparatus-side locking portion located at the −Z-axis direction end, wherein in the attached state, the second apparatus-side locking portion engages with a second abutting part of the first cartridge-side restriction portion, which is different from a first abutting part of the first cartridge-side restriction portion that is engaged with the first apparatus-side locking portion, so as to restrict motion of the cartridge in the +X-axis direction.

3. The printing apparatus according to claim 1, wherein the first apparatus-side locking portion has a cross section that is parallel to both the X axis and the Z axis and is formed in an arc shape about the axis of rotation.

4. The printing apparatus according to claim 3, wherein the axis of rotation is located at a position near to the specified locking position with respect to the X-axis direction.

5. The printing apparatus according to claim 1, wherein the lever additionally has a guide member configured to guide the first cartridge-side restriction portion to the first apparatus-side locking portion while restricting motion of the cartridge both in the X-axis direction and in the Y-axis direction, when the cartridge is mounted on the cartridge mounting structure.

6. The printing apparatus according to claim 5, wherein the guide member has a guide bottom wall formed along the Y-axis direction and a pair of guide walls vertically angled toward the −X-axis direction from the guide bottom wall and opposed to each other in the Y-axis direction, the guide bottom wall and the pair of guide walls are extended from a location of the operating member of the lever to a location of the first apparatus-side locking portion, and distance between the pair of guide walls is less than the Y-axis direction length of the cartridge in the attached state but is greater than the Y-axis direction length of the first cartridge-side restriction portion in the attached state.

7. The printing apparatus according to claim 6, wherein one of the pair of guide walls is located at the −Y-axis direction end of the guide bottom wall, the other of the pair of guide walls is located at the +Y-axis direction end of the guide bottom wall, and the guide member is arranged to form a recess by the guide bottom wall and the pair of guide walls to receive the first cartridge-side restriction portion.

8. The printing apparatus according to claim 1, wherein the operating member of the lever is structured to have: an operation surface arranged to receive an external force applied to the operating member to eliminate the restriction of the motion of the cartridge by the first apparatus-side locking portion; and an operating-member opposed surface arranged to be in contact with a projection located on the +Z-axis direction side of the first cartridge-side restriction portion located on the third face of the cartridge, wherein the operating-member opposed surface comes into contact with the projection to apply a force in a specific direction including the +Z-axis direction component to the cartridge and thereby eliminate the restriction of the motion of the cartridge.

9. The printing apparatus according to claim 8, wherein the operating-member opposed surface is inclined in a specific direction including the −X-axis direction component and the +Z-axis direction component in the attached state.

10. The printing apparatus according to claim 1, further comprising:

an elastic member that is elastically deformable, wherein the elastic member is configured to apply an external force including the−X-axis direction component to a specific part of the lever located on the −Z-axis direction side of the axis of rotation at least during a mounting operation of mounting the cartridge on the cartridge mounting structure.

11. The printing apparatus according to claim 10, wherein the elastic member is arranged to apply the external force to the specific part of the lever located on the −Z-axis direction side of the axis of rotation in the attached state.

12. The printing apparatus according to claim 10, wherein the elastic member is arranged to apply no external force to the lever in the attached state.

13. The printing apparatus according to claim 1, wherein the lever has center of gravity at a location where the first apparatus-side locking portion is moved to the specified locking position by dead weight of the lever.

14. The printing apparatus according to claim 1, wherein the lever additionally has a pair of shaft bodies to form the axis of rotation, and one of the pair of shaft bodies is provided as a projection protruded from an outer surface on the +Y-axis direction side and the other of the pair of shaft bodies is provided as a projection protruded from an outer surface on the −Y-axis direction side.

15. The printing apparatus according to claim 14, wherein each of the pair of shaft bodies is structured to have: a first curved surface arranged to form a first arc about the axis of rotation on a cross section parallel to both the X axis and the Z axis; and a second curved surface arranged to form a second arc about the axis of rotation on the cross section parallel to both the X axis and the Z axis, wherein the second arc has a greater radius than radius of the first arc, and the first curved surface is located on the −X-axis direction side of the second curved surface.

16. The printing apparatus according to claim 1, further comprising:

a second apparatus-side restriction portion located on the second apparatus-side side wall member, wherein the second apparatus-side restriction portion engages with a second cartridge-side restriction portion located on the fourth face of the cartridge, so as to restrict motion of the cartridge in the +Z-axis direction.

17. The printing apparatus according to claim 16, wherein the second apparatus-side restriction portion is provided as a recess or a through hole to receive the second cartridge-side restriction portion as a projection formed on the fourth face of the cartridge.

18. The printing apparatus according to claim 1, further comprising:

a third apparatus-side restriction portion formed on the apparatus-side bottom wall member at a location nearer to the first apparatus-side side wall member than the printing material supply tube, wherein the third apparatus-side restriction portion is provided as a projection, wherein in the attached state, the projection is located between a pair of projection members protruded from in the +X-axis direction from a stepped surface, which is formed to connect the sloped surface with the first face of the cartridge, to restrict motion of the cartridge in the Y-axis direction.

19. A printing material supply system, comprising:

the printing apparatus according to claim 1; and a cartridge, the cartridge comprising:

a first face located on a −Z-axis direction side and a second face located on a +Z-axis direction side, as two surfaces opposed to each other in the Z-axis direction;

a third face located on a +X-axis direction side and a fourth face located on a −X-axis direction side, as two surfaces opposed to each other in the X-axis direction;

a fifth face located on a −Y-axis direction side and a sixth face located on a +Y-axis direction side, as two surfaces opposed to each other in the Y-axis direction;

a cartridge-side corner section arranged to connect the first face with the third face;

a printing material supply port placed on the first face and configured to supply printing material to the printing apparatus;

a first cartridge-side restriction portion placed on the third face;

a sloped surface arranged to form part of the cartridge-side corner section and inclined in a specific direction including the +X-axis direction component and the −Z-axis direction component; and a plurality of cartridge-side terminals located on the sloped surface.

* * * * *